US007457570B2

(12) United States Patent
Kasai et al.

(10) Patent No.: US 7,457,570 B2
(45) Date of Patent: Nov. 25, 2008

(54) IMAGE FORMING APPARATUS INCLUDING A MAGNETIC BRUSH DEVELOPING SYSTEM USING A TWO-COMPONENT DEVELOPER COMPRISING TONER AND CARRIER

(75) Inventors: Tadashi Kasai, Tokyo (JP); Hideki Kimura, Kanagawa (JP); Tsuyoshi Imanura, Kanagawa (JP); Katsumi Masuda, Tokyo (JP); Hideo Yoshizawa, Saitama (JP); Kiyotaka Sakai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 317 days.

(21) Appl. No.: 11/197,548

(22) Filed: Aug. 5, 2005

(65) Prior Publication Data

US 2006/0029435 A1 Feb. 9, 2006

(30) Foreign Application Priority Data

| | | |
|---|---|---|
| Aug. 6, 2004 | (JP) | 2004-230226 |
| Sep. 17, 2004 | (JP) | 2004-270764 |
| Nov. 30, 2004 | (JP) | 2004-346088 |
| May 9, 2005 | (JP) | 2005-135608 |
| May 11, 2005 | (JP) | 2005-139176 |
| May 19, 2005 | (JP) | 2005-146964 |

(51) Int. Cl.
*G03G 15/09* (2006.01)

(52) U.S. Cl. ..... 399/267; 399/167; 399/270

(58) Field of Classification Search ..... 399/111, 399/167, 252, 265, 266, 267, 270
See application file for complete search history.

(56) References Cited

U.S. PATENT DOCUMENTS

| | | | |
|---|---|---|---|
| 4,975,748 | A | 12/1990 | Koinuma et al. |
| 5,003,354 | A | 3/1991 | Takamiya et al. |
| 5,105,226 | A | 4/1992 | Sugihara |
| 5,244,741 | A | 9/1993 | Nagano et al. |
| 5,384,628 | A | 1/1995 | Takami et al. |
| 5,394,231 | A | 2/1995 | Sudo et al. |
| 5,552,877 | A | 9/1996 | Ishikawa et al. |
| 5,592,267 | A | 1/1997 | Misago et al. |
| 5,612,769 | A | 3/1997 | Sugihara et al. |
| 5,617,198 | A | 4/1997 | Ishikawa et al. |
| 5,638,158 | A | 6/1997 | Sanpe et al. |

(Continued)

FOREIGN PATENT DOCUMENTS

| | | |
|---|---|---|
| JP | 2000-227690 | 8/2000 |

(Continued)

OTHER PUBLICATIONS

U.S. Appl. No. 11/777,645, filed Jul. 13, 2007, Kimura.

*Primary Examiner*—Hoan H Tran
(74) *Attorney, Agent, or Firm*—Oblon, Spivak, McClelland, Maier & Neustadt, P.C.

(57) ABSTRACT

It is an object of the present invention to provide a process unit and an image forming apparatus in which generation of loss of image density due to flying off of developer and the edge effect occurring as a side-effect under developing conditions aimed at improving development performance can be reduced, even when a DC bias development system is adopted, and which can suppress developing density unevenness caused by impact occurring on contact of the teeth of gears in the drive system.

52 Claims, 28 Drawing Sheets

U.S. PATENT DOCUMENTS 5,758,235 A 5/1998 Kosuge et al.
5,765,059 A 6/1998 Kosuge et al.
5,768,662 A 6/1998 Sugihara et al.
5,768,664 A 6/1998 Kosuge et al.
5,787,328 A 7/1998 Sugihara et al.
5,794,108 A 8/1998 Yoshizawa et al.
5,850,586 A 12/1998 Sugihara et al.
5,878,317 A 3/1999 Masuda et al.
5,940,664 A 8/1999 Sugihara et al.
5,946,529 A 8/1999 Sato et al.
5,956,549 A 9/1999 Sugihara et al.
5,970,290 A 10/1999 Yoshiki et al.
5,970,294 A 10/1999 Narita et al.
5,991,569 A 11/1999 Sugihara et al.
6,070,037 A 5/2000 Sugihara et al.
6,070,038 A 5/2000 Imamura et al.
6,072,967 A 6/2000 Sugihara et al.
6,104,900 A 8/2000 Ishikawa et al.
6,112,042 A 8/2000 Imamura et al.
6,122,469 A 9/2000 Miura et al.
6,141,520 A 10/2000 Kosuge
6,198,895 B1 3/2001 Tsuda et al.
6,226,481 B1 5/2001 Yoneda et al.
6,330,415 B1 12/2001 Imamura et al.
6,336,020 B1 1/2002 Ishikawa et al.
6,337,957 B1 1/2002 Tamaki et al.
6,393,241 B1 5/2002 Matsumoto et al.
6,501,913 B2 12/2002 Hattori et al.
6,522,855 B1 2/2003 Katoh et al.
6,553,202 B2 4/2003 Tamaki et al.
6,591,077 B2 7/2003 Yanagisawa et al.
6,615,014 B2 9/2003 Sugihara
6,628,908 B2 9/2003 Matsumoto et al.
6,665,508 B2 12/2003 Sudo et al.
6,696,213 B2 * 2/2004 Yamaguchi et al. ..... 430/122.2
6,697,593 B2 2/2004 Imamura et al.
6,751,433 B2 6/2004 Sugihara
6,763,214 B2 7/2004 Sugihara
6,775,503 B2 8/2004 Hattori et al.
6,795,673 B2 9/2004 Yoshizawa
6,813,460 B2 11/2004 Sudo et al.
6,887,636 B2 5/2005 Matsuda et al.
6,898,406 B2 * 5/2005 Suzuki et al. ..... 399/277
6,899,986 B2 5/2005 Aoki et al.
6,925,277 B2 8/2005 Sugihara
2004/0018031 A1 1/2004 Imamura et al.
2004/0076443 A1 4/2004 Suzuki et al.
2004/0091287 A1 5/2004 Matsumoto et al.
2004/0113118 A1 6/2004 Kamoi et al.
2004/0114971 A1 6/2004 Sakai et al.
2004/0126139 A1 7/2004 Yoshizawa et al.
2004/0146319 A1 7/2004 Sudo et al.
2004/0197119 A1 10/2004 Matsumoto et al.
2004/0241566 A1 12/2004 Suzuki et al.
2004/0258436 A1 12/2004 Nakamura et al.
2005/0025535 A1 2/2005 Koichi et al.
2005/0030595 A1 2/2005 Koichi et al.
2005/0031374 A1 2/2005 Nagashima et al.
2005/0036810 A1 2/2005 Murakami et al.
2005/0063738 A1 3/2005 Kamiya et al.
2005/0079430 A1 4/2005 Aoki et al.
2005/0111882 A1 5/2005 Sudo et al.
2005/0135843 A1 6/2005 Kakegawa et al.
2006/0029435 A1 2/2006 Kasai et al.

FOREIGN PATENT DOCUMENTS

JP 2001-324862 11/2001
JP 2003-122127 4/2003
JP 2003-255627 9/2003

* cited by examiner

FIG. 20

| MODULUS | NUMBER OF TEETH | DEVELOPING ROLLER DIAMETER (mm) | LINEAR SPEED RATIO | IMAGE FREQUENCY (T/mm) | BRIGHTNESS AMPLITUDE | VISUAL EVALUATION |
|---|---|---|---|---|---|---|
| 0.6 | 23 | 18.2 | 2.0 | 0.80451949 | OK | ALTHOUGH SLIGHT UNEVENNESS IS PRESENT, THIS IS NOT NOTICEABLE |
| 0.8 | 17 | 18.2 | 2.0 | 0.59464484 | NG | MARKED UNEVENNESS |
| 0.6 | 23 | 18.2 | 1.8 | 0.72067540 | OK | ALTHOUGH SLIGHT UNEVENNESS IS NOTED, IT IS WITHIN THE ALLOWED LEVEL |
| 0.8 | 17 | 18.2 | 1.8 | 0.53518036 | NG | MARKED UNEVENNESS |
| 0.8 | 17 | 18.0 | 1.5 | 0.45093901 | NG | MARKED UNEVENNESS |
| 0.5 | 27 | 18.2 | 2.0 | 0.94443593 | OK | NO UNEVENNESS |
| 0.6 | 23 | 16.0 | 2.0 | 0.91514092 | OK | ALTHOUGH SLIGHT UNEVENNESS IS PRESENT, THIS IS NOT NOTICEABLE |
| 0.5 | 27 | 16.0 | 2.0 | 1.07429587 | OK | NO UNEVENNESS |

FIG. 34

| | DEVELOPMENT CONDITION | | | | TWO-COMPONENT DEVELOPER | CARRIER | | TONER |
|---|---|---|---|---|---|---|---|---|
| | DEVELOPMENT BIAS SYSTEM | LINEAR SPEED RATIO (Vs/Vp) | DEVELOPING GAP (mm) | AMOUNT PICKED UP (g/cm³) | TONER DENSITY (%) | VOLUME AVERAGE PARTICLE SIZE (μm) | ELECTRICAL RESISTANCE (Ω·cm) | VOLUME AVERAGE PARTICLE SIZE (μm) |
| TEST EXAMPLE 1 | DC | 1.90 | 0.32 | 0.07 | 7% | 35 | 7.0 Log | 6.8 |
| TEST EXAMPLE 2 | DC | 1.90 | 0.32 | 0.07 | 5% OR 7% | 50 | 7.0 Log | 6.8 |
| TEST EXAMPLE 3 | DC | 1.80 | 0.40 | 0.07 | 5% OR 7% | 55 | 8.5 Log | 6.8 |
| TEST EXAMPLE 4 | DC | 2.00 | 0.25 | 0.07 | 5% OR 7% | 55 | 8.5 Log | 6.8 |
| COMPARATIVE EXAMPLE 1 | AC+DC | 1.57 | 0.47 | 0.07 | 5% | 55 | 8.5 Log | 6.8 |
| COMPARATIVE EXAMPLE 2 | DC | 1.57 | 0.47 | 0.07 | 5% | 55 | 8.5 Log | 6.8 |

IMAGE FORMING APPARATUS INCLUDING A MAGNETIC BRUSH DEVELOPING SYSTEM USING A TWO-COMPONENT DEVELOPER COMPRISING TONER AND CARRIER

BACKGROUND OF THE INVENTION

1. Field of the Invention

The present invention relates to an image forming apparatus in which an electrophotographic system is adopted, such as copiers, printers or facsimile machines, particularly relates to an image forming apparatus in which a magnetic brush developing system using a two-component developer comprising a toner and carrier is adopted.

2. Description of the Related Art

In image forming apparatuses in which an electrophotographic system is adopted, such as computers, printers or facsimile machines, an electrostatic latent image corresponding to image information is formed on a photosensitive body constituting an image carrier as disclosed for example in Laid-open Japanese Patent Application No. 2000-227690 and this electrostatic latent image is converted to a visible image by toner acting as developer within a developer device so that a toner image is obtained. In execution of this development process, in an image forming apparatus of this type, in view of considerations regarding for example toner charging stability or charging performance and development performance, the magnetic brush development system using a two-component developer comprising a toner and carrier is often employed. This magnetic brush development system is a system in which the toner is charged up by friction between the toner and carrier, a magnetic brush is formed on a developing roller constituting a developer carrier, and development of the latent image on the photosensitive body is performed by means of this magnetic brush. The magnetic brush attaches charged toner to spikes formed from the carrier. The developing roller comprises a magnet roller comprising a non-magnetic sleeve and a plurality of magnetic poles that are arranged within this developing sleeve: a magnetic field such as to cause the developer to sprout up in the form of spikes is formed on this developing sleeve. The developer, in which these spikes are created on the sleeve surface, moves by movement of this developing sleeve or the magnet roller. The developer on the sleeve that is conveyed in the developing region facing the photosensitive body causes spikes to sprout up along the lines of magnetic force generated from the developing magnetic poles of the aforementioned magnet roller. The developing agent that causes this sprouting up in the form of spikes produces a visible image by contacting the surface of the photosensitive body in a grazing fashion and supplying toner in respect of the electrostatic latent image in an amount based on the relative linear speed ratio of the photosensitive body and the developing roller.

In an image forming apparatus of this type, for example the DC bias development system, in which development is performed using DC voltage or the DC/AC bias development system, in which development is performed by superimposing an AC voltage on a DC voltage, is employed. In the DC/AC bias development system, fine line reproducibility can be improved and gradation reproducibility can be improved by using the AC voltage to produce vibration of the toner in the space in the developing region; also, with the DC bias development system, development performance in terms of toner deposition performance onto the photosensitive body is inferior to that in the case of the DC/AC bias development system. It has therefore come to be recognized, as mentioned in for example Laid-open Japanese Patent Application No. 2004-133178, that images of better image quality can be obtained with the DC/AC bias development system than in the case of the DC bias development system.

However, regarding the ground contamination characteristic of the photosensitive body, the DC bias development system is much better as regards this degree of ground contamination than the DC/AC bias development system. This is because, compared with the DC/AC bias development system, in which the toner tends to fly off during cycling between the developing roller and the photosensitive body, due to superimposition of an AC voltage on the DC voltage, in the DC bias development system, there are far fewer opportunities for the toner to fly off, since the electrical field acts unidirectionally from the developing roller to the photosensitive body.

Furthermore, in recent years, in image forming apparatuses of this type, instead of pulverized toner, polymer toner has come to be employed, that is manufactured by a polymerization method and that provides high image quality and high transfer efficiency due to its narrow particle size distribution and uniform shape. In the case of image forming apparatuses using polymer toner, reproducibility of fine details is sometimes better in the case of the DC bias development system than in the case of the DC/AC bias development system, so it cannot necessarily be said that the DC/AC bias development system is always better in terms of image quality. Also, the DC bias development system, in which only DC voltage is employed and AC voltage is not employed, has the considerable user merit that costs can be lowered due to the fact that a DC power source is not required. It is therefore expected that image forming apparatuses adopting the DC bias development system and employing polymer toner will become predominant in the future, since they combine advantages in terms of both image quality and costs.

However, the DC bias development system has unsatisfactory development performance compared with the DC/AC bias development system. Efforts are therefore being made to compensate for this by improving the development process and the developer. These require for example increase of the linear speed ratio Vs/Vp of the developing sleeve linear speed Vs and the photosensitive body linear speed Vp, or raising of the toner density. However, although making the linear speed ratio Vs/Vp large improves development performance, it results in a severe so-called edge effect, in which the amount of toner deposited at the edges of the electrostatic latent image on the photosensitive body is increased. Specifically, the so-called image density loss phenomenon is generated, in which peripheral portions of block regions or halftone regions in the image are emphasized and portions further on the outside thereof lose image density. For example, if block regions are present in the halftone regions of the image, the halftone portions in the peripheral portion of the block regions are not developed, due to the edge effect, and so lose image density.

It is also possible to improve development performance by making the developing gap, which is the gap between the photosensitive body and the developing sleeve in the developing region, narrow. However, although development performance is improved by reducing the developing gap, the sliding frictional force with the photosensitive body produced by the magnetic brush is augmented, resulting in a severe edge effect as described above, with the result that loss of image density occurs due to the edge effect. This has side-effects including loss of image density at the rear edge of the image, deterioration of reproducibility of transverse lines, and decreased life of the developer due to increased stress on the developer. Furthermore, although decreasing the developing gap improves the development performance, sliding frictional force when the magnetic brush applies pressure to the photosensitive body is increased. As a result, since the amount of toner that is held by the spikes of developer that contribute to development is reduced, the phenomenon of toner that has already been developed being, contrariwise, scraped off the photosensitive body after development i.e. the "reverse development" phenomenon occurs. As a result, blurring of the rear edge portion of the image or loss of image density of peripheral portions of block images occurs. In particular, in cases where the arrangement is such that the angle of the main magnetic pole of the developing roller and the photosensitive body becomes 0°, impact with the photosensitive body takes place in a condition with the developer spikes standing out therefrom in a location in which the developing gap is at its narrowest, so a considerable amount of toner is scraped off. Consequently, the problem arises that the rear edge portion of the image is blurred or the phenomenon of loss of image density of the peripheral portion of block images occurs, resulting in considerable loss of image quality.

Furthermore, as mentioned for example in Laid-open Japanese Patent Application No. 2003-240065, in recent years, in which the developing gap has been further narrowed, unevenness of density of development caused by minute vibrations of the developer carrier such as the developing roller have tended to become more noticeable. The reason for this is that the degree of variation of the width of the developing region produced by such vibration and the instantaneous rate of change of developer performance increase as the developing gap is narrowed. Consequently, even if misalignment of axes of the rotary shafts of the gears in the drive transmission system of an image forming apparatus and the various process devices is cancelled, unevenness of development density tends to occur due to minute vibration of the developer carrier caused by factors other than such misalignment of axes. For example, although minute vibration of the developing sleeve was caused by meshing impact of the teeth of adjacent gears provided to drive this developing sleeve, in conventional devices, in which the developing gap was set comparatively wide, the unevenness of developing density produced by such vibration was not particularly noticeable. However, in recent years, in which the width of the developing gap has been continually reduced, unevenness of developing density produced by such vibration has become serious. A further problem is that unevenness of developing density is also produced by transmission to the image carrier of minute vibration caused by meshing impact of the teeth of adjacent gears in the drive transmission system of other image forming units, such as the photosensitive body, provided in the vicinity of the image carrier.

Technologies relating to the present invention are also disclosed in, e.g., Laid-open Japanese Patent Application No. 2003-255627.

SUMMARY OF THE INVENTION

In view of the foregoing, an object of the present invention is to provide a process unit and image forming apparatus in which flying off of developer and occurrence of loss of image density are reduced.

A second object of the present invention is to provide a process unit and image forming apparatus in which flying off of developer and occurrence of loss of image density due to the edge effect, occurring as a by-product under developing conditions such as to enhance development performance are reduced, even in the case where a DC bias developing system is adopted.

A third object of the present invention is to provide a process unit and image forming apparatus in which it is possible to suppress unevenness of developing density produced by meshing impact of the teeth of adjacent gears in the drive system of the image forming apparatus and process unit.

An image forming apparatus in accordance with the present invention comprises an image carrier; a developer carrier comprising a plurality of magnetic poles fixedly arranged within a rotating non-magnetic sleeve, for carrying on its surface as a magnetic brush two-component developer containing toner and carrier and for supplying toner in a development region facing this image carrier to a latent image on this image carrier; and a transfer body onto which the toner image on this image carrier is transferred. The transfer body is arranged above the image carrier and the developer carrier. The center line of the half value width of the magnetic field produced by a developing magnetic pole for erecting the magnetic brush in the form of spikes in the development region is below the line segment joining the center of rotation of this image carrier and the center of rotation of this developer carrier.

A process unit that is removably mountable on the main body of an image forming apparatus in accordance with the present invention comprises an image carrier that carries at least a latent image on its surface; a developer carrier that moves carrying developer; a developing device that develops a latent image on the image carrier by means of developer carried on the moving surface of this image carrier; and a drive transmission gear train comprising a plurality of gears that relay rotary drive force that is transmitted from a drive source provided on the image forming apparatus main body and transmit this rotary drive force to this developer carrier. The number of moving teeth on the path of rotation of the respective gears that constitute the drive transmission gear train during movement by 1 mm over the surface of the image carrier is at least 0.72 teeth.

An image forming apparatus in accordance with the present invention comprises an image carrier that carries at least a latent image on its moving surface; a developer carrier that moves carrying developer; a developing device that develops a latent image on the image carrier by means of developer carried on the moving surface of this image carrier; and a drive source that drives in rotation the developer carrier. The developing device is provided with a drive transmission gear train comprising a plurality of gears that relay rotary drive force that is transmitted from the drive source and transmit this rotary drive force to the developer carrier. The number of moving teeth on the path of rotation of the respective gears within the drive transmission gear train during movement by 1 mm over the surface of the image carrier is at least 0.72 teeth.

An image forming apparatus in accordance with the present invention comprises an image carrier that carries at least a latent image on its moving surface; a developer carrier that moves carrying developer; a developing device that develops a latent image on the image carrier by means of developer carried on the moving surface of this image carrier; a transfer device that transfers a visible image on the image carrier onto a surface-movement element whose surface moves in a position facing the image carrier or a recording body carried on the surface of this surface-movement element; and a drive source that provides drive force to the surface-movement element. The transfer device is provided with a drive transmission gear train comprising a plurality of gears that relay rotary drive force that is transmitted from the drive source that is provided on the image forming apparatus main body and transmit this rotary drive force to the surface-movement element. The number of moving teeth on the path of rotation of the respective gears within the drive transmission gear train during movement by 1 mm over the surface of the image carrier is at least 0.72 teeth.

An image forming apparatus in accordance with the present invention comprises an image carrier that carries a latent image on its moving surface; a developer carrier that moves carrying developer; and a developing device that develops a latent image on the image carrier by means of developer carried on the moving surface of this image carrier. The developing bias that is applied to said developer carrier is DC voltage. The linear speed ratio Vs/Vp of the linear speed Vp of the image carrier and the linear speed Vs of the developer carrier is in the range 1.7 to 2.0. The developing gap Gp of the image carrier and the developer carrier is in the range 0.1 to 0.45 mm.

An image forming apparatus in accordance with the present invention comprises an image carrier that carries a latent image on its surface; a developer carrier that moves carrying developer; and a developing device that develops a latent image on the image carrier by means of developer carried on a moving surface of this image carrier. The developer carrier incorporates a magnet roller comprising a plurality of magnetic poles. The magnet roller comprises a main magnetic pole that forms a magnetic brush for causing sliding contact of developer with the image carrier. The angle R made by the line joining the center of the half value width of the magnetic field produced by the main magnetic pole and the center of rotation of the developer carrier with the line joining the center of rotation of the image carrier and the center of rotation of the developer carrier is in the range 2° to 8.5° with respect to the upstream direction in which the developer carrier rotates.

BRIEF DESCRIPTION OF THE DRAWINGS

The above and other objects, features and advantages of the present invention will become more apparent from the following detailed description when taken with the accompanying drawings in which:

FIG. 20 is a table showing comparison results in respect of unevenness of density;

FIG. 34 is a table showing the test results in the second embodiment;

DESCRIPTION OF THE PREFERRED EMBODIMENTS

Figure 1:
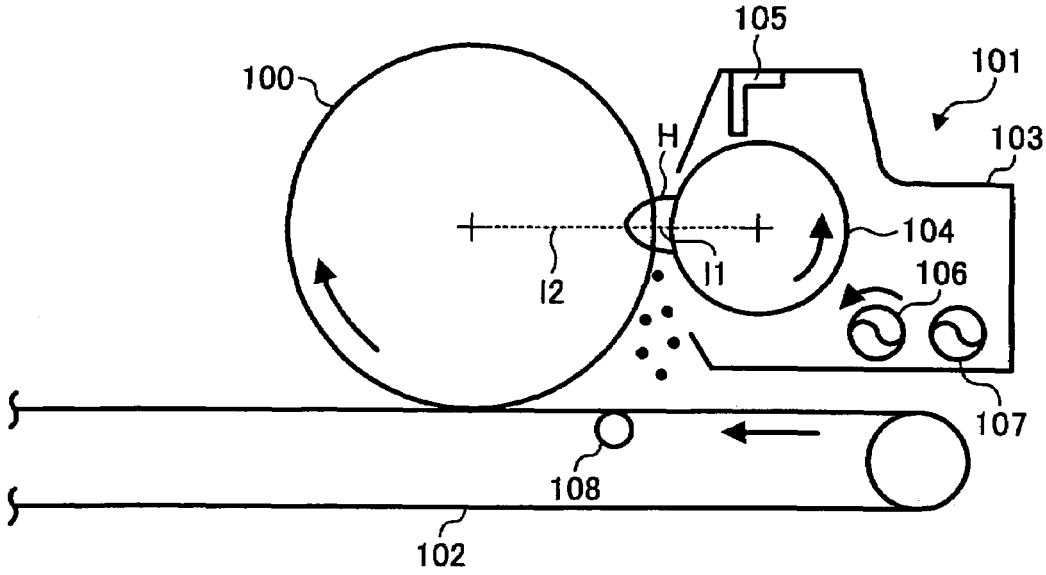
FIG. 1 PRIOR ART
FIG. 1 is a view showing the diagrammatic layout of a prior art image forming apparatus.

Preferred embodiments of the present invention will be described hereinafter. It is to be noted that the reference numerals used in each embodiment are independent of the reference numerals of the other embodiments i.e. the same reference symbols do not always designate the same structural elements.

First Embodiment

First of all, prior art relating to the first embodiment and problems thereof will be described.

As shown in FIG. 1, for example, conventionally, an image forming apparatus such as a copier, printer or facsimile machine comprises a drum shaped photosensitive body 100 that rotates in the direction of the arrow in the Figure, a developing device 101 arranged to the right in the Figure of the photosensitive body 100, and a transfer belt 102 arranged below the photosensitive body 100. The developing device 101 comprises, within a developing container 103 that is formed with an aperture facing the photosensitive body, 100 a developing roller 104 that carries developer in the developer container 103, a developer regulating member 105 that regulates the layer thickness of the developer on the developing roller 104, and developer feed members 106, 107 that stir and feed the developer in the developing container 104. The toner image that is converted to a visible image on the photosensitive body 100 by the developing device 101 is transferred onto the transfer belt 102 by means of a transfer bias roller 108. The center line l1 of the half value width of the magnetic field H produced by the developing magnetic pole of the developing roller 104 is typically substantially collinear with a line segment l2 joining the center of rotation of the photosensitive body 100 and the center of rotation of the developing roller 104. As is known, the development performance improves as the angle (hereinbelow referred to as the developing magnetic pole angle) made by the center line l1 of the half value width of the magnetic field H produced by the developing magnetic pole with a line segment l2 joining the center of rotation of the photosensitive body 100 and the center of rotation of the developing roller 104 a approaches 0°. It is believed that this is because the density of packing of the developer becomes a maximum at a position where the developing gap between the photosensitive body 100 and the developing roller 104 is at its narrowest, resulting in the opportunities for contact of the spikes of developer with respect to the electrostatic latent image on the photosensitive body 100 being increased.

However, as shown in the Figure, in this image forming apparatus, when the transfer belt 102 is arranged below the photosensitive body 100, when the developer passes the developer regulating member 105 or developing region, developer that has been separated from the surface of the developing roller 104 drops down onto the transfer belt 102 due to its weight. When the developer drops down onto the transfer belt 102, this results in damage to the photosensitive body 100 or generation of loss of image density. When the carrier is interposed between the photosensitive body 100 and the transfer belt 102, this dropping down of developer onto the transfer belt 102 gives rise to poor adhesion of the transfer belt 102 to the photosensitive body 100, and, as a result, there is poor transfer of toner in the image portions corresponding to the belt portions facing the carrier or the periphery thereof, resulting in loss of image density in these portions. Conventionally, although not shown, a member that receives the developer falling vertically downwards after separating from the developing roller 104 was arranged between the photosensitive body 100 and the transfer belt 102. However, the effect of this member in suppressing damage to the photosensitive body 100 or loss of image density was insufficient, since it did not actually prevent the developer from dropping down.

Figure 2:
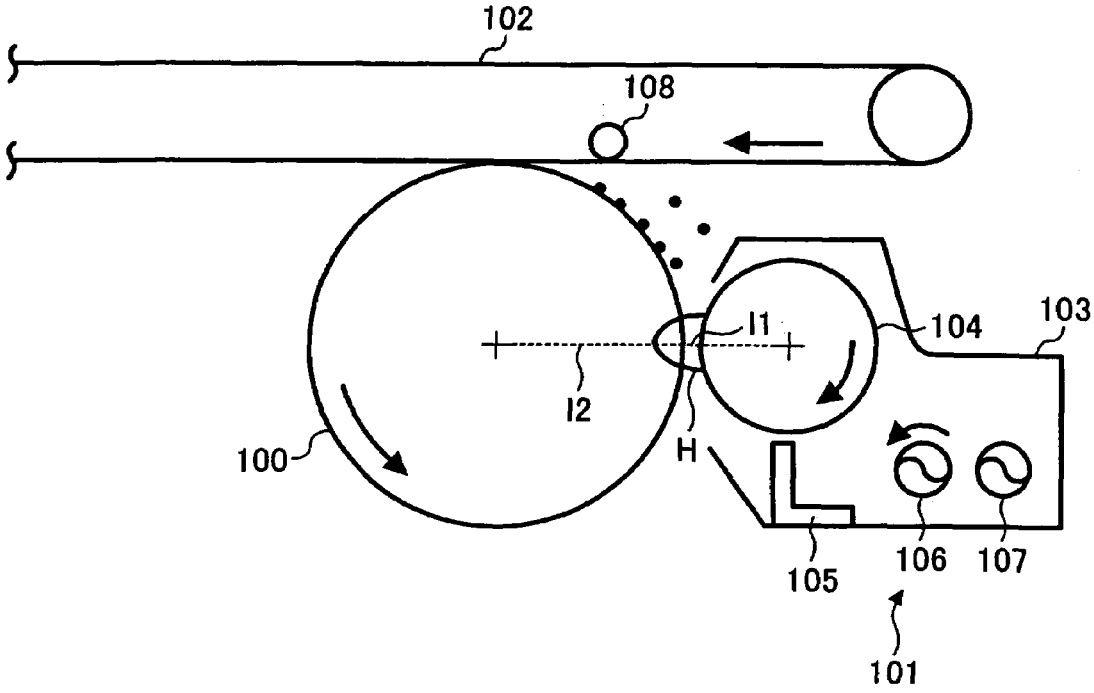
FIG. 2 PRIOR ART
FIG. 2 is a view showing the diagrammatic layout of another prior art image forming apparatus.

Accordingly, as disclosed for example in Laid-open Japanese Patent Application No. 2003-122127 and Laid-open Japanese Patent Application No. 2001-324862, as shown in FIG. 2, image forming apparatuses were studied in which the transfer belt was arranged above the photosensitive body. It should be noted that identical structural members shown in FIG. 2 and FIG. 1 are given the same reference symbols and further description thereof is dispensed with. In this way, if the transfer belt 102 is arranged above the photosensitive body 100, even if developer separating from the developing roller 104 drops down in the vertical direction due to its weight, it does not drop onto the transfer belt 102, so damage to the photosensitive body 100 and loss of image density due to such dropping down of developer can be to some degree reduced.

In the image forming apparatus shown in FIG. 2, the transfer belt 102 was arranged above the photosensitive body 100, thereby preventing dropping down of developer onto the transfer belt 102, but the reasons for the separation of the developer from the developing roller 104 at the aperture of the developing container 103 do not solely consist in the weight of the developer. First of all, developer is separated from the surface of the developing roller 104 by centrifugal force produced by rotation of the developing roller 104, causing the developer to fly off from the aperture of the developing container 103. Also it is believed that, since, in the developing region, the developer spikes impact the photosensitive body 100 with speed, if the force of rebound thereof exceeds the restraining force produced by the magnetic field H, this allows the developer to fly off at the downstream side of the direction of movement of the photosensitive body (i.e. upwards in the Figure). In particular, as shown in FIGS. 1 and 2, if the developing magnetic pole angle is arranged to be 0°, the packing density of the developer becomes a maximum at the position where the developing gap is narrowest. Consequently, it is believed that a severe impact takes place between the photosensitive body 100 and the developer spikes, producing a condition in which the developer tends to fly off.

Thus the developer that separates from the developing roller 104 is believed to be not merely developer that drops downwards but also developer that flies off upwards. Consequently, as shown in FIG. 2, even if the transfer belt 102 is arranged above the photosensitive body 100, carrier that flies off is deposited on block image portions on the photosensitive body 100, and when this carrier is transported to the transfer nip by movement of the photosensitive body, this carrier damages the photosensitive body 100 and gives rise to loss of image density. In particular, in the most recent image forming apparatuses, the diameter of the photosensitive body is small at ϕ20 to ϕ40 and the curvature (1/radius) is large, so carrier flying off in this way can easily find its way onto the photosensitive body.

Also, the phenomenon of reverse development is known, in which, typically, toner that has already been developed is contrariwise scraped off from the photosensitive body 100 after development, due to decrease of the toner that is held by the spikes that contribute to development. This results in blurring of the rear edge of the image or loss of image density, in which image density is lost at the periphery of block image portions. In particular, as shown in FIGS. 1 and 2, in cases where an arrangement is adopted such that the developing magnetic pole angle is 0°, the force acting to scrape off toner is thought to be considerable, due to impact with the photosensitive body 100 in a condition in which the toner is standing up in the form of spikes, in the position in which the developing gap is at its narrowest.

It may be noted that the aforementioned Laid-open Japanese Patent Application No. 2003-122127 proposes an image forming apparatus in which the transfer belt is arranged above the photosensitive body. However, this does not recognize the flying off of developer described above but merely contains the statement that the position of the developing magnet pole is arranged in a location facing the developing region, which location is not clearly specified. Also, the aforementioned Laid-open Japanese Patent Application No. 2001-324862 proposes an image forming apparatus in which a toner is employed that is manufactured by emulsion polymerization and the DC bias developing system is adopted; also, the transfer belt is arranged above the photosensitive body. However, there is no recognition of the flying off of developer as described above and the arrangement of the magnetic pole is different.

Figure 3:
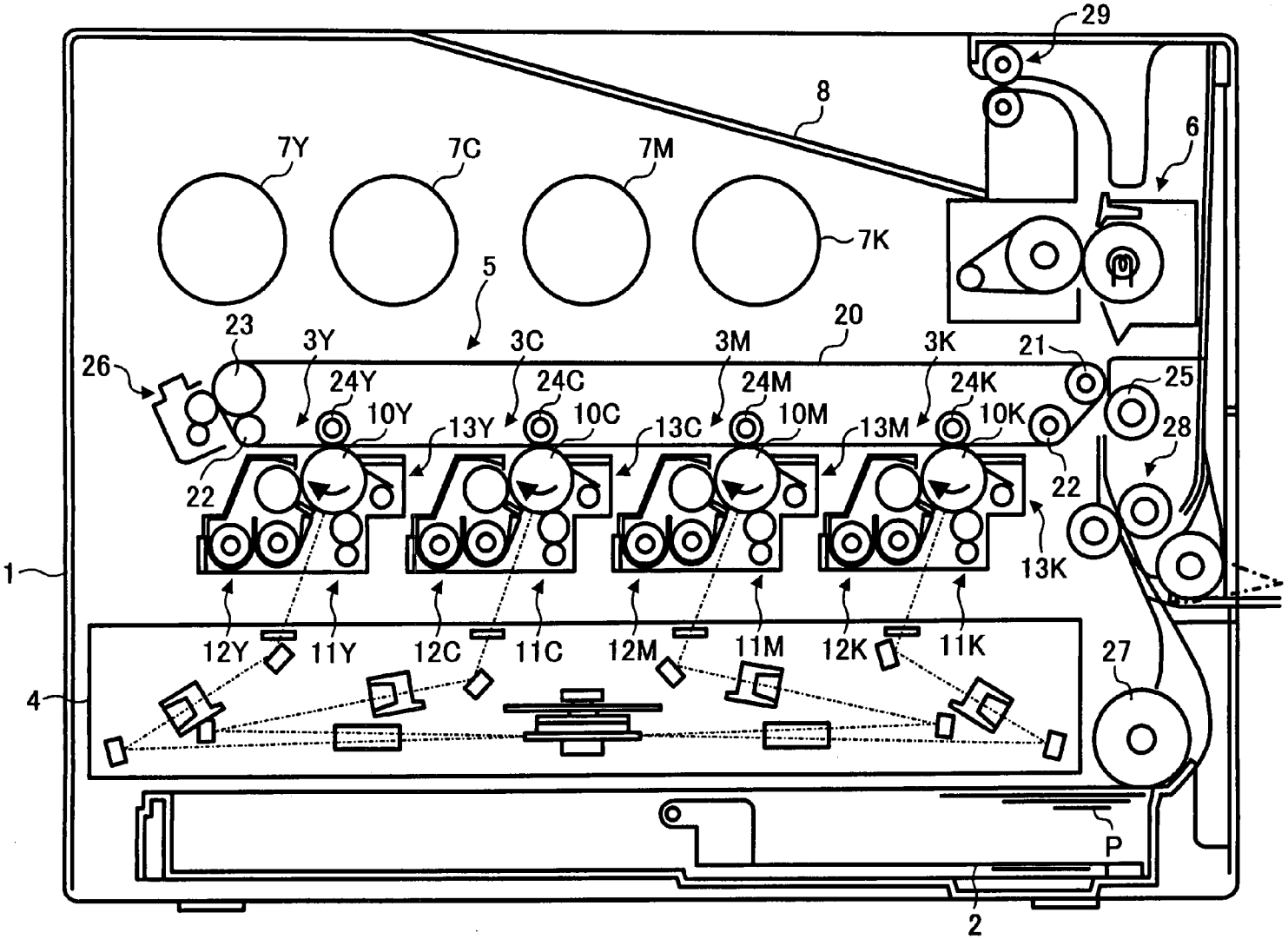
FIG. 3 is a view showing the diagrammatic layout of an image forming apparatus according to a first embodiment of the present invention.

A full-color printer constituting an image forming apparatus according to a first embodiment of the present invention (hereinbelow referred to simply as a "printer") is described below. FIG. 3 shows the diagrammatic layout of this printer. As shown in FIG. 3, this printer comprises a device main body 1 that is fixed in position and accommodates various structural members constituting image forming means, and a paper feed cassette 2 that can be pulled out and is used to accommodate transfer paper P. In the central portion of the device main body 1, there are provided image stations 3Y, 3C, 3M, 3K for forming toner images of the various colors: yellow (Y), cyan (C), magenta (M) and black (K). Hereinbelow, the suffixes Y, C, M, K denote members for yellow, cyan, magenta or black respectively.

Figure 4:
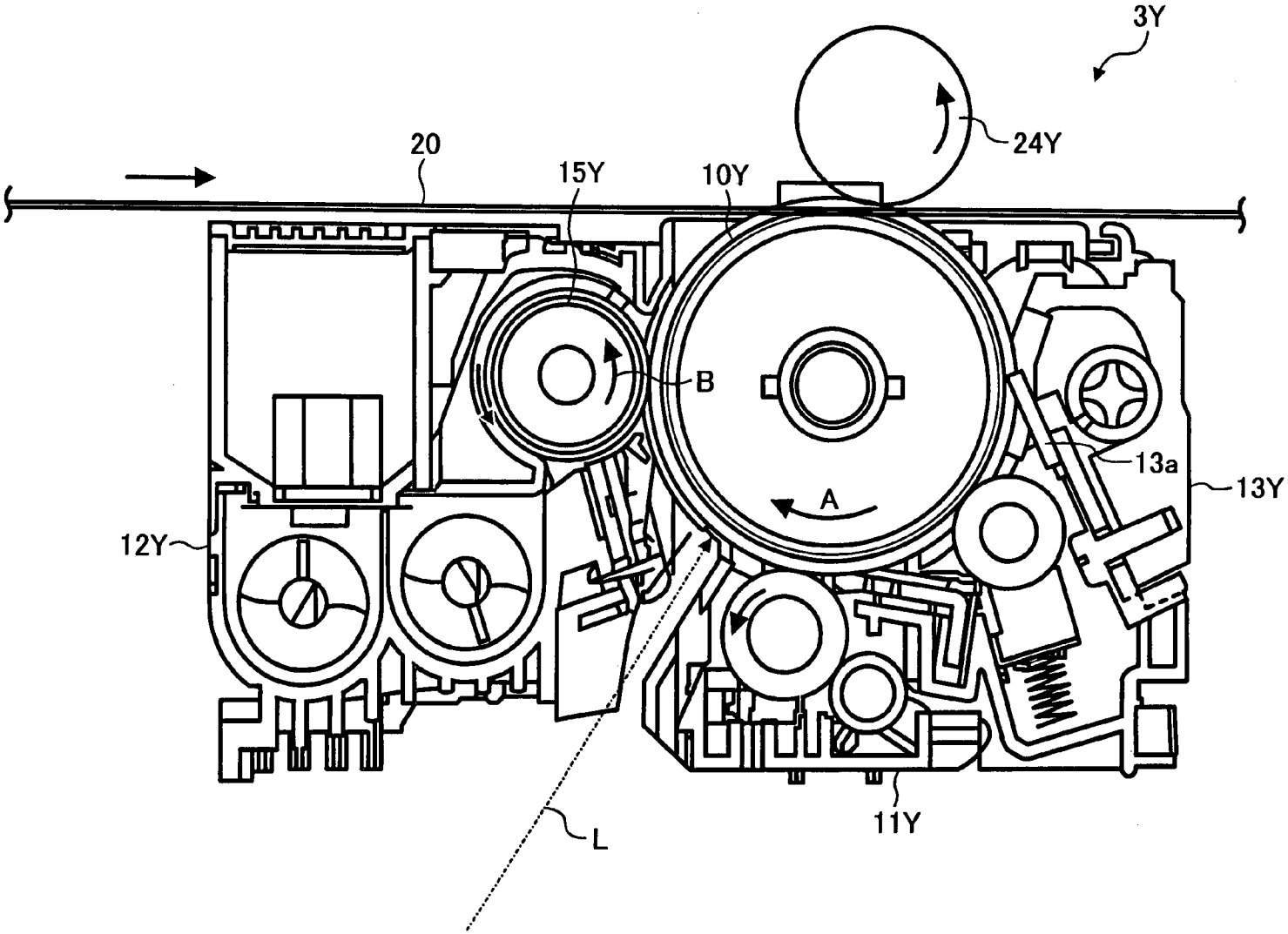
FIG. 4 is a view showing the diagrammatic layout of an image station of an image forming apparatus according to a first embodiment of the present invention.

FIG. 4 shows the diagrammatic layout of an image station. As shown in FIGS. 3 and 4, the image stations 3Y, 3C, 3M, 3K comprise photosensitive bodies 10Y, 10C, 10M, 10K in the form of drums that rotate in the direction of the arrow A in the Figure. The photosensitive body 10 comprises a cylindrical substrate made of aluminum of diameter 40 mm and a photosensitive layer made of for example OPC (organic optical semiconductor) that covers the surface of this substrate. The image stations 3 comprise charging devices 11Y, 11C, 11M, 11K that charge the photosensitive body 10 at the periphery of the photosensitive body 10, developing devices 12Y, 12C, 12M, 12K that develop a latent image formed on the photosensitive body 10, and cleaning devices 13Y, 13C, 13M, 13K that clean residual toner from the photosensitive body 10. Below the image stations 3, there is provided an optical unit 4 constituting exposure means capable of illuminating the photosensitive bodies 10Y, 10C, 10M, 10K with laser light L. Above the image stations 3, there is provided an intermediate transfer unit comprising a transfer belt 20 whereby a toner image that is formed by the image stations 3 is transferred. Also, there is provided a fixing unit 6 that fixes the toner image transferred to the transfer belt 20 onto transfer paper P. Also, at the top of the device main body 1, there are installed toner bottles 7Y, 7C, 7M, 7K that accommodate toner of the respective colors yellow (Y), cyan (C), magenta (M) and black (K). These toner bottles 7Y, 7C, 7M, 7K are arranged to be capable of being released from the device main body 1 by opening a paper discharge tray 8 that is formed at the top of the device main body 1.

The optical unit 4 performs sequential scanning while illuminating the photosensitive bodies 10Y, 10C, 10M, 10K with laser light L emitted from a light source constituted by a laser diode, using a polygonal mirror or the like to achieve this scanning. The transfer belt 20 of the intermediate transfer unit 5 engages a drive roller 21, tension roller 22 and driven roller 23 and is driven in rotation in the anti-clockwise direction in the Figure with a prescribed timing. Also, the intermediate transfer unit 5 comprises primary transfer rollers 24Y, 24C, 24M, 24K that transfer the toner images formed on the photosensitive bodies 10Y, 10C, 10M, 10K to the transfer belt 20. The intermediate transfer unit 5 comprises a secondary transfer roller 25 that transfers the toner image formed on the transfer belt 20 to the transfer paper P and a belt cleaning device 26 that cleans off transfer residue toner on the transfer belt 6 that has failed to be transferred to the transfer paper P.

Next, the step of obtaining a color image in a printer constructed as described above will be described.

First of all, in the image stations 3Y, 3C, 3M, 3K, the photosensitive bodies 10Y, 10C, 10M, 10K are uniformly charged up by means of charging devices 11Y, 11C, 11M, 11K. After this, latent images are formed by the optical unit 4 on the surface of the photosensitive bodies 10Y, 10C, 10M, 10K by scanning exposure of the laser light L in accordance with the image information. The latent images on the photosensitive bodies 10Y, 10C, 10M, 10K are converted to toner images constituting visible images by being developed by toner of the respective colors that is carried on the developing rollers 15Y, 15C, 15M, 15K of the developing device 12. The toner images on the photosensitive bodies 10Y, 10C, 10M, 10K are successively superimposed and transferred on the transfer belt 20 that is driven in rotation in the anti-clockwise direction by the action of the transfer rollers 24Y, 24C, 24M, 24K. This image creation action of the respective colors is implemented with staggered timings from the upstream side to the downstream side in the direction of movement of the transfer belt 20 so that these toner images are superimposed and transferred onto the same position on the transfer belt 20. After completing the primary transfer, the surfaces of the photosensitive bodies 10Y, 10C, 10M, 10K are cleaned by cleaning blades 13*a* of the cleaning devices 13Y, 13C, 13M, 13K so as to be ready for the next image formation. Prescribed amounts of the toner contained in the toner bottles 7Y, 7C, 7M, 7K are supplied to the developing devices 12Y, 12C, 12M, 12 K of the image stations 3Y, 3C, 3M, 3K by feed paths, not shown, as required.

Meanwhile, transfer paper P in the data feed cassette 2 is fed into the device main body 1 by the paper feed roller 27 that is arranged in the vicinity of the data feed cassette 2, and is fed with a prescribed timing to the secondary transfer section by means of a resist roller pair 28. The toner image that has formed on the transfer belt 20 is then transferred to the transfer paper P in this secondary transfer section. The transfer paper P onto which the toner image has been transferred is then subjected to image fixing by passage through the fixing unit 6, after which it is discharged to a paper discharge tray 8 by discharge rollers 29. Just as in the case of the photosensitive bodies 10, any toner left behind on the transfer belt 20 after transfer is cleaned off by a belt cleaning device 26 that contacts the transfer belt 20.

Next, the developing device 12 will be described in detail.

The transfer devices 12Y, 12M, 12C and 12 K are of the same construction apart from use of different toner colors, so the description will be given in terms of the construction of a single developing device 12.

Figure 5:
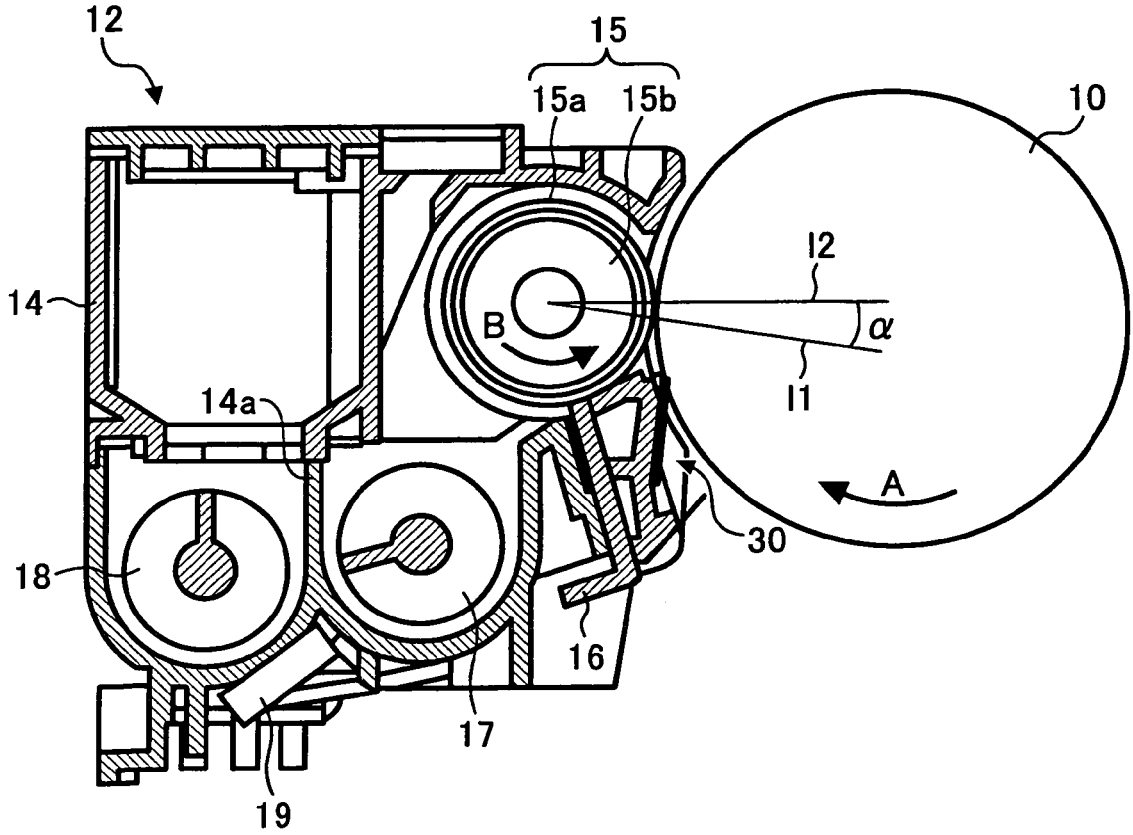
FIG. 5 is a view showing the internal layout of a developing device of an image station of an image forming apparatus according to a first embodiment of the present invention.

FIG. 5 shows the internal construction of a developing device. As shown in this Figure, the developing device 12 comprises a developing roller 15 that is arranged within the developing container 14 facing the photosensitive body 10 on the other side of an aperture of the developing container 14 and that is rotated in the direction of the arrow B i.e. whose roller surface is moved upwards from below in the developing region. Below the developing roller 15, there is provided a developer regulating member 16 that regulates the layer thickness of the developer on the developing roller 15. Below the developing container 14, there are provided a first developer feed screw 17 and second developer feed screw 18 that stir and feed developer within the developing container 14, and a toner density sensor 19 that detects the toner density of the developer in the developing container 14. The first developer feed screw 17 and second developer feed screw 18 are partitioned by means of a partition 14*a*. The first developer feed screw 17 and second developer feed screw 18 in this embodiment are formed with diameters of 14 mm.

Figure 6:
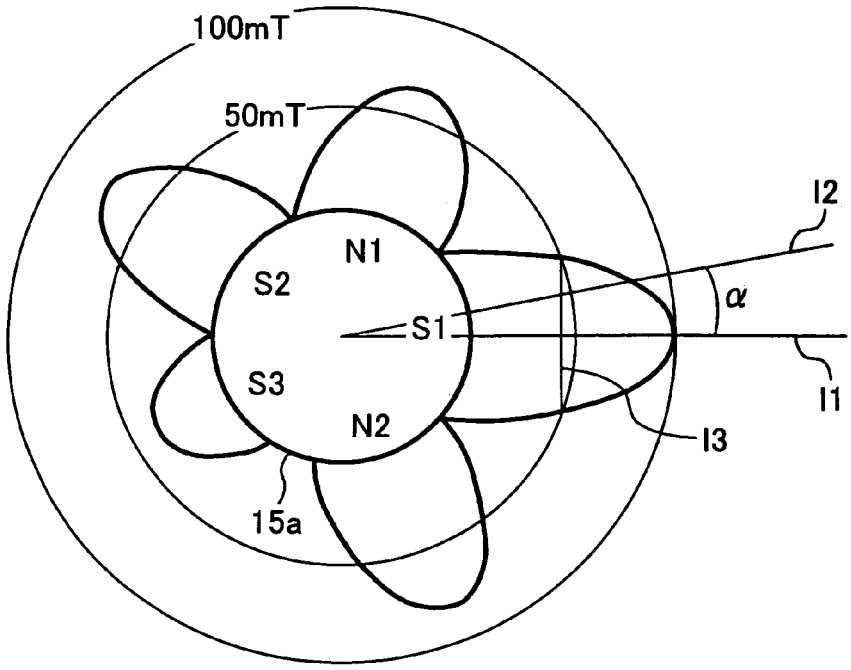
FIG. 6 is a view showing the waveform of the magnetic flux density distribution of a magnet roller of a developing device according to a first embodiment of the present invention.

The developing roller 15 includes a magnet roller 15*b* that is fixed and arranged within a rotating developing sleeve 15*a* made of aluminum of diameter 18 mm. In order to improve the developer feed performance, the surface of the developing sleeve 15*a* may be provided with grooves or may be roughened by for example sand-blast processing. FIG. 6 is a view showing the waveform of the flux density distribution of the magnet roller. It should be noted that the magnetic pole arrangement in FIG. 6 is a constructional example and the number and arrangement of the magnetic poles other than the developing magnetic pole are not restricted to this. As shown in the Figure, the magnet roller 15*b* comprises magnetic poles S1, N1, S2, S3, N2 in the direction of rotation of the developing sleeve 15*a*, from the location of the developing region, which is in a region facing the photosensitive body 10. Of these, the developing magnetic pole S1, that is arranged such that the center line of the half value width of this magnetic pole is in a position on the upstream side in the direction of rotation from the line l2 joining the respective centers of the developing roller 15 and the photosensitive body 10, exhibits the strongest magnetic force of the five magnetic poles. It therefore performs the role of forming a magnetic brush by causing sprouting out of spikes of the two-component developer on the developing sleeve 15*a* in the developing region. The tips of the magnetic brush formed on the developing sleeve 15*a* by the magnetic force of this developing magnetic pole S1 pass through the developing gap while making sliding contact with the photosensitive body 10.

The movement of developer in a developing device 12 constructed in this way will now be described.

The toner and carrier are frictionally charged up by stirring while the two-component developer in the developing container 14 is fed in circulatory fashion by the first developer feed screw 17 and the second developer feed screw 18. The first developer feed screw 17 then supplies some of the developer to the developing roller 15 and the developing roller 15 magnetically carries and feeds this developer, by means of the magnetic pole N2. The developer on the developing roller 15 is formed in a condition contacting the photosensitive body 10, with its layer thickness (amount carried) regulated by the developer regulating member 16. The magnetic pole N2 is a pole that combines the action of picking up developer with an action of regulating the layer thickness thereof. Toner frictional charging is promoted in the two-component developer whilst it is attracted onto the surface of the developing sleeve 15*a* by this magnetic pole N2 and regulated in layer thickness. Developing bias is applied to the developing sleeve 15*a* by a power source, not shown.

The developer that is fed into the developing region is caused to stand up in the form of spikes on the developing sleeve 15*a* by the magnetic force of the developing magnetic pole S1; thus toner is supplied to the electrostatic latent image on the photosensitive body 10 in a condition in which the tips of these spikes make sliding contact with the photosensitive body 10 during passage through the developing gap. The developer, after being passed through the developing gap with the rotation of the developing sleeve 15*a*, moves, restricted to the developing sleeve 15*a* by the magnetic force of the magnetic pole N1, but with the previously projecting spikes flattened by the diminution of magnetic force. The developer is then separated from the surface of the developing sleeve 15*a* in a region between the magnetic pole S3 and magnetic pole N2 where the magnetic field in the normal direction is restricted and is returned into the developing container 14. The developer that has thus returned to the developing container 14 is again fed by the first feed screw 17 and is again fed by the second developer feed screw 18 through the partition 14*a*. When the toner density sensor 19 detects that the toner density of the developer in the developing container 14 has dropped to no more than a prescribed density, toner is supplied through the toner supply port and mixed with the developer by stirring performed by the second feed screw 18. The above cycle is then repeated by again carrying on the developing sleeve 15*a* the developer that has thus been adjusted to the prescribed density and reducing its layer thickness by passage through the developer regulating member 16.

In an image forming apparatus according to this embodiment, as shown in FIG. 3 and FIG. 4, the transfer belt 20 constituting the transfer body is arranged above the photosensitive body 10 and developing roller 15. Consequently, even if developer separates from the developing roller 15 when the developer on the developing roller 15 passes the developer regulating member 16 or developing region and drops downwards, such developer cannot be deposited on the transfer belt 20. Also, as shown in FIG. 6, the center line l1 of the half value width of the magnetic field produced by the developing magnetic pole S1 is arranged below the line segment l2 joining the center of the photosensitive body 10 and the center of the developing roller 15. The center line l1 of the half value width is the line joining the bisection point that bisects the line segment l3 joining the points of intersection of the curve expressing the normal magnetic field and the concentric circle (50 mT in FIG. 6) constituting the half value of the peak value of this curve and the center of rotation of the developing roller 15.

The developer that is held by the developing magnetic pole S1 is held with maximum density on the center line l1 of the half value width. Consequently, the gap between the photosensitive body 10 and the developing roller 15 at the position where the developer is held with maximum density becomes wider than the developing gap where it is at its narrowest between the photosensitive body 10 and the developing roller 15. Accordingly, on the center line of the half value width l1 of the magnetic field produced by the developing magnetic pole S1, impact of the photosensitive body 10 and spikes of developer is moderated, with the result that the amount of developer that flies off due to its release from the constraint of the magnetic field is reduced. Even if release from such restraint does allow some developer to separate from the developing roller 15, owing to the narrowing of the gap between the photosensitive body 10 and the developing roller 15 in the upwards direction, movement of developer in the upwards direction is blocked and flying off of the developer becomes difficult.

Also, in the developing gap where the distance between the photosensitive body 10 and the developing roller 15 is at its narrowest, magnetic force acts so as to flatten the angle of the spikes of developer that contacts the photosensitive body, so impact between the photosensitive body 10 and the spikes of developer is moderated, reducing the amount of developer that flies off. Also, since the angle of the spikes of developer that contact the photosensitive body 10 is flattened in the developing gap, the toner scraping-off capability of the developer spikes is also reduced, reducing the generation of loss of image density. Furthermore, in the developing gap, flattening of the angle of the spikes of developer that contact the photosensitive body 10 increases the contact area per unit time of the spikes of developer contacting the photosensitive body 10. Consequently, excellent development can also be achieved even in the region where the developing potential is decreased by the edge effect.

The developing magnetic pole S1 is arranged such that the angle α (hereinbelow referred to as the developing magnetic pole angle) made by the center line l1 of the half value width of the magnetic field produced by the developing magnetic pole S1 with the line segment l2 joining the center of rotation of the photosensitive body 10 and the center of rotation of the developing roller 15 is 2° to 8.5°. If this developing magnetic pole angle α is smaller than 2°, the effect of suppressing flying off of the developer in the upwards direction described above is small. This results in carrier that has thus flown off being deposited on the photosensitive body 10; when this carrier that has thus been deposited on the photosensitive body 10 is transported to the transfer nip, the photosensitive body 10 is damaged or loss of image density is produced due to such carrier deposition. Also, if this developing magnetic pole angle α is smaller than 2°, the scraping-off force of the developer spikes becomes large, resulting in loss of image density. On the other hand, if this developing magnetic pole angle α exceeds 9°, development performance is lowered, resulting in generation of unevenness of image density. For these reasons, the developing magnetic pole angle α is preferably 2 to 8.5°, and even more preferably in the vicinity of 6°.

Also, as shown in FIG. 5, an inlet seal 30 constituting a developer receiving member is provided in the developing device 12. This inlet seal 30 is constituted of a resilient member made of for example polyurethane rubber or Mylar film. One end of the inlet seal 30 is stuck onto a side wall of the developing container 14 while the other end thereof is arranged so as to contact the surface of the photosensitive body 10 below the center line l1 of the half value width of the magnetic field produced by the developing magnetic pole S1. Even if developer drops down due to its weight from the aperture of the developing container 14, this developer is received by the inlet seal member 30, so there is no possibility of contamination of the interior of the device main body 1 by such developer.

Also, in a printer according to this embodiment, the DC bias development system may be employed as the system for voltage application to the developing sleeve 15*a*. With the DC bias power source, a reduction of costs can be achieved insofar as an AC bias is not employed. If DC bias is employed as the developing bias, development conditions as described below are preferable.

Preferably the developing gap where the gap between the photosensitive body 10 and the developing roller 15 is at its narrowest is 0.25 to 0.45 mm. Although the development performance improves as the developing gap is made narrower, it has been found that substantial saturation of the development performance tends to occur at a certain distance. Preferably the ratio Vs/Vp of the linear speed Vp of the photosensitive body 10 and the linear speed Vs of the developing roller 15 is 1.7 to 2.0. By employing a high linear speed Vs of the developing roller 15, the frequency of contact of the spikes on the developing sleeve 15*a* with the electrostatic latent image on the photosensitive body 10 is increased. In general, development performance is improved as this frequency of contact is raised.

The toner that is employed in this embodiment will now be described.

Preferably the volumetric average particle size of the toner is 3 to 8 μm, in order to reproduce fine dots of 600 dpi or more. Preferably the ratio (Dv/Dn) of the volume average particle size (Dv) and the number average particle size (Dn) is in the range 1.00 to 1.40. A sharper particle size distribution is displayed as (Dv/Dn) approaches 1.00. Toner of such a small particle size and narrow particle size distribution has a uniform distribution of toner charge, making it possible to obtain images of high quality with little blurring, and making it possible to raise the transfer rate in the electrostatic transfer system.

Figure 7A:
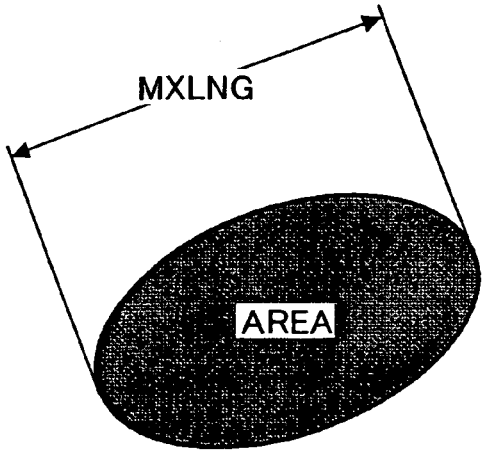
FIGS. 7A, 7B, 8A, 8B and 8C are views showing diagrammatically toner shapes.
Figure 7B:
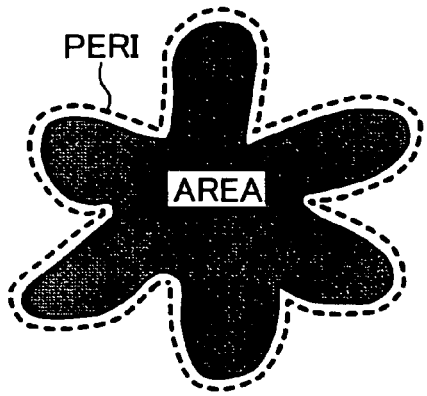

Preferably, the toner shape coefficient SF-1 is in the range 100 to 180 and the shape coefficient SF-2 is in the range 100 to 180. FIGS. 7A and 7B are diagrams showing diagrammatically the toner shape, given in explanation of this toner shape coefficient SF-1 and shape coefficient SF-2. The shape coefficient SF-1 shows the rounding ratio of the toner shape and is expressed by the following Equation (1).

$$SF\text{-}1=\{(MXLNG)^2/\mathrm{AREA}\}\times(100\,\pi/4) \qquad \text{Equation (1).}$$

This is a value obtained by dividing the square of the maximum length MXLNG of the Figure produced by projection of the toner shown in FIG. 7A in a two-dimensional plane by the area AREA of the Figure and multiplying by 100 π/4. If the value of SF-1 is 100, the shape of the toner is spherical; larger values of SF-1 indicate a more irregular shape.

Also, the shape coefficient SF-2 indicates the unevenness ratio of the toner shape and is expressed by the following equation (2).

$$SF\text{-}2=\{(PERI)^2/\mathrm{AREA}\}\times(100\,\pi/4) \qquad \text{Equation (2).}$$

This is a value obtained by dividing the square of the periphery PERI of the Figure produced by projection of the toner shown in FIG. 7B in a two-dimensional plane by the area AREA of the Figure and multiplying by 100 π/4. If the value of SF-2 is 100, unevenness is absent from the toner surface; increasing values of SF-2 indicate progressively more marked unevenness of the toner surface.

For measurement of the shape coefficients, specifically, a photograph of the toner is taken using a scanning electron microscope (S-800: manufactured by Hitachi Seisakusho); this is then introduced into an image analyzer (LUSEX 3: manufactured by Nireko) and analyzed to calculate the shape coefficients.

When the shape of the toner approaches sphericity, the condition of contact of the toner particles with each other or between the toner particles and the photosensitive body becomes point contact, so the adsorptive force between adjacent toner particles becomes weaker, so toner fluidity is increased. Also, the adsorptive force between the toner and the photosensitive body becomes weaker, so the transfer rate becomes higher. It is undesirable that either of the shape coefficients SF-1, SF-2 should exceed 180, since, if this happens, the transfer rate is lowered.

Suitably, the toner that is employed in an image forming apparatus according to this embodiment is toner obtained by subjecting a toner material liquid obtained by dispersing polyester prepolymer having a functional group containing at least a nitrogen atom, polyester, coloring agent and a release agent in an organic solvent to a cross-linking and/or elongation reaction in an aqueous solvent. The toner constituent material and a method of manufacturing it are described below.

(Polyester)

The polyester is obtained by a condensation polymerization reaction of a polyhydric alcohol compound and polyhydric carboxylic acid compound. Examples of polyhydric alcohol compounds (PO) that may be given include dihydric alcohols (DIO) and trihydric or more polyhydric alcohols (TO); preferably the (DIO) is employed alone, or in the form of a mixture of (DIO) and a small quantity of (TO). Examples of dihydric alcohols (DIO) that may be given include alkylene glycols (for example ethylene glycol, 1,2-propylene glycol, 1,3 propylene glycol, 1,4-butane diol, or 1,6-hexane diol); alkylene ether glycols (for example diethylene glycol, triethylene glycol, dipropylene glycol, polyethylene glycol, polypropylene glycol, or polytetramethylene ether glycol); alicyclic diols (for example 1,4 cyclohexane dimethanol, or hydrogenated bisphenol A); bisphenols (for example bisphenol A, bisphenol F, bisphenol S); alkylene oxides of the aforementioned alicyclic diols (for example ethylene oxide, propylene oxide or butylene oxide) adducts; and alkylene oxides of the aforementioned bisphenols (for example ethylene oxide, propylene oxide or butylene oxide) adducts. Of these, preferred examples are alkylene glycols of carbon number 2 to 12 and alkylene oxide adducts of bisphenols; particularly preferred examples are alkylene oxide adducts of bisphenols and joint use of these with alkylene glycols of carbon number 2 to 12. Examples that may be given of trihydric or more polyhydric alcohols (TO) include 3 to 8 or more -hydric polyhydric aliphatic alcohols (glycerol, trimethylol ethane, trimethylol propane, pentaerythritol or sorbitol); trihydric or more phenols (for example trisphenol PA, phenol novolac, or cresol novolac); or alkylene oxide adducts of the above trihydric or more polyphenols.

As polyhydric carboxylic acids (PC), there may be mentioned by way of example dihydric carboxylic acids (DIC) and trihydric or more polyhydric carboxylic acids (TC); (DIC) used alone or a mixture of (DIC) with a small quantity of (TC) is preferable. As dihydric carboxylic acids (DIC) there may be mentioned by way of example alkylene dicarboxylic acids (for example succinic acid, adipic acid or sebacic acid); alkenylene dicarboxylic acids (for example maleic acid or fumaric acid); or aromatic dicarboxylic acids (for example, phthalic acid, isophthalic acid, terephthalic acid, or naphthalene dicarboxylic acid). Preferred examples of these are alkenylene carboxylic acids of carbon number 4 to 20 and aromatic dicarboxylic acids of carbon number 8 to 20. Examples of trihydric or more polyhydric carboxylic acids (TC) that may be mentioned include aromatic polyhydric carboxylic acids of carbon number 9 to 20 (for example trimellitic acid or pyromellitic acid). It should be noted that the reaction with the polyhydric alcohol (PO) may be conducted using an acid anhydride of the acids mentioned above or a low alkylene ester (for example methyl ester, ethyl ester, isopropyl ester) thereof as the polyhydric carboxylic acid (PC).

Regarding the ratio of the polyhydric alcohol (PO) and polyhydric carboxylic acid (PC), the equivalents ratio [OH]/[COOH] of the hydroxide group [OH] and carboxylic group [COOH] is usually 2/1 to 1/1, preferably 1.5/1 to 1/1 and even more preferably 1.3/1 to 1.02/1.

Regarding the condensation polymerization reaction of the polyhydric alcohol (PO) and polyhydric carboxylic acid (PC), a polyester having hydroxyl groups is obtained by heating to 150 to 280° C. in the presence of a known esterification catalyst such as tetrabutoxy titanate or dibutyl tin oxide and distilling off the water that is produced under reduced pressure if necessary. Preferably the hydroxyl value of the polyester is at least 5, and the acid value of the polyester is normally 1 to 30, preferably 5 to 20. The acid value serves to facilitate negative charging capability and furthermore improves low temperature fixing performance, providing good affinity of the toner with the recording paper during fixing onto the recording paper. However, if the acid value exceeds 30, there tends to be an adverse effect on charging stability, in particular in respect of variations in the environment.

Also, the weight average molecular weight of the polyester is 10,000 to 400,000, preferably 20,000 to 200,000. If the weight average molecular weight is less than 10,000, ability to withstand offset is adversely affected, which is undesirable. Also, if the weight average molecular weight exceeds 400,000, low temperature fixing performance are adversely affected, which is undesirable.

Apart from the unmodified polyester obtained by the above condensation polymerization reaction, the polyester preferably contains urea-modified polyester. Urea-modified polyester means that for example the terminal carboxylic groups and/or hydroxyl groups of the polyester obtained by the above condensation polymerization reaction are reacted with a polyhydric isocyanate compound (PIC), to obtain a polyester prepolymer (A) having isocyanate groups and molecular chains are obtained by cross-linking and/or elongation reaction with an amine.

Examples of polyhydric isocyanate compounds (PIC) that may be employed include aliphatic polyhydric isocyanates (for example tetramethylene diisocyanate, hexamethylene diisocyanate, or 2,6 diisocyanate methyl caproate); alicyclic polyisocyanates (for example isophorone diisocyanate, or cyclohexyl methane diisocyanate); aromatic diisocyanates (for example tolylene diisocyanate or diphenyl methane diisocyanate); aromatic aliphatic diisocyanates (for example $\alpha,\alpha,\alpha',\alpha'$-tetramethyl xylylene diisocyanate); isocyanates; or block copolymers of the aforesaid polyisocyanates with for example phenol derivatives, oximes or caprolactam; and block copolymers with two or more of these.

The ratio of polyhydric isocyanate compounds (PIC) is usually 5/1 to 1/1, preferably 4/1 to 1.2/1 and even more preferably 2.5/1 to 1.5/1 in terms of the equivalents ratio [NCO]/[OH] of the isocyanate groups [NCO] and the hydroxyl groups [OH] of the polyester having the hydroxyl groups. If [NCO]/[OH] exceeds 5, low temperature fixing performance is adversely affected. If the mol ratio of [NCO] is less than 1, when urea-modified polyester is employed, the urea content in the ester becomes low and the ability to withstand hot offset is adversely affected.

The content of polyhydric isocyanate compound (PIC) structural constituents in the polyester prepolymer (A) having an isocyanate group is usually 0.5 to 40 wt %, preferably 1 to 30 wt % and even more preferably 2 to 20 wt %. If this content is less than 0.5 wt %, ability to withstand hot offset is adversely affected and this is also disadvantageous in terms of combining heat resistant storage performance and low temperature fixing performance. Also, low temperature fixing performance is adversely affected above 40 wt %

The number of isocyanate groups present per molecule in the polyester prepolymer (A) having an isocyanate group is usually at least one, preferably an average of 1.5 to 3 and even more preferably an average of 1.8 to 2.5. If there is less than one isocyanate group per molecule, the molecular weight of the urea-modified polyester becomes low and the ability to withstand hot offset is adversely affected.

Next, as examples of the amines (B) that are reacted with the polyester prepolymer (A) there may be mentioned dihydric amine compounds (B1), trihydric or more polyhydric amine compounds (B2), aminoalcohols (B3), aminomercaptans (B4), aminoacids (B5), and block combinations (B6) of the amino groups of B1 to B5.

As dihydric amino compounds (B1), there may be mentioned as examples aromatic diamines (for example phenylene diamine, diethyl toluene diamine, or 4,4'-diamino diphenyl methane); alicyclic diamines (for example 4,4'-diamino-3,3'-dimethyl dicyclohexyl methane, diamine cyclohexane, or isophorone diamine); and for example aliphatic diamines (for example ethylene diamine, tetramethylene diamine or hexamethylene diamine). As trihydric or more polyhydric amine compounds (B2), there may be mentioned by way of example of diethylene triamine, or triethylene tetra-amine. As aminoalcohols (B3), there may be mentioned by way of example ethanolamine or hydroxyethyl aniline. As aminomercaptans (B4) there may be mentioned by way of example aminoethyl mercaptan or aminopropyl mercaptan. As aminoacids (B5), there may be mentioned by way example amino propionic acid or aminocaproic acid. As block combinations (B6) of the amino groups of B1 to B5, there may be mentioned by way of example ketimine compounds, or oxazolidine compounds obtained from the amines of B1 to B5 above and ketones (for example acetone, methyl ethyl ketone, or methyl isobutyl ketone). Preferred examples of these amines (B) are B1 and mixtures of B1 with a small amount of B2.

The ratio of amines (B) in terms of the equivalents ratio [NCO]/[NHx] of isocyanate groups [NCO] in the polyester prepolymer (A) having an isocyanate group and amino groups [NHx] in the amines (B) is usually 1/2 to 2/1, preferably 1.5/1 to 1/1.5 and even more preferably 1.2/1 to 1/1.2. If [NCO]/[NHx] exceeds 2 or is less than 1/2, the molecular weight of urea-modified polyester becomes low, adversely affecting ability to withstand hot offset.

Also, the urea-modified polyester may contain urea linkages and urethane linkages. The mol ratio of urea linkage content and urethane linkage content is usually 100/0 to 10/90, preferably 80/20 to 20/80, and even more preferably 60/40 to 30/70. If the mol ratio of urea linkages is less than 10%, ability to withstand hot offset is adversely affected.

Urea-modified polyester may be manufactured by for example a one-shot method. The polyhydric alcohol (PO) and polyhydric carboxylic acid (PC) are heated to 150 to 280° C. in the presence of a known esterification catalyst such as tetrabutoxy titanate or dibutyl tin oxide, and polyester having hydroxyl groups is obtained by distilling off the water that is generated under reduced pressure if necessary. Next, this is reacted with polyhydric isocyanate (PIC) at 40 to 140° C., to obtain polyester prepolymer (A) having an isocyanate group. Further, this (A) is reacted with amine (B) at 0 to 140° C., to obtain urea-modified polyester.

When the (PIC) is reacted, and when (A) and (B) are reacted, if necessary, a solvent may be employed. As solvents that may be employed, there may be mentioned by way of example aromatic solvents (for example toluene or xylene); ketones (for example acetone, methyl ethyl ketone, or methyl isobutyl ketone); esters (for example ethyl acetate); amides (for example dimethyl formamide, or dimethyl acetamide) and ethers (for example tetrahydrofuran), which are inert to isocyanates (PIC).

Also, in the cross-linking/and or elongation reaction of the polyester prepolymer (A) and amine (B), if necessary, the molecular weight of the urea-modified polyester obtained may be adjusted by using a reaction stopping agent. Examples of reaction stopping agents that may be given include monoamines (for example diethylamine, dibutylamine, butylamine, laurylamine) and block combinations of these (ketimine compounds).

The weight average molecular weight of the urea-modified polyester is usually at least 10,000, preferably 20,000 to 10,000,000 and even more preferably 30,000 to 1,000,000. If the weight average molecular weight is less than 10,000, the ability to withstand hot offset is adversely affected. Regarding the number average molecular weight of for example the urea-modified polyester, there is no particular restriction if the previous unmodified polyester is employed and the urea-modified polyester may be of a number average molecular weight that makes it easy to obtain the aforesaid weight average molecular weight. If the urea-modified polyester is employed on its own, its number average molecular weight is usually 2000 to 15,000, preferably 2000 to 10,000 and even more preferably 2000 to 8000. If 20,000 is exceeded, low temperature fixing performance and luster when used in a full-color device are adversely affected.

By using unmodified polyester and urea-modified polyester in combination, low temperature fixing performance and luster when used in a full-color image forming apparatus 100 are improved, so this is preferable rather than using urea-modified polyester on its own. It should be noted that "unmodified polyester" may include polyester that has been modified using chemical linkages apart from urea linkages.

It is desirable for the point of view of low temperature fixing performance and hot offset performance that the unmodified polyester and urea-modified polyester should be least partially mutually soluble. It is therefore preferable that the unmodified polyester and urea-modified polyester should be of similar composition.

Also, regarding the weight ratio of unmodified polyester and urea-modified polyester, this is usually 20/80 to 95/5, preferably 70/30 to 95/5, and even more preferably 75/25 to 95/5, 80/20 to 93/7 being particularly preferred. If the weight ratio of urea-modified polyester is less than 5%, ability to withstand hot offset is adversely affected and this is also disadvantageous in terms of combining heat resistant storage performance and low temperature fixing performance.

The glass transition point (Tg) of binder resin containing unmodified polyester and urea-modified polyester is usually 45 to 65° C., preferably 45 to 60° C. If the glass transition point is less than 45° C., heat resistance of the toner is adversely affected and if it exceeds 65° C. low temperature fixing performance is insufficient.

Also, the urea-modified polyester tends to be present at the surface of the toner matrix particles that are obtained, so heat resistant storage performance tends to be better than that of known polyester based toner, even though the glass transition point is low.

As coloring agents, all known dyes and pigments may be employed such as for example Carbon Black, Nigrosine, Iron Black, Naphthol Yellow S, and Hansa Yellow (10G, 5G, G), Cadmium Yellow, Yellow Iron Oxide, Yellow Ochre, Chrome Yellow, Titanium Yellow, Poly Azo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, Anthrazan Yellow BGL, Isoindolinone Yellow, Red Iron Oxide, Red Lead, Lead Vermilion, Cadmium Red, Cadmium Mercury Red, Antimony Vermilion, Permanent Red 4R, Para Red, Fire Red, p-chloro o-nitro Aniline Red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarin Lake, Thioindigo Red B, Thioindigo Maroon, Oil Red, Quinacridone Red, Pyrazolone Red, Poly Azo Red, Chrome Vermilion, Benzidine Orange, Perynone Orange, Oil Orange, Cobalt Blue, Cerulean Blue, Alkali Blue Lake, Peacock Blue Lake, Victoria Blue Lake, Metal-free Phthalocyanin Blue, Phthalocyanin Blue, Fast Sky-blue, Indanthrene Blue (RS, BC), Indigo, Ultramarine, Navy-blue, Anthraquinone Blue, Fast Violet B, Methyl Violet Lake, Cobalt Violet, Manganese Violet, Dioxane Violet, Anthraquinone Violet, Chrome Green, Zinc Green, Chromium Oxide, Viridian, Emerald Green, Pigment Green B, Naphthol Green B, Green Gold, Acid Green Lake, Malachite Green Lake, Phthalocyanin Green, Anthraquinone Green, Titanium Oxide, Zinc White, Lithopone and mixtures of these.

The content of coloring agent is usually 1 to 15 wt % with respect to the toner, preferably 3 to 10 wt %.

The coloring agent may also be employed in the form of a master batch combined with the resin. In the manufacture of a master batch, or as a binder resin kneaded with the master batch, there may be employed for example the following, either alone or as a mixture: polymers of styrene and derivatives thereof or copolymers of these with vinyl compounds such as polystyrene, poly-p-chlorostyrene, or polyvinyl toluene, or polymethyl methacrylate, polybutyl methacrylate, polyvinyl chloride, polyethylene, polypropylene, polyester, epoxy resin, epoxy polyol resin, polyurethane, polyamide, polyvinyl butyral, polyacrylate resin, rosin, modified rosin, terpene resin, aliphatic or alicyclic hydrocarbon resin, aromatic petroleum resin, chlorinated paraffin, or paraffin wax.

(Charging Control Agent)

As charging control agent, known charging control agents may be employed such as for example nigrosine dyes, triphenylmethane dyes, chromium-containing metallic complex dyes, molybdenum acid chelate pigment, rhodamine dyes, alkoxyamines, quaternary ammonium salts (including fluorine-modified quaternary ammonium salts), alkylene amides, phosphorus either alone or in the form of a compound thereof, tungsten either alone or in the form of a compound thereof, fluorine based activating agents, metal salicylates, or metal salicylate derivatives. Specific examples are the nigrosine-based dye Bontoron 03, the quaternary ammonium salt Bontoron P-51, the metal containing azo dye Bontoron S-34, the oxynaphthoate-based metallic complex E-82, the metal salicylate complex E-84, the phenol-based condensation product E-89 (the above are manufactured by Orient Chemical Industries Inc), the quaternary ammonium salt molybdenum complexes TP-302 and TP-415 (the above are manufactured by Hodogaya Chemical Industries Inc), the quaternary ammonium salt Copy Charge PSY VP 2038, the triphenylmethane derivative Copy Blue PR, the quaternary ammonium salt Copy Charge NEG VP 2036, Copy Charge NX VP 434 (the above is manufactured by Hoechst Inc), LRA-at 901, the boron complex LR-147 (manufactured by Japan Carlit, copper phthalocyanin, perylene, quinacridone, azo based pigments, or, in addition, high molecular weight compounds having functional groups such as sulfonate groups, carboxylate groups, or quaternary ammonium salts. Of these, in particular substances that control the toner to negative polarity are preferably employed.

The amount of charging control agent used is determined by the method of toner manufacture including the type of binder resin, whether or not additives are employed as required, and the method of dispersal and so cannot be uniquely specified, but preferably is employed in the range 0.1 to 10 weight parts with respect to 100 weight parts of binder resin. Preferably the range may be 0.2 to 5 weight parts. If 10 weight parts are exceeded, the charging of the toner tends to be too large and the benefit of the charging control agent is diminished, electrostatic adsorptive force with respect to the developing roller is increased, the fluidity of the developer drops and the image density decreases.

(Release Agent)

Release agents, constituted by low melting point wax of melting point 50 to 120° C., act between the fixing roller and the toner interface and act more effectively as release agents in dispersion in the binder resin: in this way, release can be achieved without coating the fixing roller with a release agent such as oil. The following may be mentioned by way of example as constituents of such waxes: plant waxes such as carnauba wax, cotton wax, wood wax or rice wax, animal wax is such as beeswax or lanolin, mineral wax is such as ozokerite or cercine, and paraffin, microcrystalline or petrolatam or other petroleum wax. Also, apart from these natural waxes, synthetic hydrocarbon waxes such as Fischer-Tropsch-wax or polyethylene wax, or synthetic waxes such as esters, ketones, or ethers may be mentioned by way of example. In addition, 12-hydroxystearic acid amide, stearic acid amide, phthalic anhydride imide, fatty acid amides of chlorinated hydrocarbons and the like or homopolymers or copolymers of polyacrylate, such as poly-n-stearyl methacrylate or poly-n-lauryl methacrylate, which are crystalline polymer resins of low molecular weight (for example n-stearylacrylate-ethyl methacrylate copolymer) and the like and crystalline polymers having alkyl groups with long side chains and the like may be employed.

The charging control agents and release agents may also be dissolved and kneaded with a master batch and binder resin or may of course be added during dissolving and dispersal of the organic solvent.

(Externally Added Agents)

Fine inorganic particles are preferably employed as externally added agents for promoting fluidity of the toner particles and assisting development performance and charging performance. The primary particle size of such fine inorganic particles is preferably $5\times10^{-3}$ to 2 μm, $5\times10^{-3}$ to 0.5 μm in particular being preferred. Also, the relative surface area obtained by the BET method is preferably 20 to 500 $m^2/g$. The ratio in which such fine inorganic particles are employed is preferably 0.01 to 5 wt % of the toner; in particular, 0.01 to 2.0 wt % is preferable.

Specific examples of such fine inorganic particles that may be mentioned include silica, alumina, titanium oxide, barium titanate, magnesium titanate, calcium titanate, strontium titanate, zinc oxide, tin oxide, silica sand, clay, mica, silica ash, diatomaceous earth, chromium oxide, cerium oxide, red iron oxide, antimony trioxide, magnesium oxide, zirconium oxide, barium sulfate, barium carbonate, calcium carbonate, silicon carbide, or silicon nitride. Of these, it is preferable to employ fine hydrophobic silica particles and fine hydrophobic titanium oxide particles together as a fluidity enhancing agent. In particular, if stirring and mixing are performed using both of these types of fine particles with average particle size of 5×10−2 μm or less, the electrostatic force and the Van der Waals force with the toner are enormously improved, with the result that separation of the fluidity enhancing agent from the toner does not occur even though the toner is subjected to stirring and mixing in the interior of the developing device, which are performed in order to obtain the desired charging level and high image quality can be obtained in which "fireflies" or the like do not appear and further reduction in the amount of toner left behind after transfer can be achieved.

While fine titanium oxide particles are excellent in regard to promoting environmental stability and stability of image density, they tend to have an adverse effect on the rise characteristic of charging; as a result, if a larger amount of fine silica particles is added than the added amount of fine titanium oxide particles, the effect of side effects thereof appears to become considerable. However, in a range of added amount of fine hydrophobic silica particles and fine hydrophobic titanium oxide particles of 0.3 to 1.5 wt %, the desired charging rise characteristic is obtained without impairing the magnitude of the charging rise characteristic i.e. even when repeated copying is performed, stable image quality is obtained.

Next, a method of manufacturing toner will be described. Although a preferred method of manufacture is illustrated, there is no restriction to this.

(Method of Manufacturing Toner)

1) Toner material is created by dispersing coloring agent, unmodified polyester and a polyester prepolymer having isocyanate groups and a release agent in an organic solvent.

It is desirable from the point of view of facilitating removal of the organic solvent after forming the toner matrix particles that the organic solvent should be volatile with a boiling point of less than 100° C. Specific examples of organic solvents that may be used, alone or in a combination of two or more, include toluene, xylene, benzene, carbon tetrachloride, methylene chloride, 1,2-dichloromethane, 1,1,2-trichloroethane, trichloroethane diethylene, chloroform, monochlorobenzene, dichloroethylidene, methyl acetate, ethyl acetate, methyl ethyl ketone, or methyl isobutyl-ketone. In particular, aromatic solvents such as toluene or xylene and halogenated hydrocarbons such as methylene chloride, 1,2-trichloroethane, chloroform or carbon tetrachloride are preferred. The amount of organic solvent used is usually 0 to 300 weight parts with respect to 100 weight parts of polyester prepolymer, preferably 0 to 100 weight parts and even more preferably 25 to 70 weight parts.

2) The toner material liquid is emulsified in an aqueous medium in the presence of a surfactant or fine resin particles.

The aqueous medium may be for example water on its own, or may contain an organic solvent such as alcohol (for example methanol, isopropyl alcohol, or ethylene glycol), dimethyl formamide, tetrahydrofuran, a Cellosolve (for example methyl Cellosolve), or low ketone, for example acetone or methyl ethyl ketone).

The amount of aqueous medium used with respect to 100 weight parts of toner material liquid is usually 50 to 2000 weight parts, preferably 100 to 1000 weight parts. If the amount used is less than 50 weight parts, the dispersion condition of the toner material liquid is poor and toner particles of the prescribed particle size are not obtained. If it exceeds 20,000 weight parts, this is uneconomic.

Also, in order to improve dispersion in the aqueous medium, there may be added a suitable dispersal agent such as a surfactant or fine resin particles.

Examples of surfactants that may be given include anionic surfactants such as alkylene benzene sulfonate, α-olefin sulfonate or phosphate esters, cationic surfactants such as amine salts such as alkylamine salts, aminoalcohol fatty acid derivatives, polyamine fatty acid derivatives, or imidazoline, or quaternary ammonium salts such as alkyl trimethyl ammonium salts, dialkyl dimethyl ammonium salts, alkylamine dimethyl benzyl ammonium salts, pyridinium salts, alkyl isoquinolinium salts or benzethonium chloride, non-ionic surfactants such as fatty acid amide derivatives, polyhydric alcohol derivatives, or amphoteric surfactants such as for example alanine, dodecyl di(aminoethyl)glycine, di(octylaminoethyl) glycine or N-alkyl-N,N-dimethyl ammonium betaine.

Also, by using a surfactant having a fluoroalkyl group, the benefit thereof can be improved even in extremely small quantity. Examples that may be given of anionic surfactants having a fluoroalkyl group that may preferably be used include fluoroalkyl carboxylic acids of carbon number 2 to 10 and metallic salts thereof, disodium perfluoro-octane sulfonyl glutamate, sodium 3-[ω-fluoroalkyl (C6 to C11) oxy]-1-alkylamines (C3 to C4), sodium 3-[ω-fluoroalkanoyl (C6 to C8)-N-ethylamino]-1-propane sulfonate, fluoroalkyl (C11 to C20) carboxylic acids and metallic salts thereof, perfluoroalkyl carboxylic acids (C7 to C13) and metallic salts thereof, perfluoroalkyl (C4 to C12) sulfonic acids and metallic salts thereof, perfluoro octane sulfonic acid diethanolamide, N-propyl-N-(2-hydroxyethyl) perfluoro octane sulfonamide, perfluoroalkyl (C6 to C10) sulfonamide propyl trimethyl ammonium salts, perfluoroalkyl (C6 to C10)-N-ethyl sulfonyl glycine salts, or monoperfluoroalkyl (C6 to C16) ethyl phosphoric acid esters.

As product names there may be mentioned by way of example Surflon S-111, S-112, S-113 (manufactured by Asahi glass Inc), Fluorad FC-93, FC-95, FC-98, FC-129 (manufactured by Sumitomo 3M), Unidine DS-101, DS-102 (manufactured by Daikin Industries), Megaface F-110, F-120, F-113, F-191, F-812, F-833 (manufactured by Dainippon Ink and Chemicals Inc), Ektop EF-102, 103, 104, 105, 112, 123A, 123B, 306A, 501, 201, 204, (manufactured by Tochem Products Inc), or Futargent F-100, F 150 (manufactured by Neos Inc).

Also, as cationic surfactants, there may be mentioned by way of example primary or secondary aliphatic having a fluoroalkyl group or secondary aminoacids, aliphatic quaternary ammonium salts such as perfluoroalkyl (C6 to C10) sulfonamide propyl trimethyl ammonium salts, benzalkonium salts, benzethonium chloride, pyridinium salts, imidazolinium salts, or, as commercial names, Surflon S-121 (manufactured by Asahi Glass), Fluorad FC-135 (manufactured by Sumitomo 3M), Unidine DS-202 (manufactured by Daikin Industries), Megaface F-150, F-824 (manufactured by Dainippon Ink and Chemicals Inc), Ektop EF-132 (manufactured by Tochem Products Inc), or Futargent F-300, (manufactured by Neos Inc).

Fine resin particles may be added in order to stabilize the toner matrix particles formed in the aqueous medium. Preferably, these are added such that the covering factor with which they are present on the surface of the toner matrix particles is in the range 10 to 90%. Examples of these that may be mentioned include fine polymethyl methacrylate particles of 1 μm and 3 μm, fine polystyrene particles of 0.5 μm and 2 μm, fine (styrene-acrylonitrile) particles of 1 μm, or, as commercial names, PB-200H (manufactured by Kao Inc), SGP (manufactured by Soken Inc), Technopolymer SB (manufactured by Sekisui Kaseihin Kogyo), SGP-3G (manufactured by Soken Inc) and Micropearl (manufactured by Sekisui Fine Chemicals Inc).

Also, inorganic compound dispersants such as calcium triphosphate, calcium carbonate, titanium oxide, colloidal silica, or hydroxyapatite may be employed.

Dispersed droplets may be stabilized by using a polymeric protective colloid as dispersion agent in combination with the above-mentioned fine resin particles or inorganic compound dispersion agents. Examples that may be used include acids such as acrylic acid, methacrylic acid, α-cyanoacrylic acid, α-cyanomethacrylic acid, itaconic acid, crotonic acid, fumaric acid, maleic acid or maleic anhydride, or (meth) acrylate-based monomers containing a hydroxyl group, for example β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid ester, triethylene glycol mono methacrylic acid ester, glycerol monoacrylic acid ester, glycerol monomethacrylic acid ester, N-methylol acrylamide, or N-methylol methacrylamide, vinyl alcohol or ethers of vinyl alcohol, for example vinyl methyl ether, vinyl ethyl ether, or vinyl propyl ether, or esters of compounds including vinyl alcohol and carboxyl groups, for example vinyl acetate, vinyl propionate, or vinyl lactate, acrylamide, methacrylamide, diacetone acrylamide or methylol compounds thereof, acid chlorides such as acrylic acid chloride, methacrylic acid chloride, or nitrogen-containing compounds such as vinyl pyridine, vinyl pyrrolidone, vinyl imidazole, or ethylene imine, or heterocyclic compounds or homopolymers or copolymers thereof, polyoxyethylenes such as polyoxyethylene, polyoxypropylene, polyoxyethylene alkylamine, polyoxypropylene alkylamine, polyoxyethylene alkylamide, polyoxypropylene alkylamide, polyoxyethylene nonylphenyl ether, polyoxyethylene laurylphenyl ether, polyoxyethylene stearylphenyl ester, or polyoxyethylene nonylphenyl ester, or celluloses such as cellulose, hydroxyethyl cellulose, or hydroxypropyl cellulose.

There is no particular restriction regarding the method of dispersal and known equipment such as low-speed shearing equipment, high-speed shearing equipment, frictional equipment, high-pressure jet equipment or ultrasonic equipment may be employed. Of these, high-speed shearing equipment for producing a dispersion of particle size 2 to 20 μm is preferable. If a high-speed sheering type dispersion machine is employed, there is no particular restriction regarding the speed of rotation thereof, but usually this will be 1000 to 30,000 rpm, preferably 5000 to 20,000 rpm. There is no particular restriction regarding the dispersal time, but, in the case of the batch system, usually this will be 0.1 to 5 minutes. For the temperature during dispersion, usually a temperature of 0 to 150° C. (under pressure), preferably 40 to 98° C. is employed.

3) At the same time as the manufacture of an emulsion, amines (B) are added and a reaction is conducted with the polyester prepolymer (A) having an isocyanate group.

This reaction is accompanied by cross-linking and/or elongation of the molecular chains. The reaction time is selected in accordance with the reactivity of the polyester prepolymer (A) having an isocyanate group structure and the amines (B), but is usually 10 minutes to 40 minutes, preferably 2 to 24 hours. The reaction time is usually 0 to 150° C., preferably 40 to 98° C. Also, if required, a known catalyst may be employed. Specific examples that may be given include dibutyl tin laurate, or dioctyl tin laurate.

4) After completion of the reaction, the organic solvent is removed from the emulsified dispersion (reactants) and the toner matrix particles are obtained by washing and drying.

In order to remove the organic solvent, the entire system may be gradually elevated in temperature under laminar-flow stirring conditions, strong stirring being applied in a fixed temperature range, followed by removal of solvent to manufacture spindle shaped toner matrix particles. Also, if a substance that is capable of dissolving in acid or alkali, such as calcium phosphate or the like is employed as a dispersion stabilizer, the calcium phosphate is removed from the toner matrix particles by a method such as washing with water after dissolving the calcium phosphate using acid such as hydrochloric acid. Apart from this, removal may be performed by an operation such as decomposition using an enzyme.

5) Toner is then obtained by absorbing a charge stabilizer in the toner matrix particles obtained as above, followed by applying fine inorganic particles such as fine silica particles or fine titanium oxide particles externally. The absorption of the charge stabilizer and external application of the fine inorganic particles may be performed by a known method using for example a mixer.

In this way, toner of small particle size and sharp particle size distribution can easily be obtained. In addition, it is possible to control the shape from a spherical shape to a rugby ball shape and, further, to control the surface morphology from a smooth morphology to a wrinkled "pickled plum" shape, by applying strong stirring in the step of removing the organic solvent.

It can be shown by the following shape definition that the toner shape in the present embodiment is substantially spherical shaped.

Figure 8A:
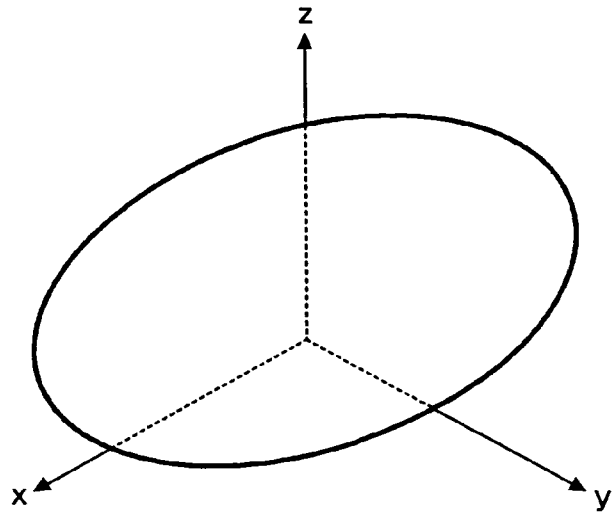
Figure 8B:
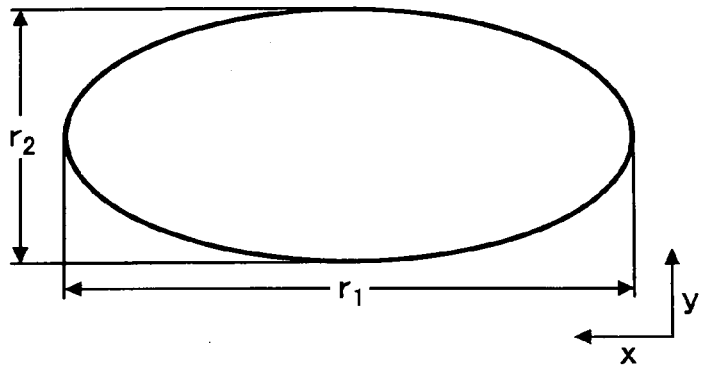
Figure 8C:
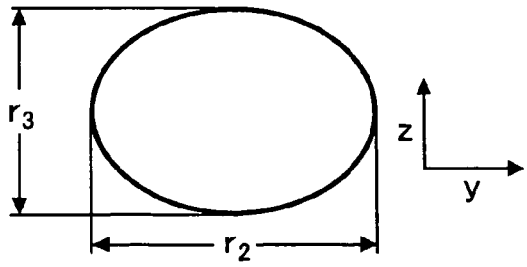

FIG. 8A to 8C are diagrams showing diagrammatically the toner shape according to the present invention. In FIG. 8A, substantially spherical shaped toner is defined as having a long axis r1, short axis r2, thickness r3 (where r1≧r2≧r3). Toner according to the present embodiment preferably has a ratio (r2/r1) of the long axis and short axis (see FIG. 8B) in the range 0.5 to 1.0, and a ratio (r3/r2) of the thickness and short axis (see FIG. 8C) in the range 0.7 to 1.0. If the ratio of the long axis and short axis (r2/r1) is less than 0.5, dot reproducibility and transfer efficiency are adversely affected due to the departure from sphericity and high image quality is not obtained. Also, if the ratio of the thickness and a short axis (r3/r2) is less than 0.7, the particles become close to a flat shape and a high transfer rate as in the case of spherical toner is not obtained. In particular, if the ratio of the thickness and short axis (r3/r2) is 1.0, the particle becomes a rotary body whose rotary axis is the long axis, and fluidity of the toner can thereby be improved. r1, r2 and r3 were measured by observation by image pickup using a scanning electron microscope (SEM), varying the angle of the field of view.

Next, embodiments will be described using experimental results.

Embodiment 1

Figure 9:
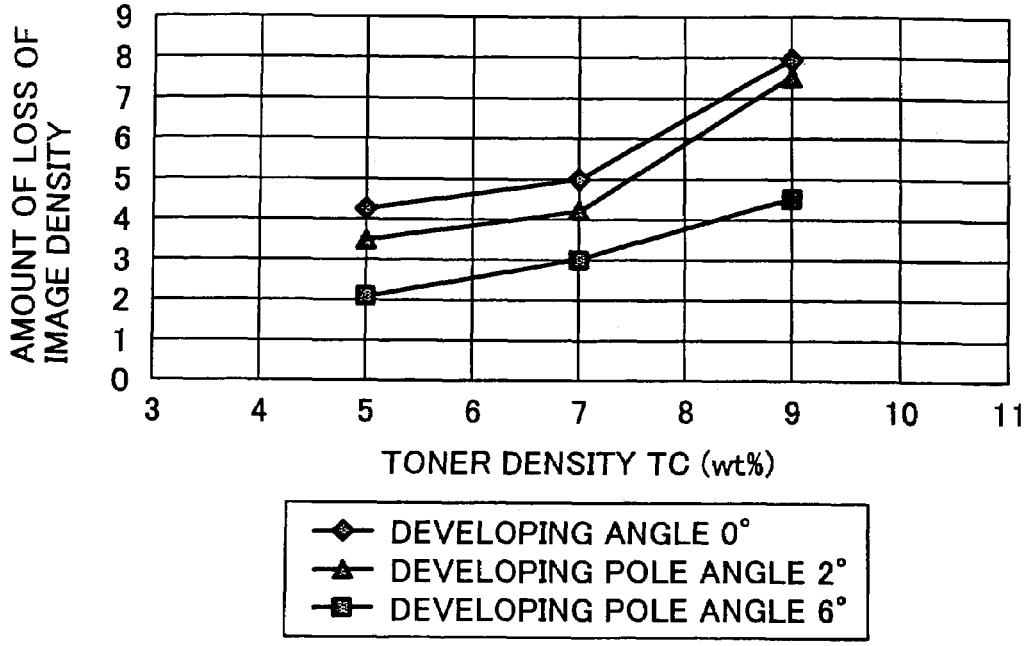
FIGS. 9 and 10 are graphs showing the relationship between toner density, developing magnetic pole angle and amount of loss of image density.

First of all, in a developing device as shown in FIG. 5, the amount of loss of image density in regard to developing magnetic pole angle and toner density under the developing conditions indicated below was measured. The results are shown in FIG. 9.

(Developing Conditions)

Linear speed of photosensitive body: 180 mm/sec

Linear speed ratio of photosensitive body and developing roller: variable range 0.5 to 3.0

Amount of developer picked up by the developing roller: 55 to 60 mm/cm$^2$

Developing gap: variable range 0.25 to 0.50 mm

Toner: polymer toner as set out in this embodiment

Carrier: iron powder carrier of mass average particle size 35 μm

Toner density of developer: about 7 wt %

Developing bias: DC bias

Measurement of loss of image density was performed by the following method. The measuring device used was NEXSCAN F5100 manufactured by HEIDERBERG Inc. The degree of resolution set was 1200 dpi. A loss of image density measurement chart was employed providing a range of image densities over one sheet of the sample. The measurement conditions were that the ID of the block area was about 1.5 and the ID of halftone areas was about 0.5. In some cases, the developing potential was varied in order to obtain the desired image density. No particular transfer paper was specified. The amount of loss of image density obtained is an integrated value over the area in which loss of image density was generated. The type of loss of image density causing the problem of the present invention is marked in the area at the leading edge of the image, so the amount of loss of image density in the area at the leading edge of the image was made the subject of comparison.

In more detail, in the measurement of amount of loss of image density, first of all, print-outs were made of the loss of image density measurement chart under various respective development conditions, using test equipment of the same construction as the printer shown in FIG. 3, while suitably altering these development conditions within the range listed above. This loss of image density measurement chart is a measurement chart in which block areas of ID=about 1.5, size=about 3 cm×3 cm are formed in matrix fashion with a prescribed pitch within a halftone area of ID (image density) =about 0.5. When the edge effect of block areas is comparatively large in development of the loss of image density measurement chart, loss of image density occurs at locations in the periphery of the block areas in the halftone area. Accordingly, image data can be obtained by reading the degree of resolution of 1200 dpi by the NEXSCAN F5100, which is the scanning device used for scanning the loss of image density measurement chart, when the loss of image density measurement chart is printed out. The image data thus obtained is then analyzed using an analysis program developed by the present applicants, and the loss of image density in the periphery of the block areas is thereby measured. Regions of brightness no more than a prescribed value in the periphery of the block region are then identified as regions of loss of image brightness and the area of these regions is found. The amount of loss of image density is then identified as one of 10 level steps: 0, 1, 2, 3, 4, 5, 6, 7, 8, 9, in accordance with the magnitude of this area. Increasing numerical value of these levels corresponds to increasing area of loss of image density.

The target value for the amount of loss of image density, based on actual results obtained with equipment manufactured by ourselves and others is no more than 5. Although if the loss of image density is no more than 5 it is possible to confirm loss of image density visually, this is a level which does not present any particular problems. The relationship between amount of loss of image density and visual evaluation is as follows. Amount of loss of image density less than 1: loss of image density cannot be recognized. Loss of image density of at least 1 but not more than 5: although the loss of image density is of a degree that it can be recognized, it is not of a level such as to present a problem. Loss of image density of at least 5 but not more than 8: there is loss of image density of width about 0.5 mm at the periphery of block areas: this is a fairly poor level. Loss of image density of 8 and up: there is loss of image density of at least 0.5 mm at the periphery of block areas: very poor level.

As can be seen from the results of FIG. 9, by increasing the developing magnetic pole angle $\alpha$ with inclinations of 0°, 2°, and 6°, in general, the developing performance tends to be adversely affected, but good results are obtained in terms of the amount of loss of image density. By making the developing magnetic pole angle $\alpha$ at 2° or more, the amount of loss of image density for a toner density of 5 to 7.5 wt % satisfies the target value of being not more than 5 i.e. an effect of improvement as regards loss of image density is obtained. In particular, in the vicinity of a developing magnetic pole angle of 6°, a marked improvement in regard to loss of image density is seen in the range 5 to 9 wt % of toner density. Usually, in order to ensure maximum developing performance, the developing magnetic pole angle $\alpha$ is made 0°. It is therefore fairly uncommon to incline the developing magnetic pole angle with respect to the photosensitive body.

However, according to the present tests, the drop in developing performance produced by inclining the developing magnetic pole angle $\alpha$ at 6° was not particularly great and was not such as to affect the image. On the other hand however, the improvement effect in regard to loss of image density was marked. It is believed that this is because, in the developing gap, the angle of the spikes of developer that contact the photosensitive body is flattened, so the scavenging force whereby the toner that has already been developed on the photosensitive body is physically scraped off by the erected spikes is lowered. Also, the flattening of the angle of the spikes of the developer that contact the photosensitive body increases the area of contact of the spikes with the photosensitive body per unit time, so excellent development is achieved, even in regions where the development potential has dropped due to the edge effect.

In contrast, when the same test was conducted with the development magnetic pole angle $\alpha$ made 9°, due to the excessive flattening of the angle of the spikes in the developing gap, contact with the photosensitive body became insufficient, resulting in poor development. Taking into consideration yield in mass-production of the image forming apparatuses in a factory, it is necessary to allow about ±2° of angular tolerance in respect of the developing magnetic pole angle $\alpha$.

Figure 10:
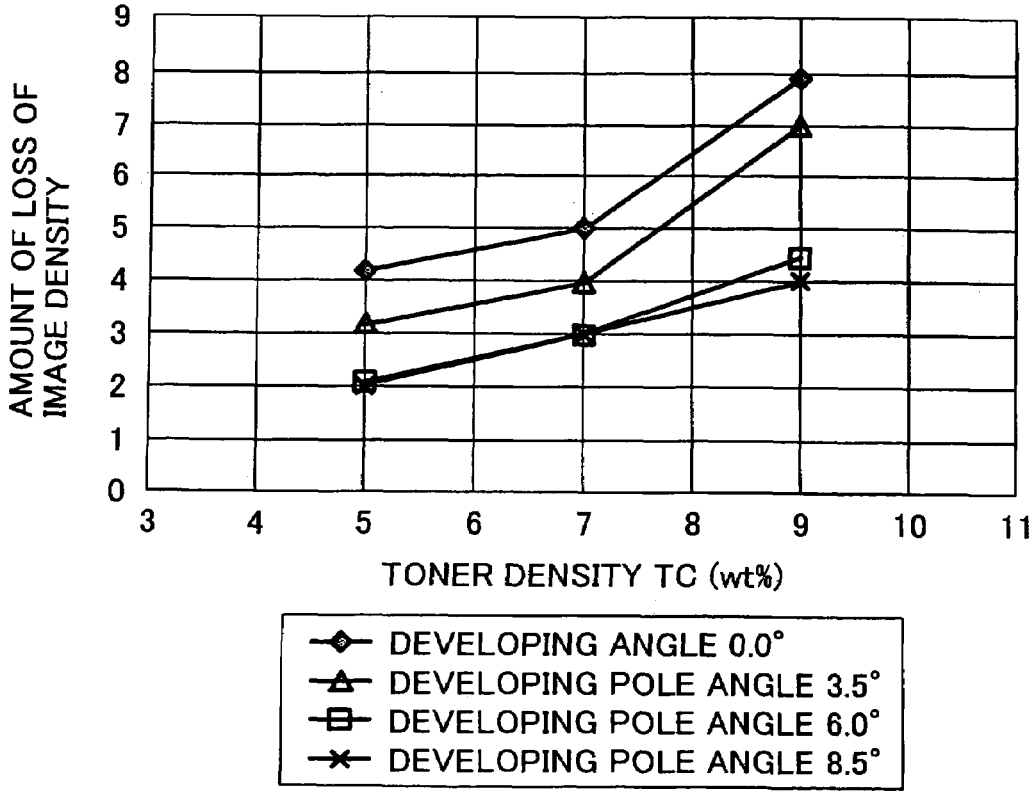

Further verification tests were therefore conducted with this in mind. In these verification tests, the developing magnetic pole angle $\alpha$ was varied between five levels: 0°, 3.5°, 6°, 8.5°, and 9°, under conditions thought to promote a loss of image density due to increased sliding frictional force of the magnetic brush i.e. under conditions of linear speed ratio of 2.0 of the photosensitive body and the developing roller. The results of these verification tests are shown in FIG. 10. From the graph of FIG. 10, it can be seen that, if the developing magnetic pole angle $\alpha$ is in the range 3.5°, 6°, 8.5°, the amount of loss of image density due to the edge effect can be kept to the rather poor level of 7, even if the toner density is high. Consequently, it is believed that the amount of loss of image density can be kept within an allowable range if image formation is in the range of developing magnetic pole angle $\alpha$=6°±2.5°, which represents the variability of mass-produced products.

It should be noted that, if the developing magnetic pole angle $\alpha$ is made 9°, extremely poor development is produced. For this reason, experimental results in the case where the developing magnetic pole angle $\alpha$=9' are not shown in FIG. 10. Also, if the developing magnetic pole angle $\alpha$ is made 0°, depending on toner density, loss of image density due to the edge effect reaches a level which cannot be allowed and loss of image density during transfer is also generated due to flying off of the carrier onto the photosensitive body.

Normally the toner density that is employed is in the range 6 to 9 wt %. If the toner density is less than 6 wt %, the amount of toner covering the carrier becomes small, so, although developer is picked up by the developing sleeve, the amount of toner that is available for development of the latent image on the photosensitive body is insufficient, resulting in a drop in image density due to insufficiency of amount of development. Also, the carrier, which is now covered by toner to a lesser degree, creates electrostatic induction in accordance with the potential of the surface of the photosensitive body, with the result that the carrier is itself developed onto the photosensitive body, giving rise to the phenomenon known as carrier deposition. Contrariwise, if the toner density exceeds 9 wt %, the toner cannot be held by the carrier and, as a result, gives rise to the phenomena of flying off of the toner or spillage of toner from the developing roller.

Embodiment 2

Figure 11:
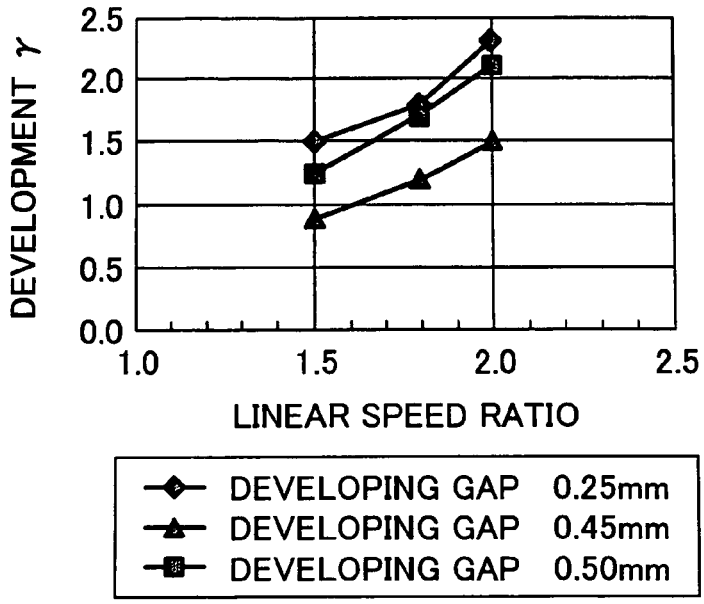
FIG. 11 is a graph showing the relationship between the linear speed ratio, developing gap and development γ.

Determination of the dependence of the developing performance on the developing gap and/or the linear speed ratio of the photosensitive body and developing roller was conducted under the same development conditions as in the case of embodiment 1. The results are shown in FIG. 11. The method of determination of the development performance was as follows. In general, the developing performance is usually expressed by the inclination of the amount of development deposition on the photosensitive body with respect to the developing bias i.e. the so-called development γ. The weight is measured by using a chart in which block patches of about 5 $cm^2$ are sporadically distributed in the image, forcibly stopping the photosensitive body with the timing with which the toner has been developed onto the photosensitive body and using a suction method to suck up block areas left behind on the photosensitive body. The developing bias is taken along the horizontal axis and the amount of the deposition on the photosensitive body per unit area is taken along the vertical axis (units $mg/cm^2$); the gradient is termed the development γ. Larger values of the development γ indicate higher development performance. While no particular threshold value of the development γ in numerical terms is set, if the development γ is less than 1.5, the development performance is so low that the development performance cannot be rescued by altering the development conditions such as increasing the toner density or employing a large linear speed ratio. Accordingly, a development γ of at least 1.5 is recommended.

From the results of FIG. 11, it can be seen that the development γ becomes high as the developing gap is made narrower. If the developing gap is 0.50 mm, a development γ of 1.5 cannot be achieved even if the linear speed ratio is increased to 2.0. Accordingly, in order to obtain a development γ of at least 1.5, preferably the developing gap is made less than 0.45 mm. However, if the developing gap is made narrow, the impact of development spikes on the photosensitive body becomes strong and this is associated with an adverse effect on filming of the photosensitive body. Also, although the need therefore arises to make the range of tolerance variability during assembly small, reducing the assembly tolerance of the developing gap tends to increase manufacturing costs correspondingly, so the existence of a lower limit of the order of substantially 0.20 mm is recognized. Also, from the results of FIG. 11, it can be seen that the development γ increases as the linear speed ratio is raised. Accordingly, in order to achieve development γ of at least 1.5 with a developing gap of less than 0.45 mm, a value of the linear speed ratio of at least 1.7, or, taking into account a variability margin for mass-production, a value of at least 1.8 is preferable.

However, increasing the linear speed ratio correspondingly increases rear edge blurring and/or results in deterioration of the vertical/horizontal line ratio due to side-effects, so, in terms of practical problems, there is an upper limit of the linear speed ratio of 2.0. Conversely, if the developing gap is made narrow, the development γ becomes large with respect to the linear speed ratio and development γ of 1.5 can be obtained even without raising the linear speed ratio.

It should be noted that it was also recognized from the results of making the linear speed of the photosensitive body 150 mm/sec and 205 mm/sec, and varying the linear speed ratio of the photosensitive body and the developing roller as 1.5, 1.8, 2.0 that the linear speed ratio should preferably be at least 1.7. Also, when a test was conducted of linear speed ratio variation under the same development conditions by a development system using an AC bias development system, it was found that the development performance was high, so high development performance was obtained with a linear speed ratio of 1.5 to 2.0.

In a printer according to this embodiment, the center line l1 of the half value width of the magnetic field produced by the developing magnetic pole S1 is lower than the line segment l2 joining the center of rotation of the photosensitive body 10 and the center of rotation of the developing roller 15. Flying off of developer and generation of image abnormalities such as loss of image density can thereby be reduced. Also, even in the case where a DC bias development system is adopted, loss of image density due to flying off of developer and the edge effect generated as side-effects under development conditions aimed at promoting development performance can be reduced.

In a printer according to this embodiment, the developing magnetic pole angle α made by the center line l1 of the half value width of the magnetic field produced by the developing magnetic pole S1 and the line segment l2 joining the center of rotation of the photosensitive body 10 and the center of rotation of the developing roller 15 is 2° to 8.5°. If this developing magnetic pole angle α is less than 2°, the developer flying off suppression effect is small and the toner scraping-off capability of the spikes of developer in the developing gap is strong, giving rise to a loss of image density. If the developing magnetic pole angle α exceeds 8.5°, this results in poor development with unevenness of image density.

In a printer according to this embodiment, an inlet seal 30 is provided as a member for receiving developer, so even if developer were to separate from the developing roller 15 and drop down, it would not be able to contaminate the device main body 1.

In a printer according to this embodiment, polymer toner of uniform particle size is employed, so improved image quality can be achieved.

In a printer according to this embodiment, thanks to a combination of the development conditions listed below, even if a low cost DC bias application system is fitted, high quality images can be obtained. Preferably the developing gap is 0.25 to 0.45 mm. Preferably the ratio (Vs/VP) of the linear speed Vp of the photosensitive body 10 and the linear speed Vs of the developing roller 15 is 1.7 to 2.0.

Also, in a printer according to this embodiment, thanks to the use of toner displaying the conditions listed below, toner can be obtained that is of small particle size, sharp particle size distribution and substantially spherical shape, making it possible to improve image quality and/or increase the margin in respect of generation of image abnormality. Preferably the volume average particle size is at least 3 μm but no more than 8 μm and the ratio (Dv/Dn) of the volume average particle size (Dv) and the number average particle size (Dn) is 1.00 to 1.40. Preferably the shape coefficient SF-1 is in the range 100 to 180 and the shape coefficient SF-2 is in the range 100 to 180. Also, preferably the toner is a toner obtained by cross-linking and/or elongation reaction in aqueous medium of toner material liquid in which polyester prepolymer having at least a functional group containing a nitrogen atom, polyester, coloring agent and release agent are dispersed in an organic solvent. The toner shape is specified in terms of the long axis r1, short axis r2, and thickness r3 (where r1≧r2≧r3). Preferably the ratio (r2/r1) of the long axis r1 and short axis r2 is 0.5 to 1.0, and the ratio (r3/r2) of the thickness r3 and short axis r2 is 0.7 to 1.0.

It should be noted that the description of this embodiment was given for an image forming apparatus using a transfer body constituted by a transfer belt 20 constituting an intermediate transfer body, but there is no restriction to this. For example, an image forming apparatus could be employed using a conveyor belt that conveys a transfer body constituted by a transfer member.

As described above, with this first embodiment, the excellent effect is obtained of providing an image forming apparatus whereby occurrence of flying off of developer and loss of image density are reduced. Also, even in the case where a DC bias development system is adopted, the excellent effect is obtained that an image forming apparatus can be provided wherein loss of image density due to flying off of developer and the edge effect occurring as side-effects under development conditions aimed at improving developing performance are reduced.

Second Embodiment

An image forming apparatus according to a second embodiment constituted by an image forming apparatus using a tandem type electrophotographic system is described below.

Figure 12:
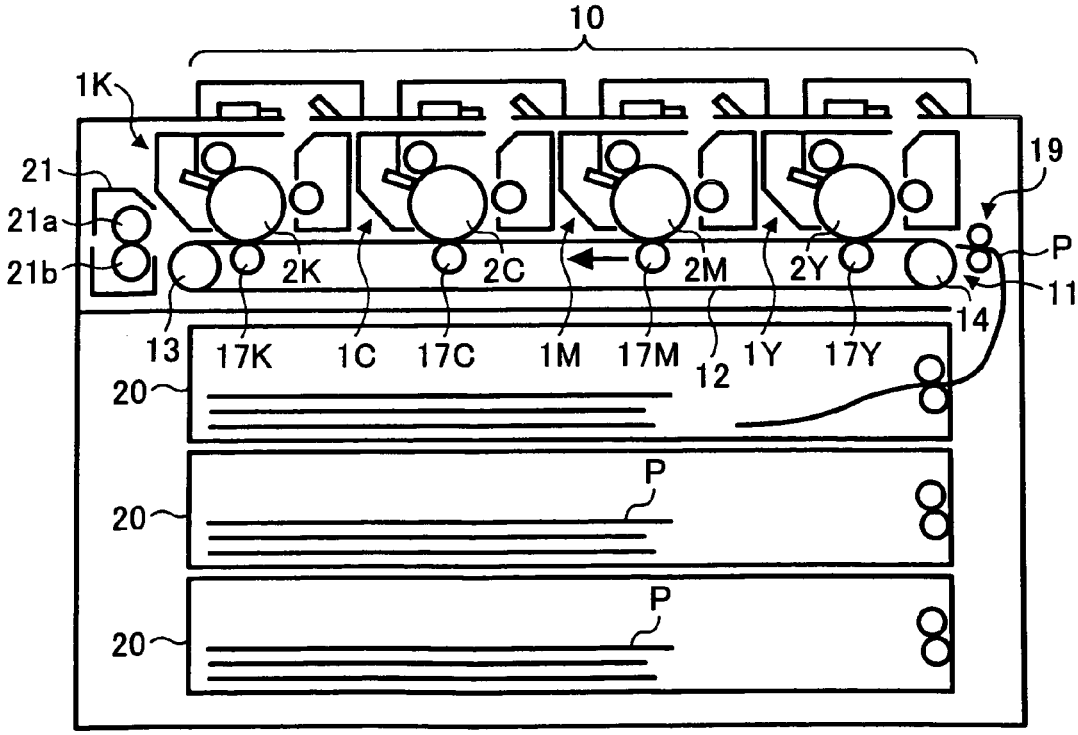
FIG. 12 is a view showing the diagrammatic layout of an image forming apparatus according to a second embodiment of the present invention.

FIG. 12 shows the layout of an image forming apparatus according to this embodiment. This image forming apparatus comprises four sets of image forming units 1Y, M, C and K for forming images of the respective colors: yellow (Y), magenta (M), cyan (C) and black (K) and is thus capable of forming a full-color image. The suffixes Y, M, C and K attached after the respective reference symbols denote members for the yellow, magenta, cyan or black units (and hereinbelow in the same way. However, unless specifically mentioned, these members are identical, so the symbols Y, M, C and K are omitted). Apart from the image forming units 1Y, 1M, 1C and 1K, there are also provided for example an optical writing unit 10, transfer device 11, resist roller pair 19, three paper feed cassettes 20 and fixing device 21.

The optical writing unit 10 comprises four optical-writers. These respective optical writers comprise for example a light source, polygonal mirror, f-θ lens and reflecting mirror and are used to direct laser light onto the surface of a photosensitive body, to be described, in accordance with image data.

Figure 13:
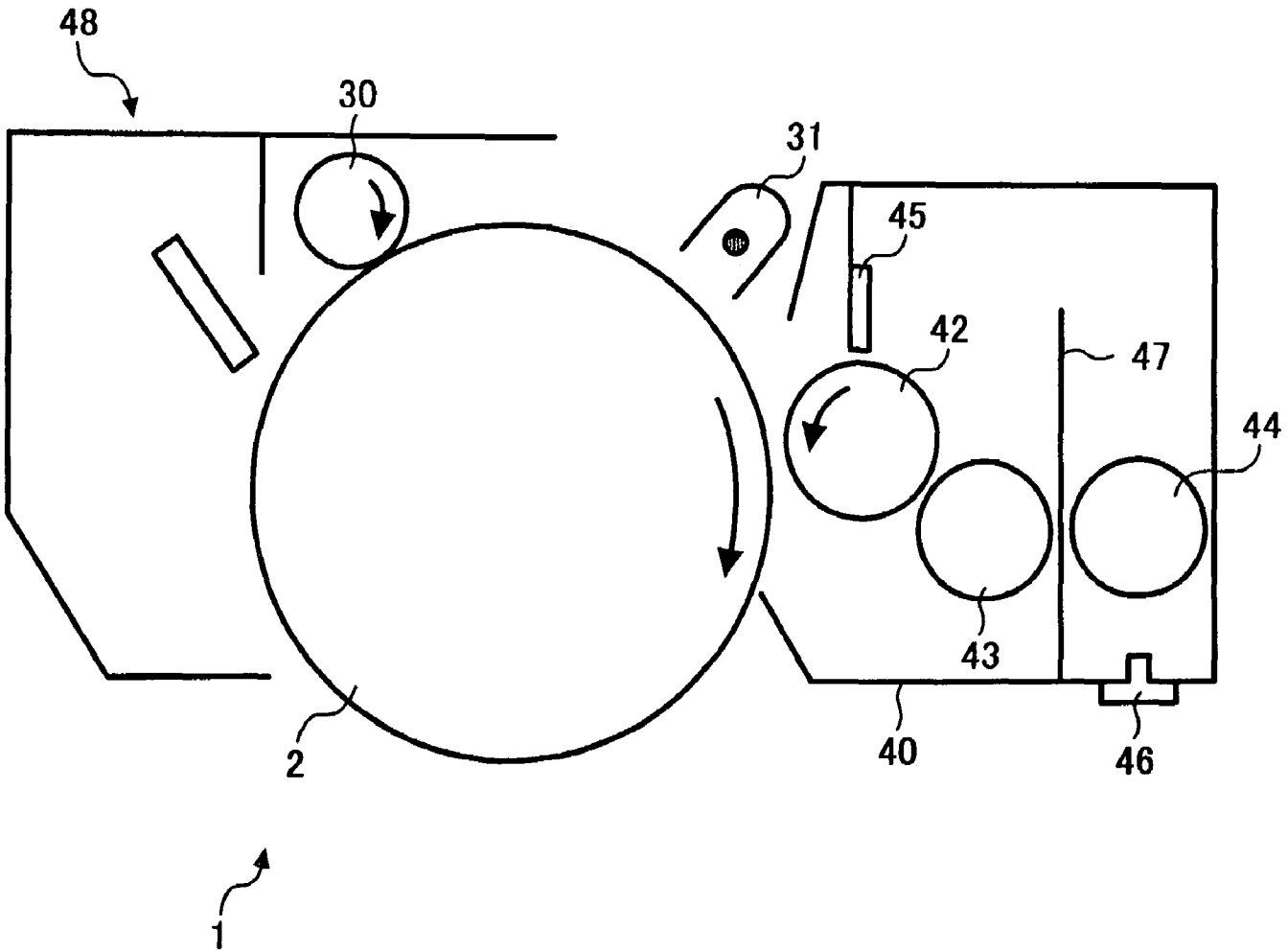
FIG. 13 is a view showing the diagrammatic layout of an image forming section of an image forming apparatus according to a second embodiment of the present invention.

FIG. 13 shows the diagrammatic layout of an image forming unit according to this embodiment. In this Figure, the image forming unit 1 comprises for example a drum-shaped photosensitive body 2 constituting an image carrier, charging device 30, developing device 40, and drum cleaning device 48.

The charging device 30 uniformly charges up the drum surface, by sliding friction with the photosensitive body 2 of a charging roller to which AC voltage is applied. After the photosensitive body 2 has been subjected to the charging processing, the surface of the photosensitive body 2 is illuminated by scanning with laser light that is modulated and deflected by means of the aforesaid optical writing unit 10. When this happens, an electrostatic latent image is formed on the drum surface. The electrostatic latent image that is thus formed is developed by the developing device 40 to produce a toner image.

The developing device 40 comprises a developing sleeve 42 constituting a developer carrier, that is arranged so as to be partially exposed from the aperture of the casing thereof. The developing device 40 further comprises for example a first feed screw 43, second feed screw 44, developing doctor 45, and toner density sensor (hereinbelow called T sensor) 46.

Within the casing there is accommodated two-component developer containing a magnetic carrier and negatively chargeable toner. This two-component developer is frictionally charged while being stirred and fed by the first feed screw 43 and second feed screw 44 and is then carried on the surface of the developing sleeve 42. The developer is fed into the developing region facing the photosensitive body 2 with its layer thickness controlled by means of the developing doctor 45 and toner is deposited on the electrostatic latent image on the photosensitive body 2. A toner image is formed on the photosensitive body 2 by this deposition. Two-component developer whose toner has been consumed by development is returned into the casing with the rotation of the developing sleeve 42.

A partition 47 is provided between first feed screw 43 and second feed screw 44. By means of this partition 47, a first accommodating section that accommodates for example the developing sleeve 42 and first feed screw 43, and a second developing section that accommodates the second feed screw 44 are defined within the casing. The first feed screw 43 is driven in rotation by drive means, not shown, so that the two-component developer in the first accommodating section is fed into the interior from the front in the Figure and is thus concurrently supplied to the developing sleeve 42. The two-component developer that is thus fed to the vicinity of the end of the first accommodating section by the first feed screw 43 penetrates into the second accommodating section through an aperture, not shown, provided in the partition 47. Within the second accommodating section, the second feed screw 44 is driven in rotation by drive means, not shown, so as to feed the two-component developer, that is fed in from the first accommodating section, in the opposite direction to the first feed screw 43. The two-component developer that is fed to the vicinity of the end of the second accommodating section by the second feed screw 44 is returned into the first accommodating section through a further aperture (not shown) that is provided in the partition 47.

The T sensor 46 comprising a magnetic permeability sensor is provided at the bottom wall in the vicinity of the center of the second accommodating section and outputs a voltage of a value corresponding to the magnetic permeability of the two-component developer passing above it. The magnetic permeability of the two-component developer has a certain degree of correlation with the toner density, so the T sensor 46 outputs a voltage of a value corresponding to the toner density. The value of this output voltage is delivered to a control section, not shown. This control section comprises data storage means such as RAM that stores therein Vtref for the Y unit, which is the target value of the output voltage from the T sensor 46. It also stores the data of Vtref for the M unit, Vtref for the C unit and Vtref for the K unit, which are the target values of the output voltages from the T sensors, not shown, fitted in the developing devices for the other colors. The Vtref for the Y unit is employed for drive control of a toner feed device, not shown. Specifically, this control unit performs drive control of the toner feed device, not shown, such that toner is supplied into the second accommodating section such that the value of the output voltage from the T sensor 46 approaches Vtref for the Y unit. By means of this supply of toner, the donor density of the two-component developer in the developing device 40 is maintained within a prescribed range. Identical control of toner supply is performed in the developing devices of the other process units.

The toner image that is formed on the photosensitive body 2 for the Y unit is transferred onto the transfer paper P that is fed by a paper feed belt, to be described. The surface of the photosensitive body 2 after transfer is cleaned of residual toner left behind after transfer by a drum cleaning device 48 and its charge is removed by a charge removal device, not shown. This toner is then made available for the formation of the next image after being uniformly charged up by the charging device 30. The same applies to the image forming units of the other colors.

In FIG. 12 shown above, the image forming units 1Y, M, C, K are respectively arranged sequentially in the horizontal direction and the transfer device 11 is arranged below these. The transfer device 11 comprises for example a paper feed belt 12, drive roller 13, tensioning roller 14, and four transfer bias rollers 17Y, M, C and K. An endless paper feed belt 12 is tensioned in a laterally elongate attitude, taking more space in the horizontal direction than in the vertical direction, by means of the drive roller 13 and tensioning rollers 14, 15. Also, the belt is moved in endless fashion anti-clockwise in the Figure by means of the drive roller 13, that is rotated by means of a drive system, not shown. Transfer bias is applied from respective power sources, not shown, to the four transfer bias rollers 17, M, C, and K. Respective transfer nips are formed by applying pressure to the paper feed belt 12 towards the photosensitive bodies 2Y, M, C, K from the rear face thereof. A transfer electrical field is formed in the respective transfer nips between the photosensitive body 2 and the transfer bias rollers by the effect of the transfer bias referred to above. The toner image mentioned above formed on the photosensitive body 2 is transferred onto the transfer paper P that is fed onto the paper feed belt 12, by the effect of this transfer electrical field and/or nip pressure. Transfer is effected onto this toner image, with the M, C, and K toner images formed on the photosensitive bodies 2M, C, and K being successively superimposed. In combination with the white color of the paper, a full-color toner image is formed by such superimposed transfer on the transfer paper P that is fed from the right to the left in the Figure while being held on the surface of the paper feed belt 12.

Three paper feed cassettes 20 that accommodate a plurality of sheets of transfer paper P in superimposed fashion are arranged at multiple levels so as to be superimposed in the vertical direction below the transfer device 11, each respective cassette being used to press a paper feed roller onto the uppermost transfer paper sheet P. When the paper feed rollers are driven in rotation with prescribed timing, the uppermost transfer paper sheet P is fed along the paper feed path.

The transfer paper sheet P that is fed in the paper feed path from the paper feed cassettes 20 is gripped between the rollers of a resist roller pair 19. The resist roller pair 19 feeds the transfer paper that is gripped between the rollers with a timing such that the toner images can be superimposed at the respective transfer nips. In this way, transfer is effected with the toner images superimposed on the transfer paper P in the respective transfer nips. When the full-color image has been formed on the transfer paper P, the transfer paper P is fed to the fixing device 21.

The fixing device 21 forms a fixing nip by means of a heating roller 21*a* having a heat source such as a halogen lamp in its interior and a pressurizing roller 21*b* that is in pressure contact therewith. The full-color image is then fixed on the surface while clamping the transfer paper P in this fixing nip. After the transfer paper P has passed through the fixing device 21, the transfer paper P is discharged to outside the device through a paper discharge roller pair, not shown.

Figure 14:
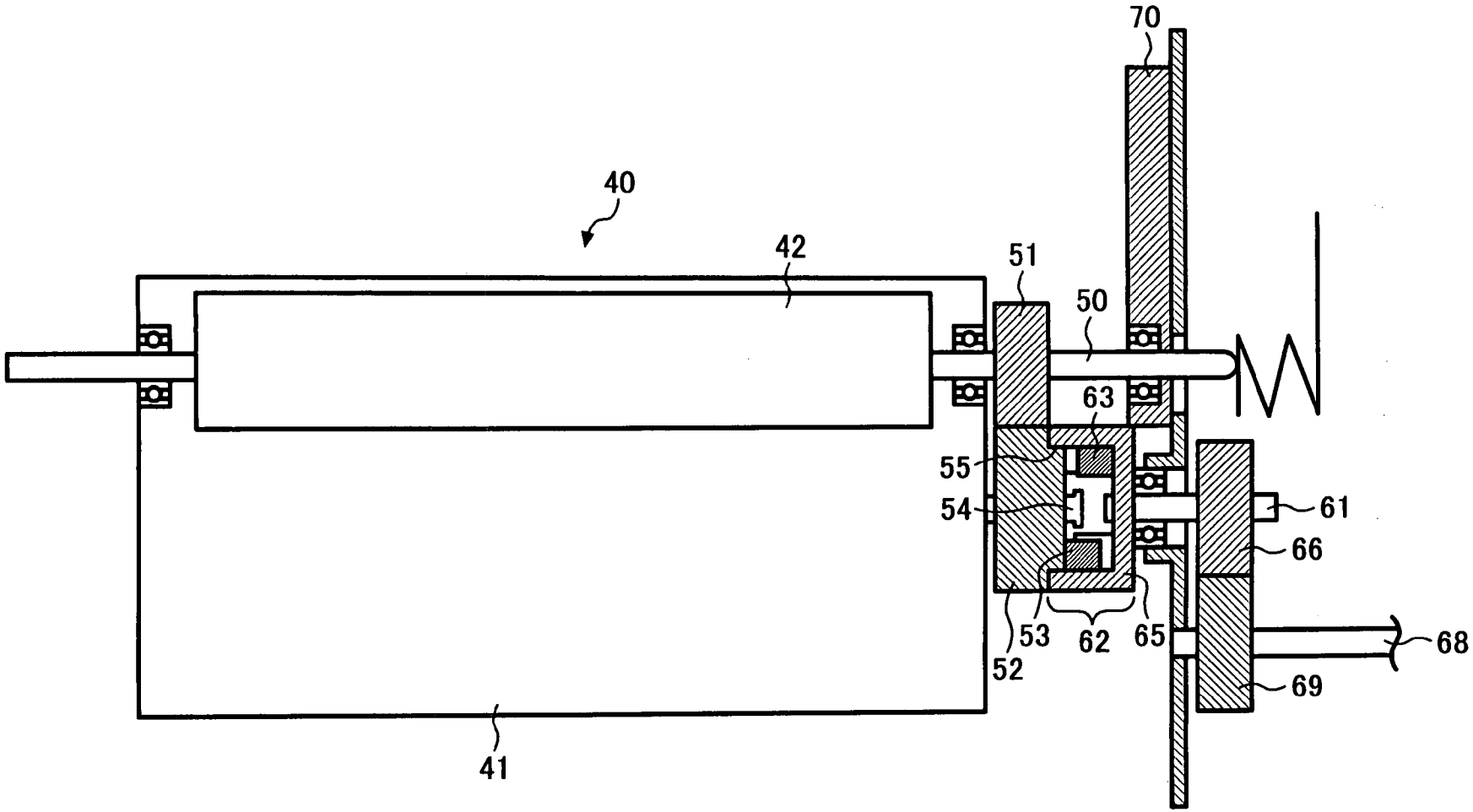
FIG. 14 is a view showing a developing device in an image forming apparatus according to a second embodiment of the present invention and a side plate of the main body of this image forming apparatus.

FIG. 14 shows a developing device 40 in an image forming apparatus according to the second embodiment together with a side plate of the main body of the image forming apparatus. The developing device 40 comprises for example a developing sleeve 42 that is arranged so as to be partially exposed from the aperture, not shown, of the casing 41, a feed screw, not shown, and a development doctor. The developing sleeve shaft 50 extends from the interior of the casing 41 from the side face at the top in the Figure in the casing 41. A roller gear 51 constituting a downstream gear is fixed at the outside of the casing 41 and rotates integrally with the developing sleeve shaft 50. A first gear 52 arranged on the right-hand side of this in the Figure and constituting a driven side rotary member meshes with this rotary gear 51. The driven rotary member is rotatably held by a holding shaft 54 constituting a holding body that is arranged projecting at the side face of the casing 41 and comprises a projection 55 and claws 53 constituting driven engagement sections, and a first gear 52.

Figure 15:
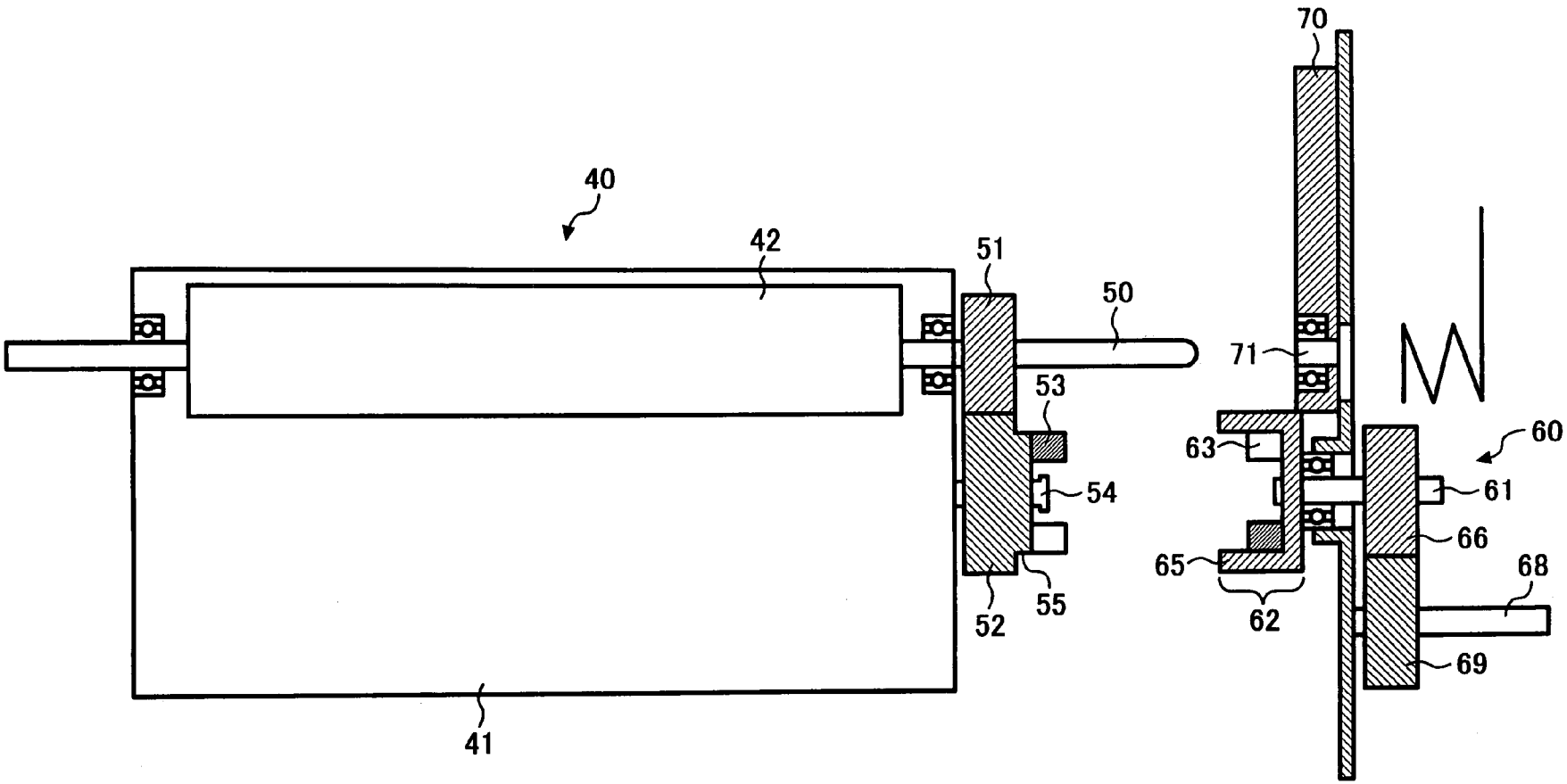
FIG. 15 is a view showing a developing device right in the middle installed in the image forming apparatus according to a second embodiment of the present invention and a side plate of the main body of this image forming apparatus.

FIG. 15 shows the developing device in the middle that is mounted on the image forming apparatus, and a side plate of the image forming apparatus main body. The developing device 40 is removably mounted on the image forming apparatus main body. The developing device 40 is constructed so as to be removably mounted by sliding movement of the developing device 40 in the vertical direction of the plane of the drawing within the image forming apparatus main body. A shaft hole 71 for insertion of the developing sleeve shaft 50 of the developing device 40 is provided in the side plate 70 of the image forming apparatus main body. When mounted on the image forming apparatus main body, the end of the developing sleeve shaft 50 that projects from the side of the casing of the developing device 40 is inserted in this shaft hole 71, thereby being located in position with respect to the image forming apparatus main body of the developing device 40. By means of this positional location, the developing sleeve 42 and the surface of the photosensitive body 2 are made to face each other with a prescribed developing gap.

The driven rotating member is freely rotatably held by a holding shaft 54 that projects at the side face of the casing of the developing device 40, on the right-hand side in the Figure of the developing sleeve shaft 50. This driven rotary member comprises a driven engagement section comprising a projection 55 and two claws 53 formed at the end in the direction of the rotary shaft and a first gear 52 integrally formed so as to rotate on the same rotary axis therewith. The first gear 52 of the driven rotary member meshes with the roller gear 51 that is fixed on the developing sleeve shaft 50.

A drive shaft 68 that receives the drive from the drive motor is mounted on the outside face (face on the upper side in the Figure) on the side plate 70 of the image forming apparatus main body. A drive gear 69 is freely rotatably mounted on a drive shaft 68. A drive side rotary member 60 having for example a shaft 61, drive side engagement section 62 and drive output gear 66 is freely rotatably supported on the side plate 70 on the left-hand side in the Figure of the drive shaft 68 constructed in this way. The shaft 61 of the drive side rotary member 60 is mounted so as to pass through the side plate 70 to the inside (underside in the Figure) from the outside (upper side in the Figure) of the image forming apparatus. The drive output gear 66 is fixed at a location on the outside of the image forming apparatus, on this shaft 61, and meshes with the drive gear 69 described above. Also, at a location on the inside of the image forming apparatus on the shaft 61, there are provided a cap 65 having a recess shaped like the lid of a tea caddy and a drive side engagement section 62 having two claws 53 that are erected on the bottom face on the inside of this. When the drive motor, not shown, is rotated, the rotary drive force thereof is transmitted from the drive gear 69 to the drive output gear 66 and the drive side engagement section 62 is thereby rotated.

As shown in the Figure, in the developing device 40, the driven side engagement sections 53, 55 thereof are mounted on the image forming apparatus main body in an attitude facing the drive side engagement section 62 that is freely rotatably supported on the side plate of the image forming apparatus main body. In the mounting process thereof, a driven side engagement section projection 55 enters the cap 65 of the drive side engagement section 62 on the side of the image forming apparatus main body and these two elements are engaged with each other. When, in this condition, the drive side engagement section 62 is rotated, the two claws 63 that are provided on the bottom face of the cap 65 thereof respectively individually engage the two claws that are provided at the end face of the driven side engagement section. In this way, the driven side rotary members 52, 53, 55 of the developing device 40 are rotated. This rotary drive force is then transmitted to the developing sleeve 42 through the first gear 55 and a gear that is further downstream on the driven side of this, causing the developing sleeve 42 to rotate.

Regarding the surface of the developing sleeve 42, preferably the amount of the two-component developer that is picked up by the rollers is stabilized by cutting grooves such as V grooves therein or by roughening the surface by sand-blasting. If this is done, unevenness of developing density produced by fluctuation in the amount of developer that is picked up can be suppressed. Typically, it is preferable that the developing sleeve 42 should be subjected to the formation of grooves such as V grooves, since stabilized conveyance of the developer can thereby be achieved without friction even when the developing sleeve 42 is used for a longer period than a developing sleeve 42 that was subjected to sand-blasting.

It should be noted that, as shown in FIG. 14, a spring member that is fixed to the side plate 70 of the image forming apparatus main body is arranged to come into contact with one end face of the developing sleeve shaft 50 in a condition in which the developing device 40 is mounted on the image forming apparatus main body. Developing bias is applied from the power source, not shown, using this spring member as a main electrode.

In such a drive transmission system, the combination of the drive side engagement section 62 and driven side engagement sections 53, 55 is widely known by the name of a so-called coupler. In drive transmission by the coupler, the rotary shaft member on the drive side and the rotary shaft member on the driven side can be successively arranged on substantially the same axis. However, arrangement of these two rotary members exactly on the same axis is extremely difficult due to factors such as errors of assembly precision, with the result that drive is transmitted during rotation in a position in which these two rotary members are mutually slightly axially misaligned. For example, in the illustrated image forming apparatus, as described above, positional location of the developing device 40 is performed by insertion of the developing sleeve shaft 50 into the shaft hole 71 of the side plate 70, so, on the side of the image forming apparatus main body, the reference position for positional location of the developing device 40 constitutes the center of the shaft hole 71 of the side plate 70. An error in distance is unavoidable due to for example errors of assembly between the center of the shaft hole 71 in the side plate 70 and the shaft 61 of the drive side rotary member 60. Furthermore, in the developing device 40, the reference for positional location with respect to the image forming apparatus main body is the center of the developing sleeve shaft 50, but an error in distance due to for example errors of assembly between the center thereof and the shaft of the driven side rotary member is also unavoidable. Due to these errors of distance, a minute misalignment of axes between the drive side rotary member 60 and the driven side rotary members 52, 53, 55 is unavoidable. This misalignment of axes causes variation of the speed of rotation of the developing sleeve 42, resulting in developing density unevenness.

In the conventional coupler, the reason for the creation of such variation of speed of rotation in the developing sleeve 42 by misalignment of axes is that the amount of drive transmission from the drive side engagement section to the driven side engagement section varies due to the misalignment of axes. Specifically, if there is misalignment of axes, the amount of drive transmission to the driven side engagement section per unit amount of rotation varies during a single rotation of the drive side engagement section, due to the difference in rotational position. In general, if there is misalignment of axes, the amount of drive transmission to the driven side engagement section per unit amount of rotation gradually increases with increase in the amount of rotation during rotation of the drive side engagement section until rotation has taken place by 180° from a prescribed rotational reference position. In contrast, during rotation from 180° to 360°, the amount of drive transmission per unit amount of rotation to the driven side engagement section gradually decreases with increase in the amount of rotation. This therefore produces speed fluctuation in the rotary body due to the variation of amount of drive transmission to the driven side engagement section, resulting from difference in rotational position of the drive side engagement section.

In conventional couplers, an Oldham coupling is known as a coupling whereby rotation of two engagement sections can be effected even if there is considerable misalignment of their axes. With this Oldham coupling, even if there is considerable misalignment of the axes of two engagement sections, these are forcibly rotated, so speed fluctuation of drive transmission due to such misalignment of axes could not be avoided. In addition, in an Oldham coupling, a groove shaped recess is provided at one end of the two engagement sections and a projection is provided at the other end that engages in a fashion capable of sliding movement in the longitudinal direction of the groove with respect to this groove shaped recess. Thus, by producing sliding movement of the projection in the longitudinal direction of the groove in the recess in response to rotation of the drive side engagement section, a condition is formed such that misalignment of the axis is not generated. In this way, even though there is misalignment of the axes of the two engagement sections, the two engagement sections can be forcibly made to rotate.

With this construction, in a single rotation of the drive side engagement section, a rotational position is generated where there is large frictional force between the projection and the groove shaped recess and a rotational position is generated in which there is only small frictional force therebetween. Although a strong force tending to produce bending of the rotary shaft of the drive side engagement section in the direction orthogonal to the axial direction thereof acts at the rotational position where the frictional force becomes large, by creating a sliding movement of the projection utilizing this force, the two engagement sections are somehow or other made to rotate. As a result, fluctuation in the amount of drive transmission from the drive side to the driven side occurs due to the difference in load on the rotary drive source such as a motor, due to difference in the rotational position of the drive side engagement section.

Thus, with a conventional Oldham coupling, rotation of two engagement sections whose axes are mutually misaligned is forcibly achieved by sliding movement of a projection: thus rotation of the two engagement sections by elimination of the axial misalignment was not achieved.

In an image forming apparatus according to the second embodiment, axial misalignment of the two engagement sections is eliminated by employing a novel construction (to be described) that previously did not exist for the driven side rotary members 52, 53, 55.

Figure 16A:
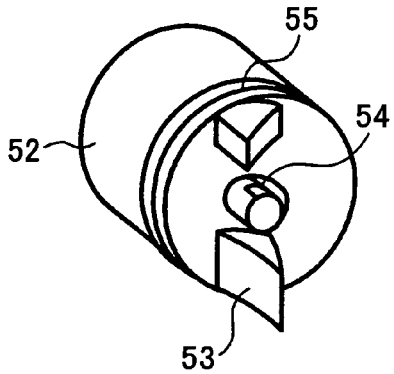
FIG. 16A is a perspective view showing a driven side rotary member thereof.
Figure 16B:
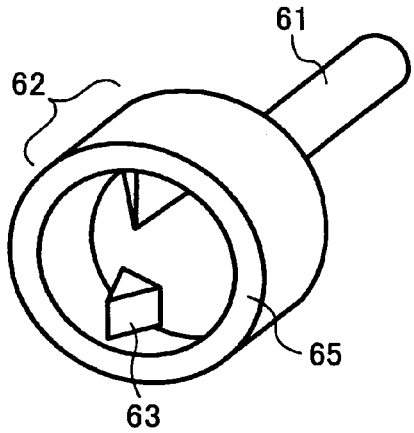
FIG. 16B is a perspective view showing a drive side engagement section of a drive side rotary member thereof.
Figure 17:
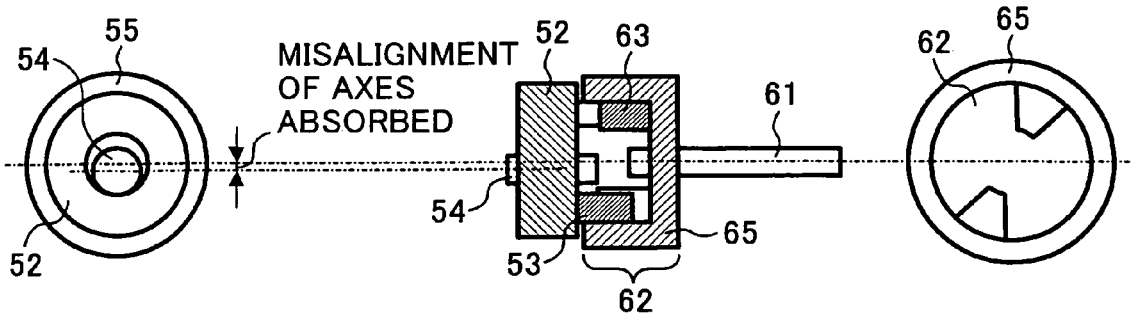
FIG. 17 is a cross-sectional view showing a driven side rotary member thereof and a drive side rotary member thereof, in meshing condition.

FIG. 16A shows a driven side rotary member to a larger scale. FIG. 16B shows a drive side engagement section of a drive side rotary member to a larger scale. FIG. 17 is a cross-sectional view of the condition in which the driven side rotary member and the drive side rotary member are in meshing engagement. In FIG. 16A, through-holes for shaft insertion are provided at the centers of rotation of the driven side rotary members 52, 53, 55. In the casing side plate of the developing device 40, not shown, a holding shaft 54 for holding a driven side rotary member in freely rotatable manner projects in non-rotatable fashion and is inserted in a through-hole of the driven side rotary member. Since the diameter of this holding shaft 54 is smaller than the diameter of the through-hole, the driven side rotary member is held in a fashion in which it is capable of movement in the planar direction orthogonal to the direction of this rotary shaft. It should be noted that, although not shown for convenience in the Figures, a doughnut-shaped metal member of larger diameter than the through-hole is fitted at the end of the holding shaft 54. Escape of the driven side rotary member from the holding shaft 54 is thus prevented by engagement of this metal member with the end face of the driven side rotary member.

The drive side engagement section 62 shown in FIG. 16B cannot move within the plane orthogonal to the axial direction, because the shaft 61 is freely rotatably supported in roller bearings of a side plate of the image forming apparatus main body, not shown. However, as mentioned above, the driven side rotary members 52, 53, 55 shown in FIG. 16A are capable of movement in any desired direction in the plane orthogonal to the direction of the axis. The projection 55 that is provided on the driven side engagement section is tapered towards the end face from the first gear 52. Due to this taper, the diameter at the tip of the recess 55 is appreciably smaller then the internal diameter of the cap 65 of the drive side engagement section 62. Consequently, during mounting of the developing device 40, even if the two engagement sections are not on precisely the same axis, the tip of the projection 55 of the driven side engagement section gradually penetrates into the cap 65 of the drive side engagement section 62 as mounting of the developing device 40 onto the image forming apparatus main body proceeds. Then, when the developing device 40 is further pushed into the image forming apparatus main body so as to be completely set in position, movement of the recess 55 takes place in the direction such as to approach the axis in the plane orthogonal to the axial direction, due to penetration of the taper at the tip thereof into the cap 65 while abutment takes place with the inside wall of the cap 65. At the stage where the developing device 40 has thereby been completely set in position, the axes of the two engagement sections perfectly coincide. It should be noted that, in addition to such movement within the plane orthogonal to the axial direction, movement of the driven side rotary member in the direction of the axis may also be anticipated by the amount of any play produced by component intersection of the casing side plate of the developing device 40 and the driven side rotary member or by the amount of a gap that is set beforehand. However, it should be noted that such movement towards the axis direction does not affect the operative effect according to the present invention: when the movement of the driven side rotary member is analyzed into components, this effect is due to the movement component in the plane orthogonal to the axis.

Thus, in this second embodiment, in the image forming apparatus, the driven side engagement section of the developing device 40 is not fixed to the shaft as conventionally but can move in a minute range with respect to the developing device 40, since it is held by the holding shaft 54 so as to permit movement within the plane orthogonal to the direction of the axis. Thus, when this driven side engagement section that is moveable in this way comes into engagement with the drive side engagement section 62, any misalignment of the axes of the two engagement sections is eliminated by correction of the position of the driven side engagement section by movement of the center of rotation thereof to a location at which it coincides with the rotary axis of the drive side engagement section 62. Fluctuation of the amount of toner per unit time that is conveyed to the development position, which is a facing position of the photosensitive body 2 and the developing sleeve 42, is thereby reduced, since there is no fluctuation of rotational speed of the developing sleeve 42 due to misalignment of axes: developing density unevenness can thereby be suppressed.

It should be noted that it is difficult to make the axes of the two engagement sections totally coincide when viewed for example in terms of dimensions of minute order i.e. nanometres (nm). However, from the point of view of mechanical design of a drive transmission system using gears, so long as the misalignment of axes is in the range 0.01 to 0.1 mm, they may be regarded as being on the same axis. "Rotating on the same axis" in this embodiment is a concept including such a degree of misalignment of axes.

Also, the drive side rotary member 60 is a member that is driven in rotation at a position that is more on the drive side than the developing device 40 with respect to the drive motor constituting the drive source, not shown.

Regarding the diameters of the through holes of the driven side rotary members 52, 53, 55, these are made larger than the diameter of the holding shaft 54 so as to be capable of accommodating misalignment of axes up to a maximum of 0.15 mm. If this is done, a gap may be formed between the through-hole of the drive side engagement section and the holding shaft 54 that is inserted therein. This gap therefore allows play of the driven side rotary member in a direction orthogonal to the direction of the rotary axis of the drive side rotary member 60 on the side of the image forming apparatus. Also in the case of conventional gears, the diameter of the through-hole aperture was made somewhat larger than the diameter of the rotary shaft member, with the object of avoiding the situation of it becoming impossible to insert the rotary shaft member, such as a shaft, in the through-hole aperture provided in the gear member, due to dimensional errors of components. However, this difference of diameters was a value of at most a few tens of μm and thus was much smaller than the difference of diameters of the through-hole of the driven side rotary member and holding shaft 54 in the present image forming apparatus. The difference of diameters of the through-hole and holding shaft 54 in the present image forming apparatus is much larger than the difference of diameters of the through-hole aperture and rotary shaft member in the case of prior art gears. This large difference of diameter allows play of the driven side rotary member in the planar direction orthogonal to the direction of the rotary shaft thereof.

Regarding the combination of the driven side engagement section and the drive side engagement section, as shown in FIG. 17, the claws 53 of the driven side engagement section may be arranged to engage the cap 65 of the drive side engagement section 62. However, as shown in FIG. 16A, the driven side engagement section is provided with a projection 55 tapered at its tip so as thereby to achieve more reliable engagement thereof with the cap 65.

In an image forming apparatus according to this second embodiment, pitch unevenness caused by eccentricity of the two engagement sections can be prevented by aligning the axes in the drive side engagement section 62 and driven side engagement section 52, 53, 55. However, even if the inter-axial distance of the first gear 52 in the driven side engagement section and the gear on the downstream side therefrom (i.e. the roller gear 51, in the case of the image forming apparatus) is set to the inter-axial distance of a standard gearwheel, variation is found in this inter-axial distance due to the eccentricity correction action described above. It may therefore be feared that inconveniences may arise in the case where the inter-axial distance is too close and in the case where the inter-axial distance is too wide, respectively. Specifically, there is a possibility that, if the inter-axial distance is too close, impacts produced by interference between the gear tips and gear troughs may give rise to speed variations, resulting in the formation on the photosensitive body 2 of a toner image having density unevenness. In this image forming apparatus, in order to suppress the occurrence of such density unevenness, the first gear 52 and the roller gear 51, which is the gear that meshes therewith, are therefore negative-shifted by a length of at least 0.1 mm. By this negative shift, the space at the bottom of the gear troughs can be widened, thereby making it possible to prevent interference as described above. However, if resin gears made of a material such as polyacetal or polycarbonate are employed in a setting of about modulus 0.6 to 1.0, if the amount of such negative shift is greater than 0.3 mm, it is found that the gears rapidly become damaged, due to the gear roots being too thin and being unable to withstand the drive load of the developing sleeve 42. Accordingly, in this image forming apparatus, the amount of negative shift is set to an amount of between 0.1 to 0.3 mm. If metal gears or resin gears containing glass-fiber in order to increase the gear strength are employed, an amount of negative shift greater than 0.3 mm may be employed.

If the inter-axial distance is made too wide, there is a risk of the gears failing to mesh, but this can be adjusted to some extent by increasing the modulus or the number of teeth. Failure to mesh therefore does not arise in normal design. However, there is a risk of development density unevenness becoming large due to contact of adjacent gear teeth, as a result of the distance of movement when moving to the next tooth from a tooth in respect of which the gear teeth are currently meshed becoming large, resulting in impact with increased momentum. In the present image forming apparatus, in order to suppress generation of such density unevenness, as will be described, the number of moving teeth of the first gear 52 and roller gear 51 during surface movement of 1 mm of the photosensitive body 2 is respectively set at at least 0.72 teeth.

By negative shift is meant that gear cutting processing is performed with the reference pitch line of the rack tool for gear cutting during gear processing set inwards, as viewed from the gear center, from the reference pitch line of the gearwheel. The amount of negative shift is the difference between the pitch circle of the standard gear wheel and the reference pitch line of the rack tool. By such negative shift, the depth of gear cutting of the gear roots becomes deeper and, as a result, the free space in the gear troughs becomes greater, making it possible to suppress interference of the gear tips and the gear troughs.

In the image forming units 1Y, M, C, K, it is preferable from the point of view of improving developing performance to make the developing gap between the photosensitive body 2 and the developing roller 42 narrow: preferably the developing gap is no more than 0.45 mm and indeed preferably is no more than the 0.4 mm. In particular in the case of image forming apparatuses in which a developing device using the DC bias developing system is fitted, the effect in terms of improving developing performance is even more marked. When the developing gap is made narrow in accordance with the numerical values given above, compared with the case where the developing gap is wider than these values, granularity of the developed toner image is considerably improved, making it possible to obtain a high-quality image. However, when the developing gap is narrowed in this way, even if misalignment of axes between the two engagement sections is eliminated, there may be marked developing density unevenness caused by minute fluctuations of rotational speed of the developing sleeve 42. Although, in previous equipment, in which the developing gap was set larger than 0.4 mm, such developing density unevenness was not particularly marked, if the developing gap is set to 0.4 mm or less, such developing density unevenness does become marked. It should be noted that this developing density unevenness is produced by contact of the teeth of the various gears that transmit drive to the developing sleeve 42.

Such developing density unevenness caused by impact on contacting of the gears can be suppressed by making the number of teeth that are moving on the path of rotation of the gears whilst moving over the surface of 1 mm of the photosensitive body 2 as large as possible. This is because the impacts produced per tooth on contacting are diminished as the number of moving teeth becomes larger. Accordingly, the present inventors conducted tests to establish to what extent the number of moving teeth of the gears could be increased.

Figure 18:
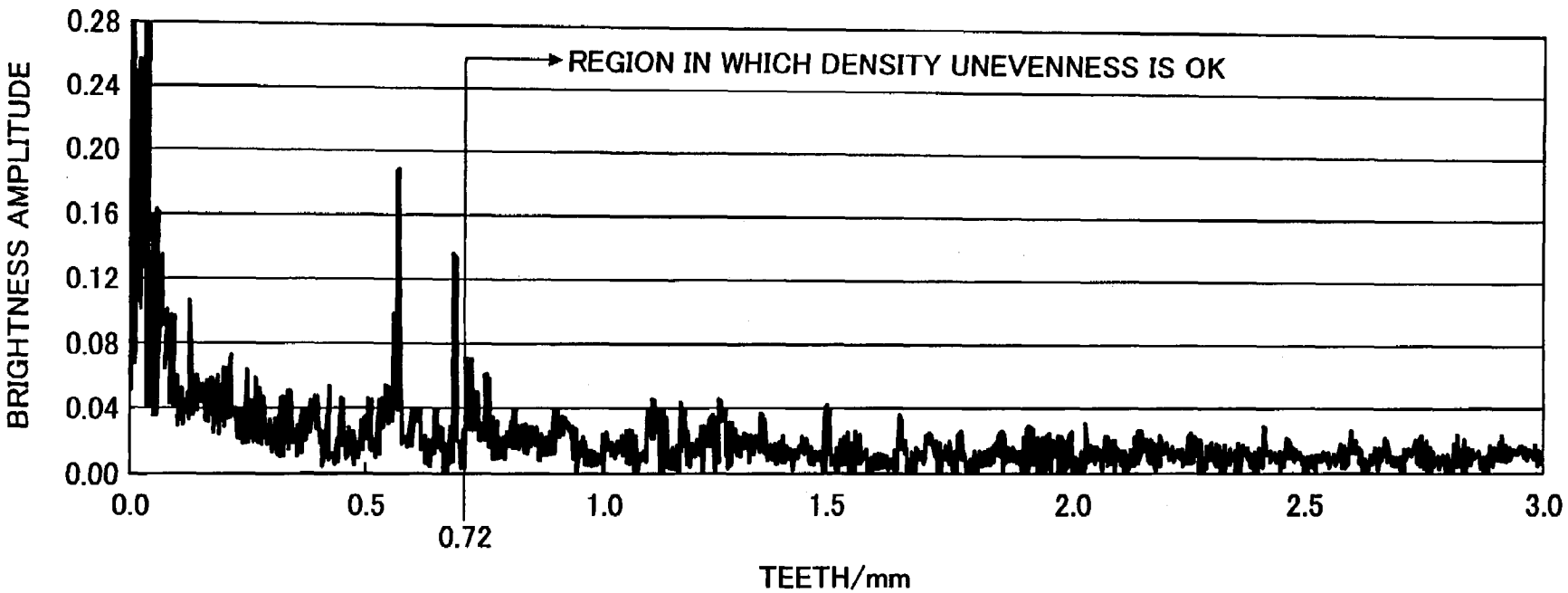
FIGS. 18 and 19 are graphs showing the relationship between brightness amplitude and image frequency.
Figure 19:
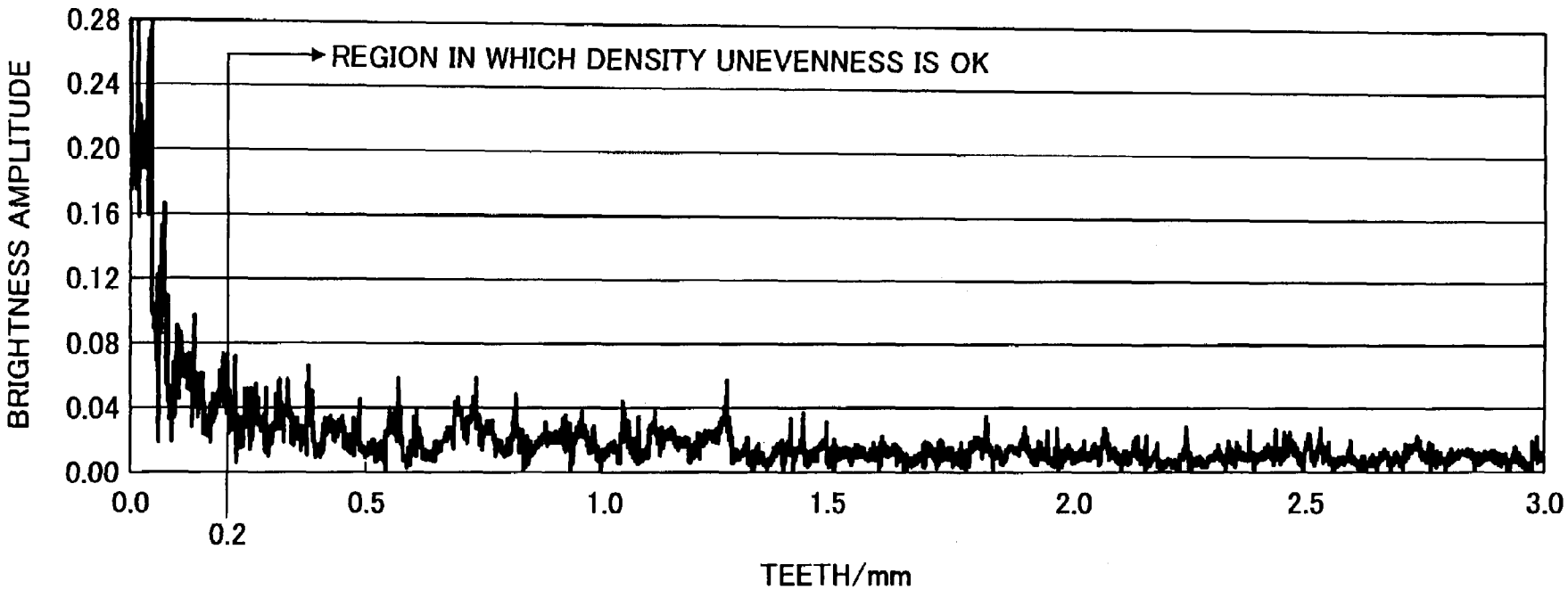

Specifically, first of all, a plurality of gears were prepared of modulus 0.8 or 0.6. For each gear, an image in the form of bands, called a banding chart, was then output with respective image frequencies, varying the image frequency i.e. the number of moving teeth of the gears during movement by 1 mm over the photosensitive body 2 in the range 0 to 3 teeth/mm. Next, these banding charts were converted to image data by reading these banding charts using a scanner and the brightness amplitude in the respective image data analyzed using image analysis software (Labview, manufactured by Solution Systems Inc) and the relationship between the brightness amplitude and the image frequency graphed. FIG. 18 shows the relationship between the brightness amplitude and image frequency in the case where gears of modulus 0.8 were employed. Also, FIG. 19 shows the relationship between brightness amplitude and image frequency in the case where gears of modulus 0.6 were employed. The brightness amplitude is an index indicating the degree of density unevenness: smaller values thereof indicate smaller density unevenness. In FIG. 18, it can be seen that, in order to keep the brightness amplitude at no more than 0.08, which is the allowed range of density unevenness, the image frequency must be set at at least about 0.70 teeth/mm. Taking into account errors of measurement and the like, in order to keep the density unevenness in the case of gears of modulus 0.8 reliably in the allowed range, it is considered necessary to set the image frequency to at least 0.72 teeth/mm. In contrast, in FIG. 19, it can be seen that keeping the frequency amplitude at no more than 0.08, which is the allowed range of density amplitude, requires that the image frequency is set to at least 0.20 teeth/mm. Accordingly, if the image frequency is set to at least 0.20, the density unevenness for teeth of modulus 0.6 can be kept within the allowed range.

Next, paper print-outs on which a plurality of banding charts were printed were respectively compared by the naked eye with samples representing various levels of density unevenness, in order to identify the density unevenness level sample corresponding to the respective density unevennesses that were obtained. This identification was conducted by one or two image evaluators. As a result of a this comparison, it was found that the density unevenness of the banding charts of the print-outs was of the same degree as the threshold value of allowed unevenness of the samples of density unevenness levels when the brightness amplitude was 0.08. Accordingly, the developing density unevenness can be kept within the allowed range if the brightness amplitude can be kept to no more than 0.08. For reference, the comparison results of density unevenness are shown in FIG. 20.

In an image forming apparatus according to the second embodiment, the number of moving teeth on the path of rotation of the first gear 52 or roller gear 51 when moving over 1 mm of the surface of the photosensitive body 2 is set to at least 0.72 in order to keep the developing density unevenness within the allowed range whether gears of modulus 0.6 or 0.8 are employed.

It should be noted that the image frequency can be found using the relationship "image frequency teeth/mm=1/image pitch=(linear speed ratio×number of teeth)/2πr" (where π is the ratio of the circumference of circle to its diameter and r is the radius of the developing sleeve 42). Also, the image pitch can be found using the relationship "image pitch mm=2πr/(linear speed ratio×number of teeth)".

The image frequency can be reduced by reducing the gear modulus, but if the modulus is made too small, durability of the gear tooth roots and gear surfaces is lowered, shortening the life of the gears. However, apart from the magnitude of the modulus, gear life is affected by the quality of the material used for the gears and the lower limit of the modulus is therefore set in accordance with this material quality. Also, as methods of increasing the image frequency, consideration may be given to increasing the linear speed ratio or increasing the number of gear teeth. In order to increase the linear speed ratio, either the process linear speed may be decreased, or the development linear speed may be increased; however, considering the increase in image formation speeds in recent years, it is more appropriate to increase the development linear speed. For example, if this speed is increased so as to make the linear speed ratio 3, there is an increase in flying off of toner and internal pressure in the unit which is undesirable from the point of view of life of the developer. In an image forming apparatus, the number of gear teeth may be increased by adopting a gear modulus of 0.6 or 0.8. By increasing the number of gear teeth, the meshing factor is also increased, and smooth transfer between adjacent gears can be performed. Also, by increasing the number of teeth, durability of the gear is improved.

Accordingly, in this image forming apparatus, the image frequency of the gears of the developing device 40 is set to at least 0.72 teeth. Accordingly, by suppressing the rotational speed fluctuation of the developing sleeve 42 produced by contact of the teeth of the gears, developing density unevenness can be kept to a level at which it is not visually apparent. It should be noted that, since the linear speed and pitch of the first gear 52 and roller gear 51 are the same, the image frequency of these gears is the same.

Also, as the developing system in this image forming apparatus, a DC bias development system may be employed. The DC bias power source does not employ an AC bias power source, and so, to that extent, is associated with lowered costs. Also, albeit development performance is lowered compared with a DC/AC bias development system, this lowering can be compensated for by the other development conditions and, since there is no fogging, high quality images can be obtained.

As the development system, the DC bias development system is adopted and the developing conditions described below are preferred. In particular, it is preferable that the linear speed ratio Vs/Vp of the linear speed Vp of the photosensitive body 2 and the linear speed Vs of the developing sleeve 42 should be 1.7 to 2.0. By making the linear speed Vs of the developing sleeve 42 faster, the frequency with which the spikes on the developing sleeve 42 contact the electrostatic latent image on the photosensitive body 2 is increased. In general, development performance can be improved as this frequency of contact is made higher. Consequently, in the DC bias development system, if the linear speed ratio Vs/Vp is less than 1.7, the developing performance is lowered and the rate of toner deposition cannot be raised, with the result that only images of low image density can be obtained. Also, in the case of a full-color image, reproducibility of intermediate colors is lowered, so image quality is adversely affected. On the other hand, if the linear speed ratio Vs/Vp exceeds 2.0, the scraping-off force becomes strong, with the result that traces of scraping-off appear on stripes in block images and halftone images, and loss of image density appears in trailing edge portions, lowering the image quality. Also, reproducibility of the image is adversely affected in that reproducibility of fine vertical lines and reproducibility of fine horizontal lines are different, vertical lines appearing thicker while horizontal lines are thinner.

Also, the developing gap Gp between the photosensitive body 2 and the developing sleeve 42 is made to be in the range 0.1 to 0.45 mm. Preferably the developing gap is in the range 0.25 to 0.40 mm. Although developing performance is improved as the developing gap is made narrower, it was found that developing performance tended to become substantially saturated at a given limiting distance. Furthermore, compared with the case where the developing gap Gp is made wider than this, the granularity of the developed toner image is considerably improved, making it possible to obtain images of high quality. However, if the developing gap Gp is narrowed in this way, even if misalignment of axes of the two engagement sections is eliminated, development density unevenness caused by minute fluctuations of the rotational speed of the developing sleeve 42 may become noticeable. Previously, where the developing gap was set larger than 0.45 mm, such developing density unevenness was not particularly noticeable, but, if the developing gap is set to 0.45 mm or less, such developing density unevenness does become noticeable. Furthermore, it is preferable to make the developing gap no more than 0.40 mm in order to avoid formation of abnormal images such as images with loss of image density and in order to obtain images of high quality with fine line reproducibility and with excellent reproducibility of intermediate colors of full-color images It should be noted that such development density unevenness is produced by contact of the teeth of the various gears that transmit drive to the developing sleeve 42. However, with an image forming apparatus according to this embodiment, by improving contact of the teeth of the gears, even if the developing gap Gp is reduced, vibration is reduced and density unevenness of development is therefore also reduced. However, if the developing gap Gp is less than 0.1 mm, there is a risk of the toner adhering to the photosensitive body 2. Also, since the surfaces of the developer carrier and the photosensitive body 2 are not necessarily smooth, it is difficult to maintain the prescribed development performance. Furthermore, in order to obtain a stable image forming apparatus, taking into account manufacturing precision of practical machinery and equipment and stability of manufacture, a gap of at least 0.25 mm is preferred.

Figure 21:
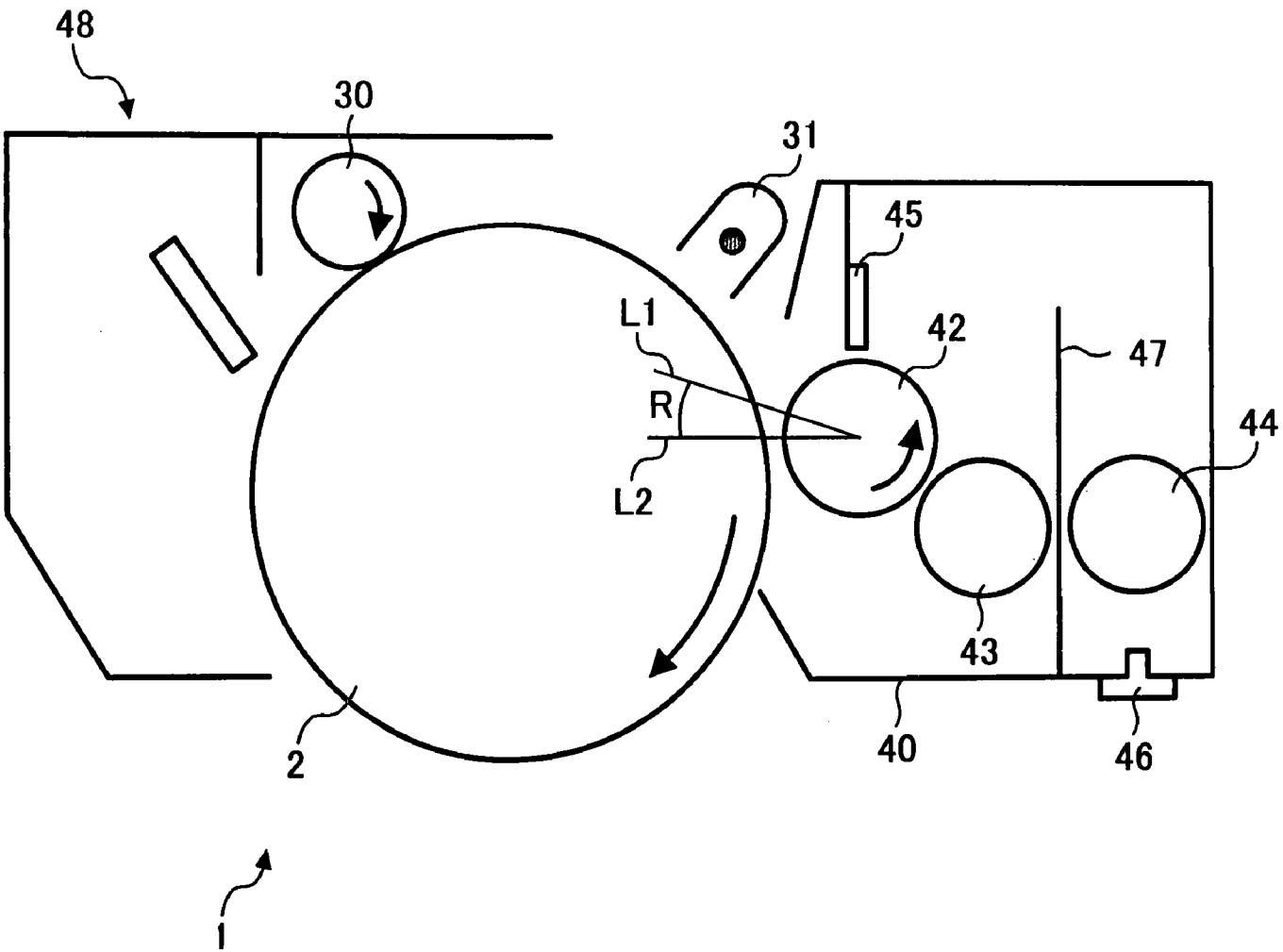
FIG. 21 is a view showing the internal layout of a developing device thereof.

FIG. 21 shows the internal construction of a developing device 40. Respective developing devices 40Y, 40M, 40C and 40K have the same construction apart from different color toners, so the construction will be described in detail starting from the internal structure, referring to a single development device 40.

The angle R formed by the line L1 joining the center of the half value width of the magnetic field of the main magnetic pole and the center of rotation of the developer carrier and the line L2 joining the center of the image carrier and the center of rotation of the developer carrier is set in the range of 2° to 8.5°. As shown in FIG. 21, the developing device 40 comprises a developing sleeve 42. The developing sleeve 42 includes a magnet roller 42*b* that is fixed and arranged within the rotating developing sleeve 42, which is made of aluminum of diameter 18 mm. In order to improve the developer feed performance, the surface of the developing sleeve 42 may be provided with grooves or may be roughened by for example sand-blast processing.

Figure 22:
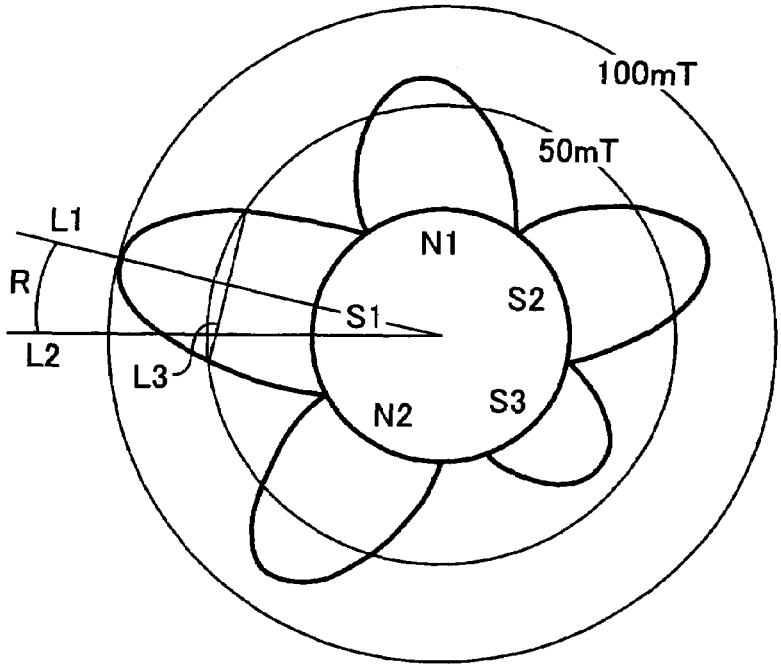
FIG. 22 is a view showing the waveform of the magnetic flux density distribution of a magnet roller thereof.

FIG. 22 is a view showing the waveform of the flux density distribution of the magnet roller. It should be noted that the magnetic pole arrangement in FIG. 22 is a constructional example and the number and arrangement of the magnetic poles other than the main developing magnetic pole are not restricted to this. As shown in the Figure, the magnet roller 42*b* comprises magnetic poles S1, N1, S2, S3, N2 in the direction of rotation of the developing sleeve 42, from the location of the developing region, which is in a region facing the photosensitive body 2. Of these, the main developing magnetic pole S1, that is arranged such that the center line L1 of the half value width L3 of this magnetic pole is in a position on the upstream side in the direction of rotation from the line L2 joining the respective centers of the developing roller 42 and the photosensitive body 2 exhibits the strongest magnetic force of the five magnetic poles. It therefore performs the role of forming a magnetic brush by causing sprouting out of spikes of the two-component developer on the developing sleeve 42 in the developing region. The tips of the magnetic brush formed on the developing sleeve 42 by the magnetic force of this main developing magnetic pole S1 pass through the developing region while making sliding contact with the photosensitive body 2.

The movement of developer in a developing device 40 constructed in this way will now be described.

The toner and carrier are frictionally charged up by stirring while the two-component developer in the developing container is fed in circulatory fashion by the first developer feed screw 43 and the second developer feed screw 44. The first developer feed screw 43 then supplies some of the developer to the developing sleeve 42 and the developing sleeve 42 magnetically carries and feeds this developer, by means of the magnetic pole N2. The developer on the developing sleeve 42 is formed in a condition contacting the photosensitive body 2, with its layer thickness (amount carried) regulated by the developer regulating member 45. The magnetic pole N2 is a pole that combines the action of picking up developer with an action of regulating the layer thickness thereof. Toner frictional charging is promoted in the two-component developer whilst it is attracted onto the surface of the developing sleeve 42 by this magnetic pole N2 and regulated in layer thickness. Developing bias is applied to the developing sleeve 42 by a power source, not shown.

The developer that is fed into the developing region is caused to stand up in the form of spikes on the developing sleeve 42 by the magnetic force of the main developing magnetic pole S1; thus toner is supplied to the electrostatic latent image on the photosensitive body 2 in a condition in which the tips of these spikes make sliding contact with the photosensitive body 2 during passage through the developing region. The developer, after being passed through the developing region with the rotation of the developing sleeve 42, moves, restricted to the developing sleeve 42 by the magnetic force of the magnetic pole N1, but with the previously projecting spikes flattened by the diminution of magnetic force. The developer is then separated from the surface of the developing sleeve 42 in a region between the magnetic pole S3 and magnetic pole N2 where the magnetic field in the normal direction is restricted and is returned into the developing container. The developer that has thus returned to the developing container is again fed by the first feed screw 43 and is again fed by the second feed screw 44 through the partition. When the T sensor 46 detects that the toner density of the developer in the developing container has dropped to no more than a prescribed density, toner is supplied through the toner supply port and mixed with the developer by stirring performed by the second feed screw 44. The above cycle is then repeated by again carrying on the developing sleeve 42 the developer that has thus been adjusted to the prescribed density and reducing its layer thickness by passage through the developer regulating member 45.

Also, the developer employed in the image forming apparatus according to the second embodiment is a two-component developer. The following are employed as magnetic carriers mixed with a two-component developer. In this case, the content ratios of carrier and toner in the developer are preferably 1 to 10 weight parts of toner with respect to 100 weight parts of carrier. The volume average particle diameter of the magnetic carrier is 30 to 80 μm and its electrical resistance is in the range 6 to 10 Log (Ω·cm).

Also, preferably magnetic carrier of volume average particle diameter 30 to 80 μm is employed. By making the volume average particle size 80 μm or less, the thickness of the developer spikes (carrier chains) during image creation can be made uniformly small and finer toner transfer can be achieved. Also, since the density of the developer spikes per unit area on the developing sleeve is increased, it becomes possible to transfer toner to the latent image on the photosensitive body 2 without a gap. In this way, an image of superior dot reproducibility can be formed. It should be noted that if the weight average particle size exceeds 80 μm, when a comparison is made using the same amount of carrier, the total surface area of the magnetic carrier becomes smaller i.e. the amount of toner retained is decreased. Also, image contamination due to flying off of toner tends to occur if the speed of rotation of the developing sleeve 42 is raised in order to prevent loss of toner density being caused thereby. On the other hand, if the volume average particle size is less than 30 μm, the magnetic holding force produced by the magnet roller that is fixed within the developing sleeve 42 is reduced, allowing the carrier to fly off more easily. Accordingly, in the image forming apparatus, it is specified to the user to employ magnetic carrier of volume average particle size 30 to 80 μm in accordance with the method of specification to be described.

Also, the electrical resistance of this magnetic carrier is specified to be in the range 6 to 10 Log (Ω·cm). This is influenced by the magnetic field that is applied to the carrier itself in the developing region by the electrical resistance. If the electrical resistance is less than 6 Log, it is not possible to achieve a large electrical field in the developing region and the developing performance is consequently poor; if the electrical resistance is more than 10 Log, the electrical field in the developing region becomes large, resulting in high developing performance, but fogging or loss of image density is displayed and furthermore the amount of carrier deposition becomes considerable. Consequently, in view of developing performance, fogging and loss of image density, a range of 6 to 10 Log (Ω·cm) is specified.

Specifically, a resin covering of for example Cu—Zn ferrite, Mn—Zn ferrite, $Fe_2O_3$ hematite or $Fe_3O_4$ magnetite is applied to the particle surface. Also, a resin-dispersed carrier obtained by dispersing these in resin may be employed.

The specific gravity of ferrite based carrier is substantially about 5, and the specific gravity can be increased by increasing the amount of Fe and reducing the amount of oxygen O. However, if a metal based magnetic body is employed whose specific gravity exceeds 5.5, the stress on the toner during transportation and mixing becomes large and electrical chargeability of the carrier is adversely affected i.e. the carrier tends to become spent. Also, if the specific gravity is less than 2.6, miscibility with the toner is adversely affected, resulting for example in an increase of inversely charged toner.

Examples of carrier covering material that may be mentioned include amino-based resins, such as for example urea-formaldehyde resins, melamine resins, benzoguanamine resins, urea resins, polyamide resins, and epoxy resins. It is also possible to use for example polyvinyl and polyvinylidene-based resins such as for example acrylic resins, polymethyl methacrylate resins, polyacrylonitrile resins, polyvinyl acetate resins, polyvinyl alcohol resins, polyvinyl butyral resins, polystyrene based resins such as polystyrene resins and styrene-acrylic copolymer resins, halogenated olefin resins such as polyvinyl chloride, polyester based resins such as polyethylene terephthalate resins and polybutylene terephthalate resins, polycarbonate based resins, polyethylene resins, polyvinyl fluoride resins, polyvinylidene fluoride resins, polytrifluoroethylene resins, polyhexafluoropropylene resins, copolymers of vinylidene fluoride and acrylic monomer, copolymers of vinylidene fluoride and vinyl fluoride, fluoro terpolymers such as for example of tetrafluoroethylene, vinylidene fluoride and non-fluoride monomer terpolymers, and silicone resins. Also, if required, electrically conductive powder or the like may be included in the covering resin. Examples of electrically conductive powder that may be employed include metal powder, carbon black, titanium oxide, tin oxide or zinc oxide. Preferably the average particle size of these conductive powders is no more than 1 μm. If the average particle size is larger than 1 μm, it is difficult to control the electrical resistance.

In particular, it is preferable to cover the surface of a core particle with a surface layer containing a thermoplastic resin, a melamine resin and a charge adjusting agent. This is a surface layer containing a charging adjustment agent in a resin component that provides cross linkage of a thermoplastic resin such as acrylic with a melamine resin. Whereas conventionally a magnetic carrier was constituted so as to obtain a long life while the hard coating film was gradually abraded, in the case of the present magnetic carrier, abrasion of the film is suppressed by absorbing impacts by the provision of a coating film having resilience. A longer life can thereby be obtained than with a conventional carrier. In this way, stabilization of the amount of toner picked up i.e. stabilization of quality can be expected over a long period. Accordingly, in this image forming apparatus, it is specified to the user to employ such magnetic carrier in accordance with the method of specification to be described.

Figure 23:
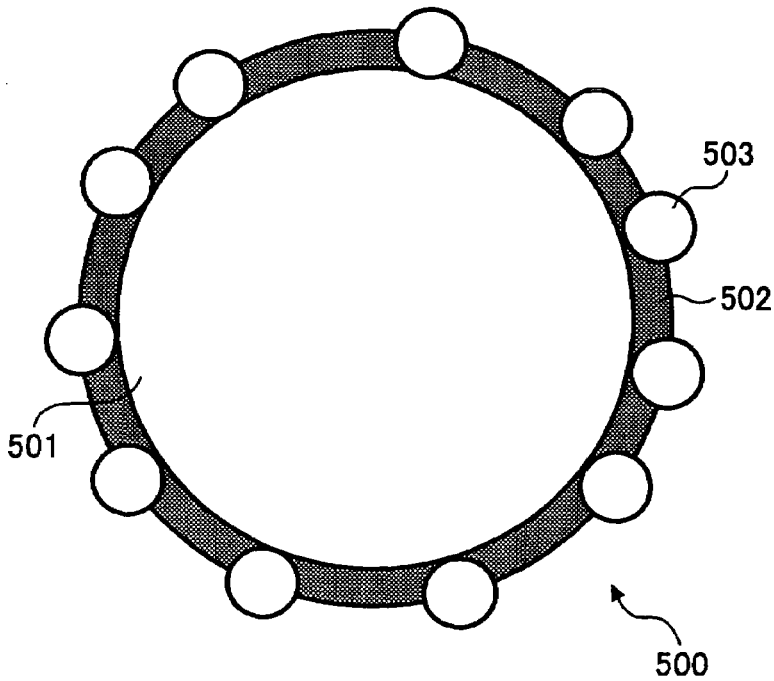
FIG. 23 is a diagram to a larger scale showing the construction of a magnetic carrier thereof.

FIG. 23 shows magnetic carrier to a larger scale. In this Figure, magnetic material constituted by ferrite 501 is employed as the core of the magnetic carrier 500. The surface of this ferrite 501 is covered with a surface layer 502 containing a charging adjusting agent in a resin component that provides cross linkage of thermoplastic resin such as acrylic with melamine resin. Such a surface layer 502 also serves to provide resilience and strong adhesive force. Particles of larger size than the film thickness such as for example alumina particles 503 are dispersed in the surface layer 502. Whereas the conventional magnetic carrier was constituted based on the concept of obtaining long life during gradual abrasion of a hard surface layer, with the magnetic carrier illustrated, impacts are absorbed by the resilience that is manifested by the surface layer 502. In this way, film abrasion of the photosensitive body 2 can be suppressed. Also, by dispersing alumina particles 500 of larger size than the film thickness in the surface layer 502, the surface scraping effect on adjacent carrier particles is increased, thereby making it possible to suppress adhesion of toner to the magnetic carrier. In this way, film abrasion and toner adhesion to the surface of the surface layer 502 are suppressed, thereby making it possible to achieve longer life.

The volume average particle size can be measured as follows. Specifically, with a measurement device using the Coulter counter method, measurement can be conducted using for example a Coulter counter-TA-11 or Coulter multisizer 11 (both of these are made by Coulter Inc). Specifically, first of all, 0.1 to 5 ml of surfactant (preferably an alkyl benzene sulfonate) as a dispersion agent is added to 100 to 150 ml of aqueous electrolyte solution. As the aqueous electrolyte solution, an approximately 1% NaCl aqueous solution may be prepared using Grade 1 sodium chloride, using for example ISOTON-11 (manufactured by Coulter Inc). In addition, 2 to 20 mg of the measurement sample are added to the solution obtained. This solution is then subjected to dispersion treatment for about 1 to 3 minutes using an ultrasonic disperser and the volume distribution and number distribution are calculated by measuring the volume and number of particles (toner and/or magnetic carrier) by means of a measurement device as described above, using a 100 μm aperture as the aperture. The volume average particle size Dm and number average particle size Dn can be found from the distributions obtained. 13 channels are employed, namely: 2.00 to less than 2.52 μm; 2.52 to less than 3.17 μm; 3.17 to less than 4.00 μm; 4.00 to less than 5.04 μm; 5.04 to less than 6.35 μm; 6.35 to less than 8.00 μm; 8.00 to less than 10.08 μm; 10.08 to less than 12.70 μm; 12.70 to less than 16.00 μm; 16.00 to less than 20.20 μm; 20.20 to less than 25.40 μm; 25.40 to less than 32.00 μm; and 32.00 to less than 40.30 μm. In the case of both Dm and Dn the average of 10,000 particles was employed.

It should be noted that the toner employed in the image forming apparatus according to the second embodiment is the same as in the case of the first embodiment of the present invention described above. That is, the constituent materials and method of manufacture of the toner described in the first embodiment can be employed without modification in the present embodiment, so explanation of these details is not repeated.

Next, various modifications of the image forming apparatus according to the second embodiment will be described.

(First Modification)

Figure 24:
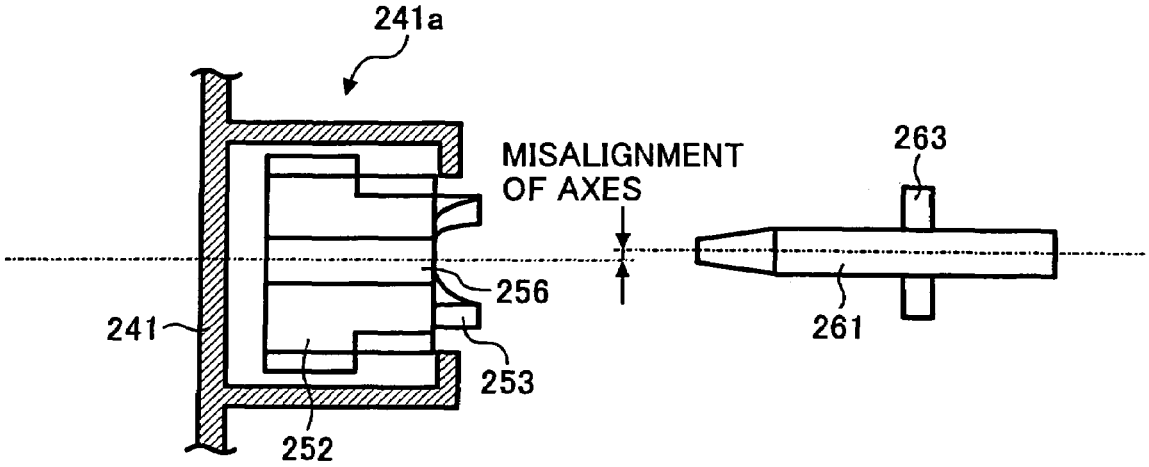
FIG. 24 is a view showing the construction of a driven rotary member and a drive rotary member according to a first modification of the second embodiment.
Figure 25:
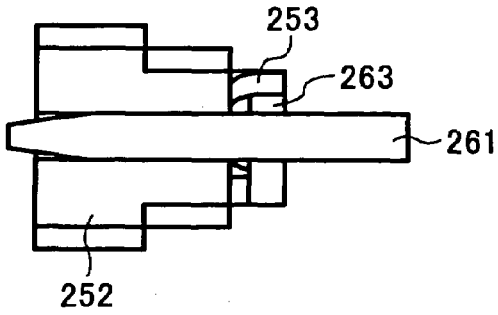
FIGS. 25 and 26 are views showing the drive output shaft and driven rotary member prior to engagement in this first modification, and a side plate of the developing device.

In this first modification, except where otherwise noted below, the construction is the same as in the image forming apparatus according to the present embodiment. FIGS. 24 and 25 show a driven side rotary member and drive side rotary member in this first modification. As shown in these Figures, a holding section 241*a* for holding the driven side rotary member in moveable fashion is formed in the planar direction orthogonal to the direction of the axis thereof on the inside face of the casing 241 of the developing device 40. This holding section 241 is of a cylindrical shape with its end on the aperture side thereof projecting towards a circular aperture. A driven side rotary member is accommodated within this cylindrical shaped holding section 241. By making the diameter of the cylindrical space of the holding section 241 larger than the diameter of the driven side rotary member, the driven side rotary member has play within the holding section 241 in the planar direction orthogonal to the direction of the rotary axis thereof.

In the image forming apparatus of the second embodiment, an assembly was provided in which play of the driven side rotary member was achieved in the direction orthogonal to the direction of the rotary axis thereof by inserting, in a through-hole provided in the central section of the driven side rotary member, a holding shaft of smaller diameter than this through-hole. In contrast, in the first modification, such a holding shaft is not provided. Instead of this, a through-hole 256 for insertion of and engagement with a drive output shaft 261 of the drive side rotary member 60 is provided in the central section of the driven side rotary member. In order to achieve smooth engagement with the through-hole 256 of the driven side rotary member, this drive output shaft 261 is provided with a taper as shown in FIG. 24 at the tip at the engaging end thereof, being tapered from the root end of the drive output shaft 261 towards the tip thereof. Also, in this first modification, instead of the claws on the drive side rotary member 60 of the image forming apparatus according to the second embodiment, there are provided pins 263 that are fixed by passing through the drive output shaft 261.

When the developing device 40 is mounted in the image forming apparatus, as shown in FIG. 24, the through-hole 256 of the driven side rotary member and the tip of the drive output shaft 261 of the drive side rotary member 60 are engaged. Also, in addition, the two engagement sections are linked by engagement of the two claws 253 of the driven side rotary member with the pins 263 that are fixed passing through the drive output shaft 261. An axial coupling is constituted by the construction of the end of the first gear 252 of the driven side rotary member and the drive output shaft 261 of the drive side rotary member 60. By means of this coupling, the rotary drive force of the drive output shaft 261 is linked with the first gear 252. Also, the rotary drive force of a roller gear, not shown, that meshes with the first gear 252 is transmitted to the developing sleeve 42 causing it to rotate.

Figure 26:
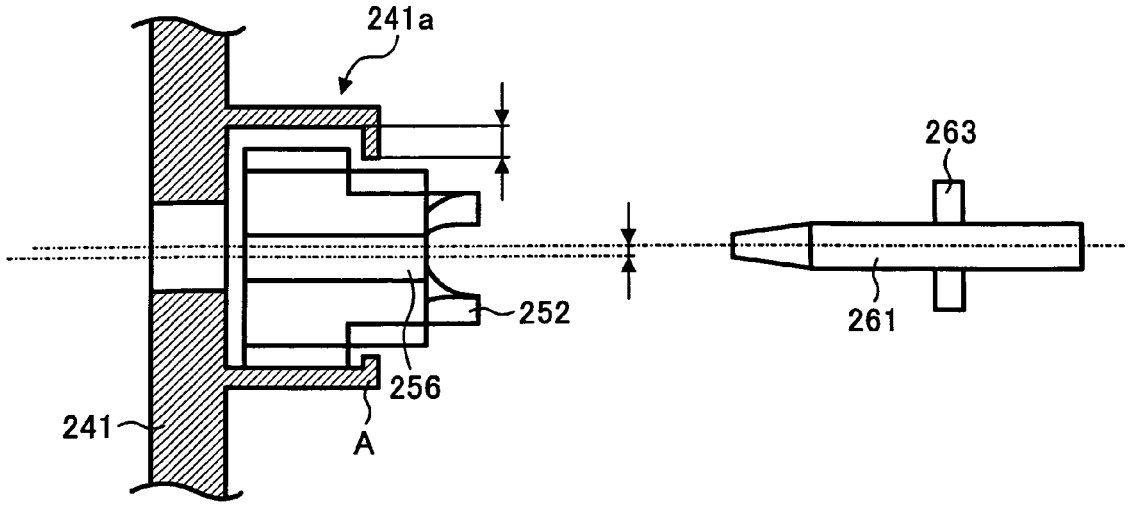
Figure 27:
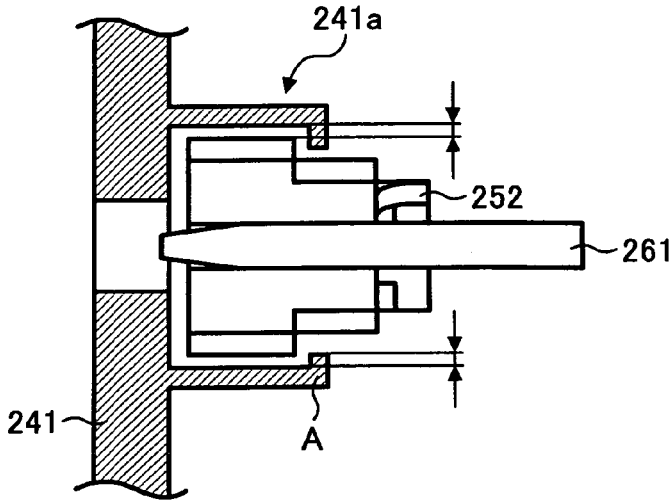
FIG. 27 is a view showing the drive output shaft and driven rotary member after engagement, and a side plate of the developing device thereof.
Figure 28:
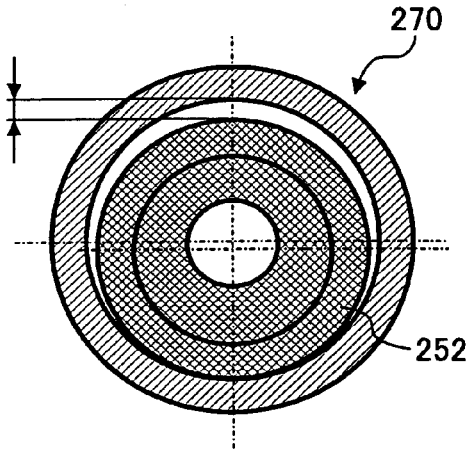
FIG. 28 is a cross-sectional view showing a side plate holding member and driven rotary member thereof.

FIG. 26 shows the drive output shaft and the driven side rotary member, prior to engagement, together with a side plate of the developing device 40, in this first modification. Also, FIG. 27 shows the drive output shaft and the driven side rotary member, after engagement, together with the side plate of the developing device 40. Also, FIG. 28 shows a cross section of the holding section of the side plate and the driven side rotary member. Fine positional correction of the driven side rotary member is effected by fixing by engagement with the drive output shaft 261.

In this first modification, a holding section 241*a* as described above is formed on the inside face 241 of the developing device 40, projecting from the side face thereof. This holding section 241*a* has a cylindrical structure, having a cylindrical space in its interior. The diameter of this cylindrical space is larger than the diameter of the rotating circumference of the driven side rotary member. The driven side rotary member is held within the cylindrical space of the holding member 241*a* and engages with the drive output shaft 261 of the drive side rotary member 60 that is inserted in a through-hole 256 formed in the direction of rotation thereof. A projection A that projects towards the interior of the cylinder in the form of a ring is provided at the end in the direction of the cylinder axis of the holding section 241*a*. The internal diameter of this projection A is smaller than the internal diameter of the circumference of the driven side rotary member and has the role of ensuring that the driven side rotary member within the cylindrical space does not fall off from within the cylindrical space. Even though the driven side rotary member has play in the direction of the cylinder axis within the cylindrical space of the holding section 241*a*, the assembly is such that it is prevented from falling off from within the cylindrical space by abutment with the projection A of the holding section 241*a*.

As shown in FIG. 28, the engagement gear 252 of this driven side rotary member is held so as to be capable of movement at least in the plane orthogonal to the direction of the rotary axis, due to the gap between this outer circumferential surface of rotation and the cylindrical space. Also positional correction is performed by movement of the drive output shaft 261 towards the rotary axis, on engagement with the drive output shaft 261. Thanks to this construction, minute misalignment of axes generated between the driven side rotary member and drive side rotary member 60 due to problems such as component or design accuracy can be absorbed by movement of the driven side rotary member. Also, the first gear 252 on the side of the developing device 40 can always be rotated by means of the center of rotation of the drive output shaft 261.

The diameter of the cylindrical space of the holding section 241*a* is made 0.5 to 1.0 mm larger than the diameter of the circumference of rotation of the driven side rotary member. In this way, play of the driven side rotary member accompanying engagement with the drive output shaft 261 is made possible in the direction orthogonal to the direction of the rotary axis thereof by the formation of a gap between the inside wall of the cylindrical space of the holding section 241*a* and the driven side rotary member that is held therein.

The driven side rotary members shown in FIGS. 26 to 28 are of cylindrical shape constituted as an aperture of the through-hole 256 and whose diameter does not change from the inlet side to the outlet side of the shaft. Instead of such an aperture, a configuration thereof may be adopted in which a taper is provided on the inlet side that becomes smaller in diameter towards the outlet side. With such an aperture, even if the center of the through-hole 256 of the driven side rotary member and the center of the drive output shaft 261 are considerably misaligned prior to engagement, the drive output shaft 261 can advance smoothly into the through-hole 256 by engagement of the tip of the drive output shaft 261 with the wide inlet of the through-hole 256.

(Second Modification)

In this second modification, except where otherwise noted below, the construction is the same as in the image forming apparatus according to the second embodiment. In this second modification, the image forming sections 1Y, M, C, K respectively comprise process units 301Y, M, C, K that are integrally removably mountable with respect to the image forming apparatus main body. These process units 301Y, M, C, K are replaced when they reach the end of their life.

Figure 29:
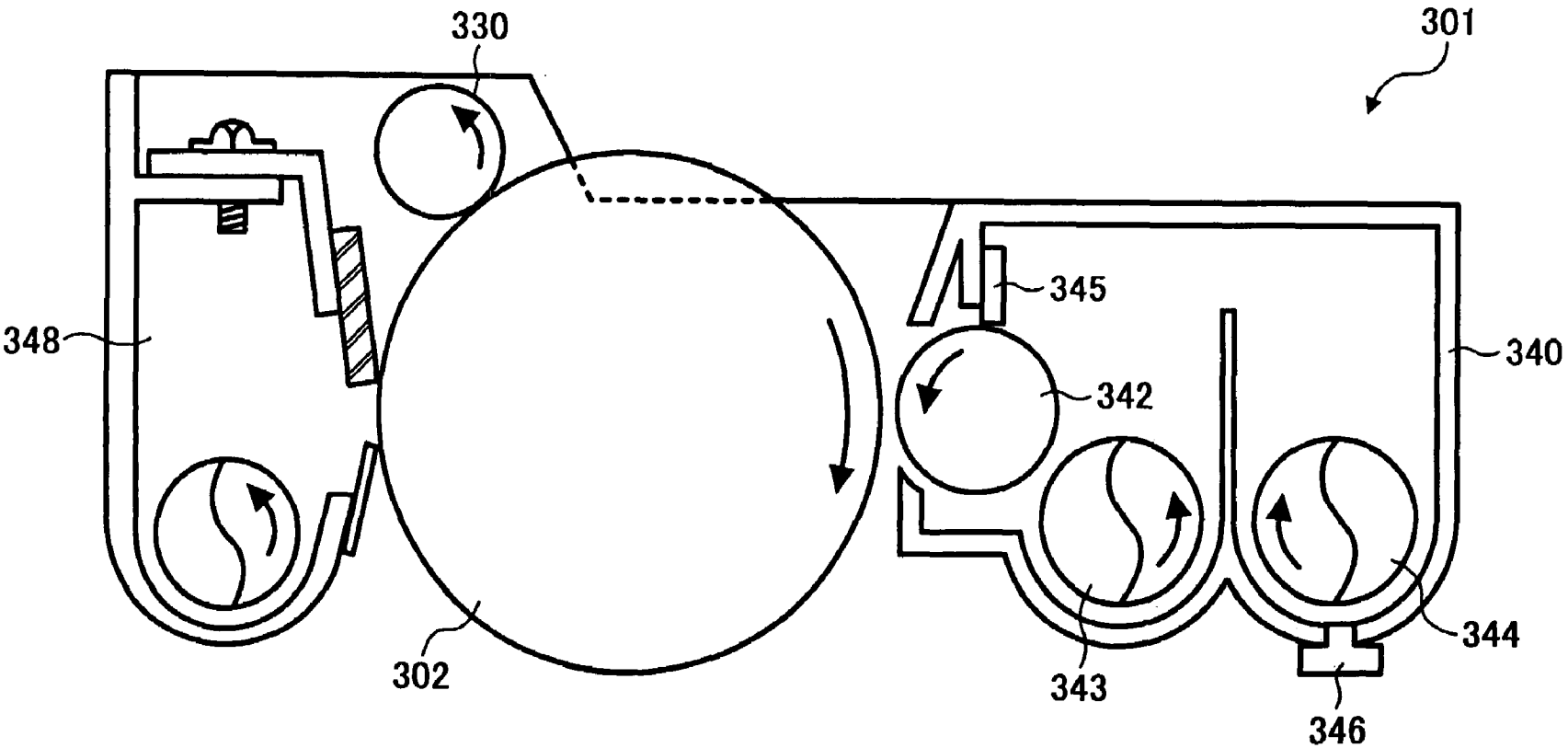
FIG. 29 is a view showing the construction of a second modification of a process unit according to the second embodiment.

FIG. 29 shows a process unit according to this second modification. As shown in this Figure, the process unit 301 comprises for example a development device 340, a charging device 330 and drum cleaning device 348 arranged around a drum-shaped photosensitive body 302. These are supported by a casing constituting a common support body and are integrally removably mountable as a single unit with respect to the image forming apparatus main body.

Figure 30:
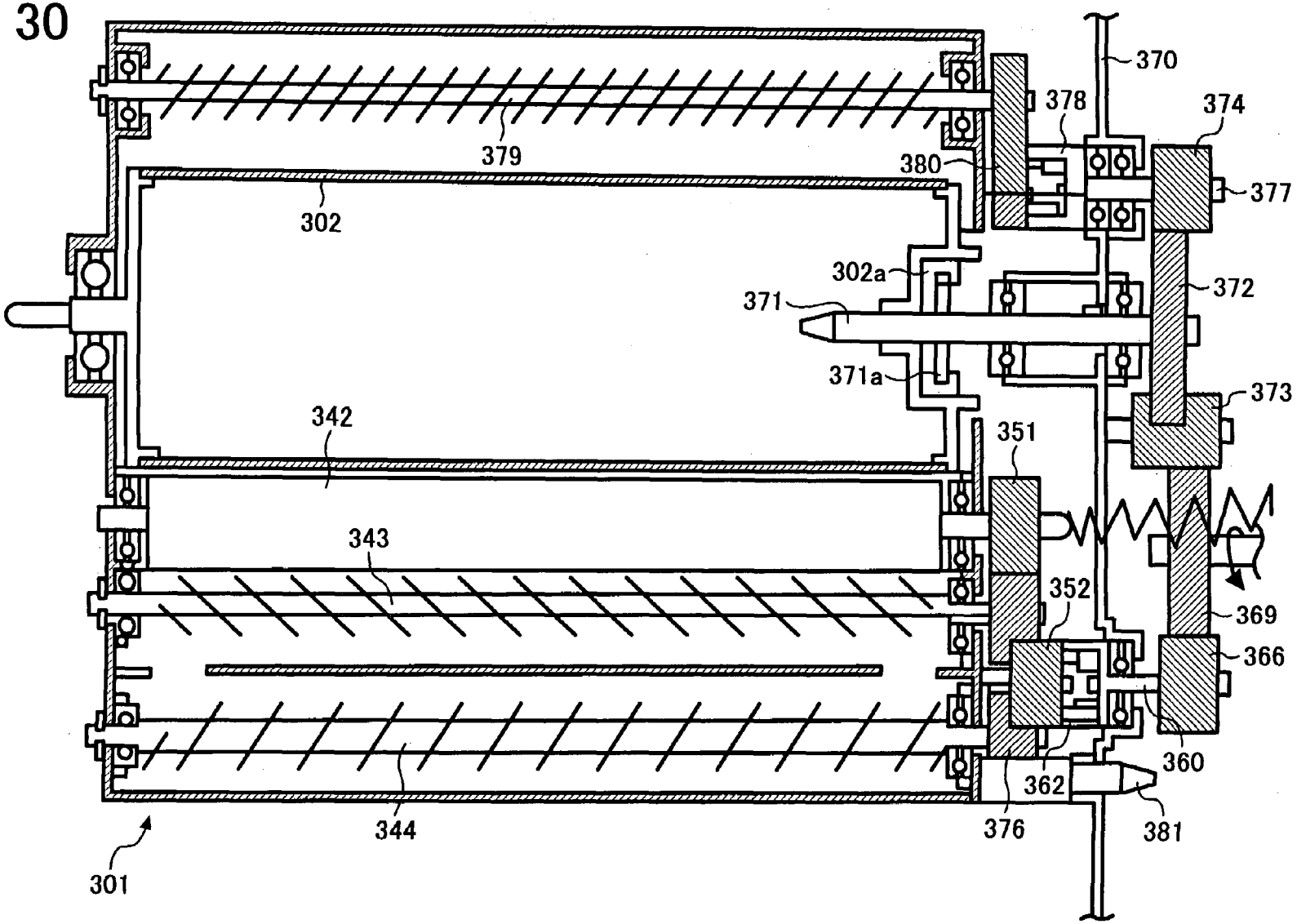
FIG. 30 is a cross-sectional view showing a process unit and side plate of an image forming apparatus main body thereof.

FIG. 30 shows a cross section of the process unit and a side plate of the image forming apparatus main body. At the center of the drum of the photosensitive body 302 of the process unit 301, there is provided a shaft hole for insertion of a drum drive shaft 371 that is freely rotatably supported on the image forming apparatus main body side plate 370. This drum drive shaft 371 comprises pins 371*a* that project from the circumference of rotation thereof at a location on the side of the base of the photosensitive body 302 before insertion of this shaft into the shaft hole of the photosensitive body 302 and that effect rotation of this photosensitive body 302 by engaging projections 302*a* of the photosensitive body 302, thereby transmitting rotary drive force to the photosensitive body 302.

A drum drive gear 372 is fixed at the rear end of the drum drive shaft 371 and a relay gear 373 and/or second drive output gear 374 mesh therewith. Apart from the drum drive gear 372, a drive gear 369 meshes with the relay gear 373 and, in addition, this drive gear 369 meshes with a first drive output gear 366.

The drive gear 369 is the gear that is most upstream that is driven in rotation by the motor, not shown, and this drive gear 369 transmits rotary drive force to the various gears. The drive side rotary member 60 is arranged in rotatable manner on the right-hand side of this drive gear 369 in the Figure and brings this first drive output gear 366 into mesh with the drive gear 369. The drive output gear 366 is fixed to the rear-end of the first drive output shaft and a drive side engagement section 362 is fixed at the tip of this drive output shaft 360.

The drive side engagement section 362 serves to deliver rotary drive force to two screws 343, 344 and/or the developing sleeve 342 of the development device 340. The development device 340 comprises a driven side rotary member that engages with the drive side engagement section 362 of the drive side rotary member. The drive side rotary member and the driven side rotary member have respectively the same construction as the drive side rotary member and driven side rotary member of the image forming apparatus according to the embodiment. The construction is such that misalignment of the axes of these two is eliminated by positional correction that takes place accompanying engagement of the driven side rotary member with the drive side rotary member.

A first screw gear 375 and a second screw gear 376 mesh with a first gear 352 of the driven side rotary member. The first screw gear 375 and second screw gear 376 are fixed to the ends of the first feed screw 343 and second feed screw 344. The first feed screw 343 and second feed screw 344 are rotated by transmission of rotary drive force from the drive side rotary member through the first gear 352 to the first screw gear 375 and second screw gear 376. In addition, the developing screw 342 is rotated by meshing of the roller gear 351 with the first screw gear 375, which causes transmission of drive force thereto.

The rotary drive force of the most upstream drive gear 369 is sequentially transmitted to the intermediate gear 373, drum drive gear 372 and the second drive output gear 374 of the second drive side rotary member. The second drive output gear 374 is fixed to the rear end of the second drive output shaft 377 and the drive side rotary engagement section 378 is fixed to the tip of the second drive output shaft 377.

The second engagement section 378 of the second drive side rotary member is provided in order to deliver rotary drive force to the recovery screw 378 of the drum cleaning device 348. The developing device 340 also comprises a second driven side rotary member that engages with the second engagement section 378 and a third gear 380 is formed thereon. The second drive side rotary member and second driven side rotary member are respectively constructed in the same way as the drive side rotary member and driven side rotary member of the image forming apparatus according to the embodiment. The construction is such that misalignment of the axes of these two is eliminated by positional correction that takes place accompanying engagement of the second driven side rotary member with the second drive side rotary member.

In an image forming apparatus constructed as above, apart from fluctuation of rotational speed of the developing sleeve 342 caused by misalignment of axes of the first drive side rotary member and the first driven side rotary member, the following speed fluctuations can also be eliminated. Specifically, fluctuation of speed of rotation of the first feed screw 343 and/or second feed screw 344 takes place caused by this misalignment of axes. But in addition, the fluctuation of rotational speed of the recovery screw 379 caused by misalignment of axes of the second drive side rotary member and second driven side rotary member can also be eliminated.

(Third Modification)

Figure 31:
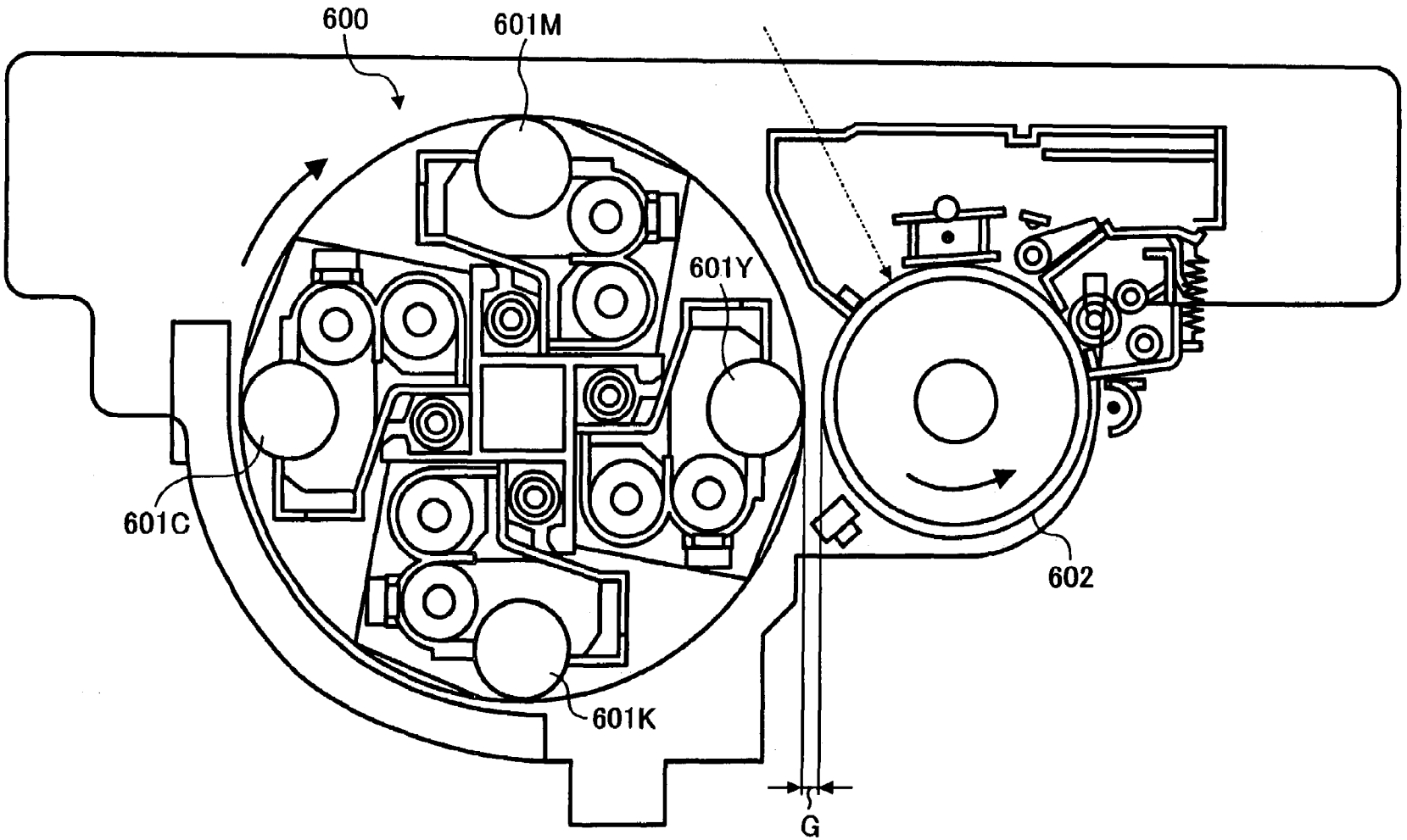
FIG. 31 is a view showing a photosensitive body and a revolver developing unit according to a third modification of the second embodiment.

FIG. 31 shows a photosensitive body and revolver developing unit according to this third modification. In the revolver developing unit 600 that is arranged on the left-hand side in the Figure of the photosensitive body 602, the four developing devices 600, M, C, K for Y, M, C and K are supported on a supporting body that rotates clockwise in the drawing about a rotary shaft. These developing devices 600 Y, M, C and K revolve about the rotary shaft by rotation of the support body in the clockwise direction in the Figure about the rotary shaft. A developing device 600M, C, K, Y is set in the developing position facing the photosensitive body 602 every time rotation takes place through 90°, 180°, 270° or 360°. Electrostatic latent images for Y, M, C and K are thereby successively formed on the photosensitive body 602 and these are successively developed as Y, M, C and K toner images by the developing devices 600 Y, M, C, K. The Y, M, C, and K toner images that are thus developed are transferred successively superimposed onto an intermediate transfer belt, not shown. The four-color toner image that is formed on the intermediate transfer belt by this superimposed transfer process is transferred as a whole to the transfer paper P in a region not shown.

When the four developing devices 600Y, M, C and K are respectively moved into the developing position, a drive receiving gear, not shown, is brought into mesh with the drive output gear that is freely rotatably fixed to the image forming apparatus main body. In this way, drive transmission to the developing sleeve and a stirring member is performed. The drive receiving gear of the developing devices 600Y, M, C, K is arranged such that the shaft to which this is fixed supplies the developing sleeve. In the third modification, the image frequency of the drive receiving gear is set to at least 0.72 teeth. Consequently, developing density unevenness can be kept to a level that cannot be observed visually, by suppressing fluctuation of speed of rotation of the developing sleeve caused by contact of the teeth of the drive output gear and the drive receiving gear.

(Fourth Modification)

Figure 32:
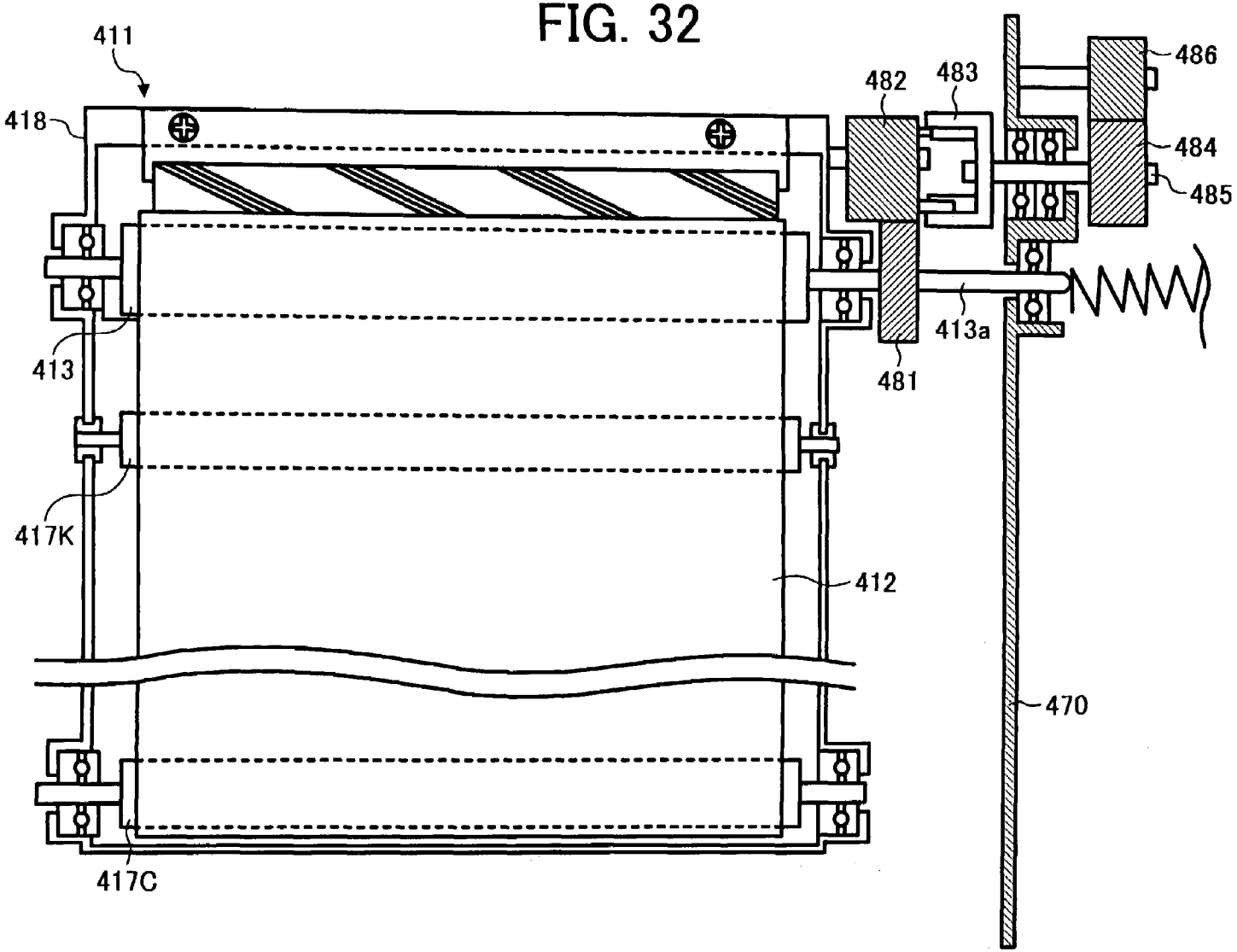
FIG. 32 is a cross-sectional view showing a transfer device and an image forming apparatus main body side plate according to a fourth modification of the second embodiment.

FIG. 32 shows a transfer device and a side plate of an image forming apparatus main body according to this fourth modification. This transfer device 411 is constructed so as to be removably mountable with respect to the image forming apparatus main body and is freely rotatably supported by a support body 418 that supports the various rollers. A drive roller 413 that tensions a paper feed belt 412 together with two tensioning rollers, not shown, while being freely rotatably supported on the support body 418 causes a paper feed belt 412 constituting a surface movement element to move in endless fashion by being driven in rotation by means of a drive transmission system, to be described.

One end of a shaft member 413*a* of the drive roller 413 projects considerably from the support body 418 and a drive roller gear 481 is fixed in this projecting section. Also, the tip of this projecting section is inserted into a position-locating bearing provided on the side plate 470 of the image forming apparatus main body. In this way, the transfer device 411 is located in position with respect to the image forming apparatus main body and hence the photosensitive bodies, with reference to the drive roller 413.

The drive roller gear 481 meshes with a transfer engagement gear 482 constituting a driven side rotary engagement section, that is supported by the supporting body 418. This transfer engagement gear 482 then fits into a drive side transfer rotary engagement section 483 that projects from a side plate 470 of the image forming apparatus main body. This transfer rotary engagement section 483 and transfer engagement gear 482 are respectively constructed in the same way as the drive side rotary member 62 and driven side rotary members 52, 53 and 55 of the image forming apparatus according to the second embodiment. The construction is such that misalignment of axes of these two is eliminated by positional correction that occurs with fitting of the transfer engagement gear 482 into the transfer rotary engagement section 483.

The transfer engagement gear 482 is fixed at one end of a drive output shaft 485, a drive output gear 484 being fixed to the other end of this drive output shaft 485. Rotary drive force of the drive gear 486 is sequentially transmitted to the drive output gear 484, transfer rotary engagement section 483, transfer engagement gear 482, drive roller gear 481 and drive roller 413 by meshing of this drive output gear 484 with this most upstream drive gear 486.

In this fourth modification, by positional correction achieved by movement of the transfer engagement gear 484 in the direction orthogonal to the direction of the rotary shaft thereof accompanying fitting thereof onto the transfer rotary engagement section 483, fluctuation of speed of rotation of the drive roller 413 caused by misalignment of axes of these two is eliminated. Also, in this way, misalignment of the position of transfer of the toner image caused by speed fluctuation of the endless movement of the paper feed belt 412 caused by fluctuation of the speed of rotation of the drive roller 413 can be suppressed.

In this fourth modification, there is a risk of creation of developing density unevenness for the following reasons. Specifically, first of all, in the transfer means constituted by the transfer device 411, vibration is generated due to meshing of the drive roller gear 481 with the transfer engagement gear 481. This vibration is sequentially transmitted to the developing sleeve through the shaft member 413*a*, the side plate 470 of the image forming apparatus main body and the developing sleeve shaft, not shown, or is transmitted from the drive roller 413 through the paper feed belt 412 to the photosensitive body 2, causing developing density unevenness.

The number of moving teeth on the path of movement of the drive roller gear 481 and transfer engagement gear 481 within the drive transmission gear train of the transfer device 411 during movement of the photosensitive body 2 by 1 mm at the surface thereof is respectively set to at least 0.72 teeth. By such setting, developing density unevenness caused by propagation to the photosensitive body of vibration generated by meshing of these two gears can be effectively suppressed.

(Fifth Modification)

Figure 33:
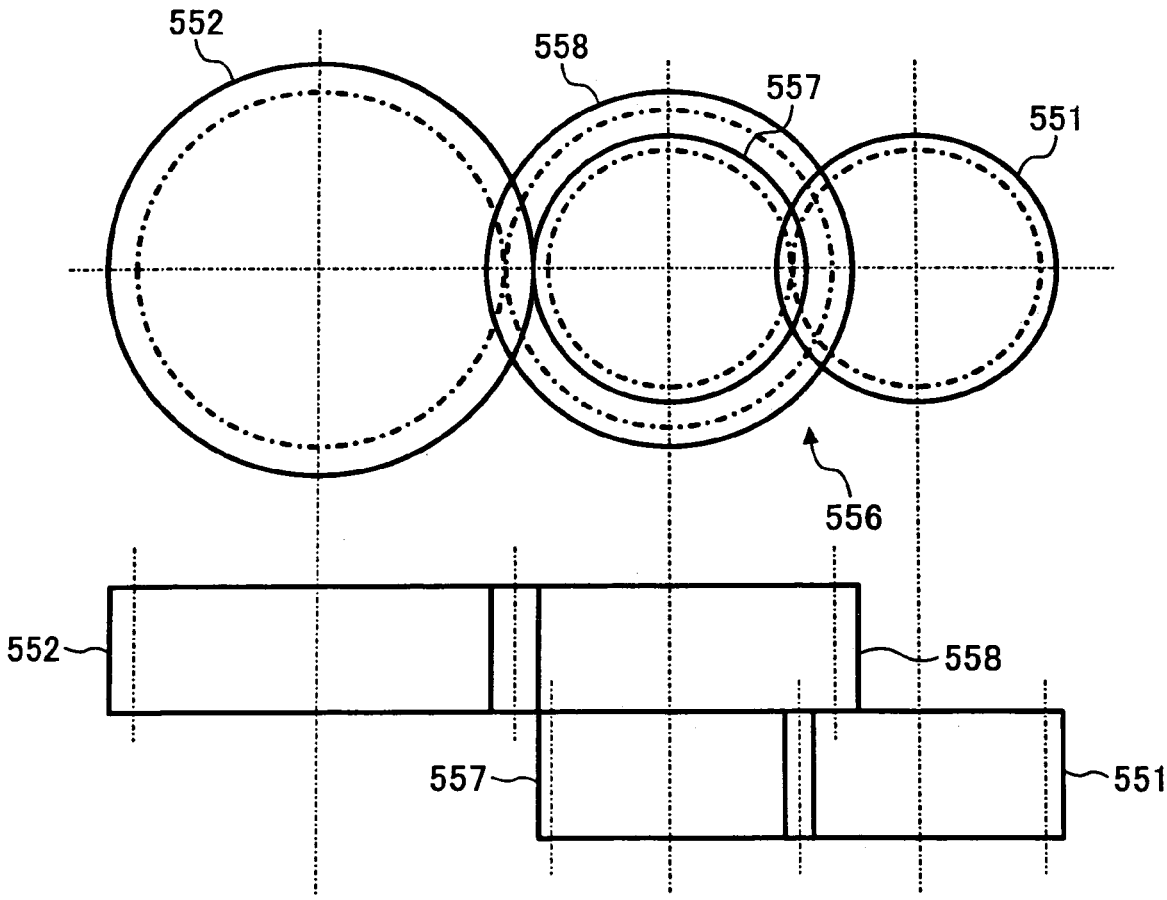
FIG. 33 is a diagram showing a drive transmission gear train in a developing device according to a fifth modification of the second embodiment.

FIG. 33 shows the drive transmission gear train in a developing device according to this fifth modification. In this drive transmission gear train, a relay gear unit 556 is interposed between the first gear 552 of the driven side rotary member that is held, by a holding shaft, not shown, in a manner capable of movement within the plane orthogonal to the direction of the rotary axes, and the roller gear 551 that is fixed to the developing sleeve shaft, not shown. This intermediate gear unit 556 comprises two gear stages integrally formed such that a small diameter gear 557 that meshes with the roller gear 551 and a larger diameter gear 558 of larger diameter than this are arranged to rotate mutually on the same rotary axis. Rotary drive force that is received by the first gear 552 is sequentially transmitted to the large diameter gear 558, small diameter gear 557 and roller gear 551, rotating the developing sleeve, not shown. The large diameter gear 558, small diameter gear 557 and roller gear 551 respectively act as downstream gears that transmit drive to the downstream side of the drive transmission direction further downstream from the first gear 552.

In this fifth modification, in the first gear 552, large diameter gear 558, small diameter gear 557 and roller gear 551, respectively, the number of moving teeth on the path of rotation of the gears during movement of the photosensitive body 2 through 1 mm at its surface is set to at least 0.72 teeth.

It should be noted that the image forming apparatuses described in the second embodiment and the various modifications thereof are merely examples of devices capable of being employed according to the present invention and the image forming apparatus according to the present invention is not restricted to these. Also, in the second embodiment and the modifications thereof, gears of modulus 0.8 or 0.6 could be employed for the respective gears.

In the image forming apparatus according to the second embodiment, since the image forming apparatus is demountably supported as a process unit on the image forming apparatus main body, the image forming apparatus can be easily replaced. Also, there is provided a driven side engagement section that is rotated by abutment and engagement in the direction of the rotary axis thereof with the drive side engagement section 62 formed at one end in the direction of the rotary axis of the drive side rotary member. With such a construction, with the drive side rotary member and driven side rotary member arranged sequentially on substantially the same axis, drive can be transmitted between these two. In addition, of the various gears within the drive transmission gear train, the first gear 52, to which the rotary drive force is initially transmitted from the drive motor constituting the drive source, is integrally formed with a projection 55 constituting a driven side engagement section and is arranged to be rotated on the same rotary axis as this. With this construction, by transmitting drive to a roller gear 51 constituting a downstream gear that is on the downstream side from this first gear 52, it is possible to rotate the developing sleeve on an axis different from that of the rotary shaft of the first gear 52.

Also, in an image forming apparatus according to this second embodiment, the developing device is provided with a holding shaft 54 constituting a holding element that holds the driven side engagement sections 53, 55 and the first gear 52 at least in a plane that is orthogonal to the direction of the rotary axis thereof, and the driven side engagement sections and first gear 52 move such that their own rotary axes approach the rotary axes of the drive side rotary member, with engagement of these respective driven side engagement sections with the drive side engagement section. In this way, fluctuation of the rotary speed of the developing sleeve produced by misalignment of the axes of the drive side rotary member and driven side rotary member can be eliminated.

Also, in an image forming apparatus according to this second embodiment, the first gear 52 and the roller gear 51, which is a gear on the downstream side meshing therewith, are subjected to negative shift. In this construction, due to the reason described above, as a result of the first gear 52 performing movement such as to approach the drive side axis by mounting of the developing device, even if the inter-axial distance of the first gear 52 and roller gear 51 is narrower than the set value, large speed fluctuations of the developing sleeve produced by abutment with the tooth troughs as between the two gears can be eliminated.

Also, in an image forming apparatus according to this second embodiment, the photosensitive body constituting the image carrier and the developing sleeve are arranged so as to face each other with a mutual developing gap of 0.1 to 0.4 mm. With such a construction, for the reasons described above, images of excellent dot reproducibility can be formed with no feeling of roughness.

Next, the results of tests using an image forming apparatus in which a photosensitive body is provided and in which two-component developer is fed and development is performed using a developing sleeve incorporating a fixed magnet roller will be described.

The test results are shown in FIG. 34.

Image fogging produced by the development conditions of two-component developer in an image forming apparatus according to this embodiment was evaluated. The number of toner particles producing contamination of a background region constituting a ground section when developing bias was applied to the photosensitive body potential was observed.

Figure 35:
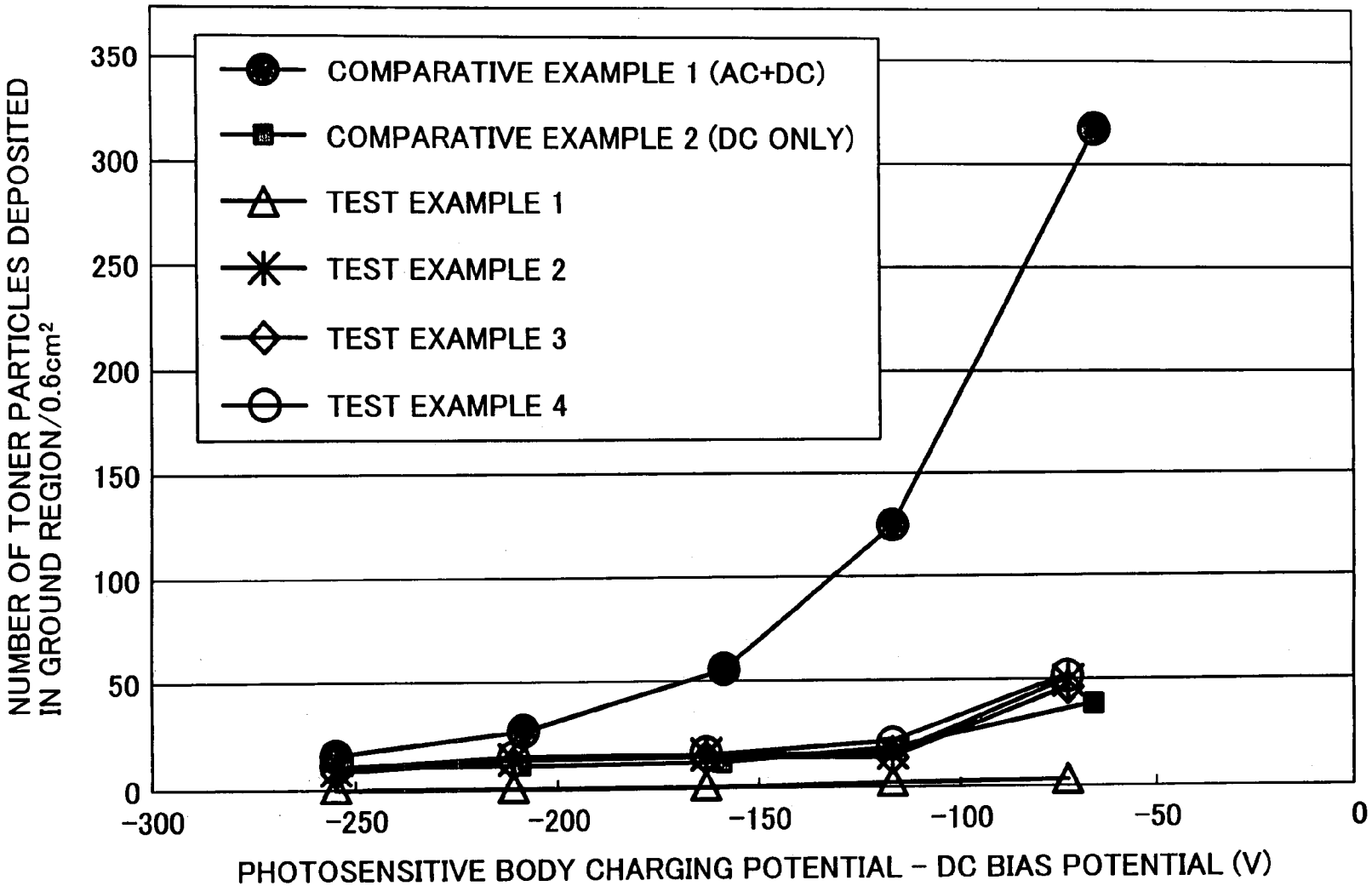
FIG. 35 is a graph showing the relationship between the developing bias and number of deposited toner particles for test examples and comparative examples.

FIG. 35 is a graph showing the relationship of the development bias and the number of toner particles deposited.

From Embodiments 1 to 4 and Comparative Examples 1 and 2, it can be seen that, although a DC/AC bias development system results in thinner toner density and a reduction in the total amount of toner ground contamination compared with a DC bias development system, ground contamination is markedly greater. This is because, whereas in the DC bias development system, movement and deposition onto the image carrier from the developing sleeve takes place unidirectionally, in the DC/AC bias development system, repeated movement takes place between the developing sleeve and the photosensitive body 2 in response to the AC frequency, thereby increasing the amount of ground contamination by dispersion into non-image regions. While Embodiment 1 is particularly advantageous in respect of ground contamination, it is inferred that this is due to the carrier particle size being smaller than in the case of the other embodiments and the frictional charging capability of the toner being higher than that of carrier of large particle size. It is believed that this is because reducing the carrier particle size increases the surface area of carrier for the same weight and, as a result, raises the probability of contact of the toner with the carrier, so charging of the toner is stabilized and the total amount of toner ground contamination becomes smaller.

Next, developing performance in the case where a uniform toner density of 7% was adopted will be discussed. The toner densities were matched, since, in evaluation of developing performance of developer, toner density is an extremely important factor. Accordingly, regarding the toner density in the test, evaluation of development performance at that toner density was conducted when the developer was matched beforehand with that toner density, with the test image forming apparatus used in a forced supply mode.

Figure 36:
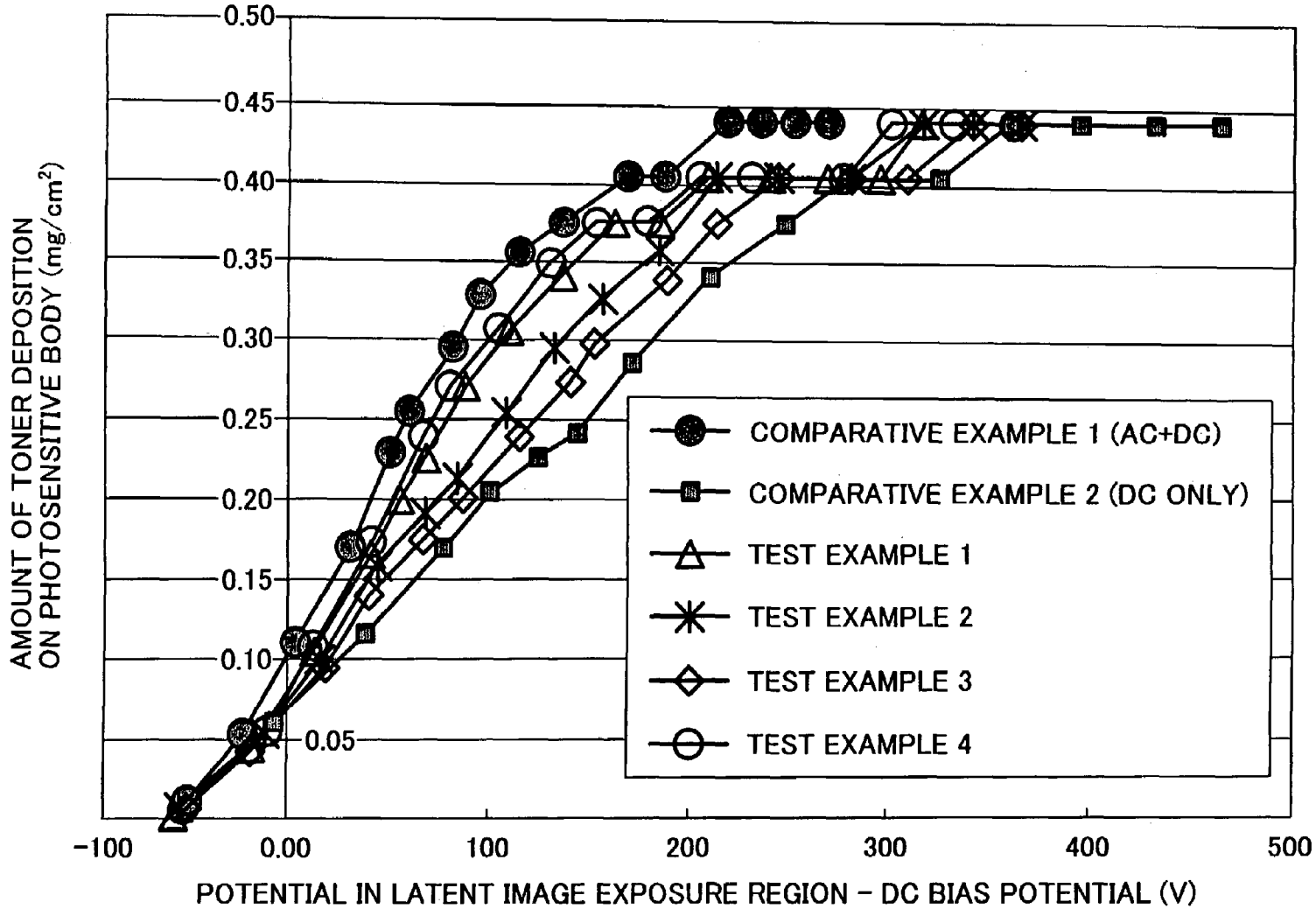
FIGS. 36 and 37 are graphs showing the relationship of the amount of deposited toner with the developing bias as a result of evaluation of development performance for test examples and comparative examples.

FIG. 36 is a graph showing the relationship of the amount of toner deposition with respect to developing bias obtained as a result of evaluation of development performance. The amount of deposition, plotted along the vertical axis, may be measured by using an electronic balance to measure the weight per unit area of developing toner collected from the developing body using a suction tool. Alternatively, the output voltage obtained by an optical density sensor provided in the image forming apparatus for test purposes may be converted into a measured value of toner density deposited on the photosensitive body using correlation data correlating this output voltage with the corresponding amount of toner.

As is clear from FIG. 36, the amount of toner deposited per unit area for the same developing potential (=potential of latent image exposure region—DC bias potential) is increased in the case of Embodiments 1 to 4 compared with the Comparative Example in which DC only was employed. Thus the developing performance approached that obtained with DC/AC development.

Furthermore, the test results were examined, using a reference level of 5%, with reference to the case in which the toner density was lower. However, in view of the fact that the frictional charging performance with respect to the toner is different for different carrier particle sizes, a toner density of 7% was employed solely in the case of 35 μm carrier, in order to achieve the same amount of charging irrespective of the carrier particle size.

Figure 37:
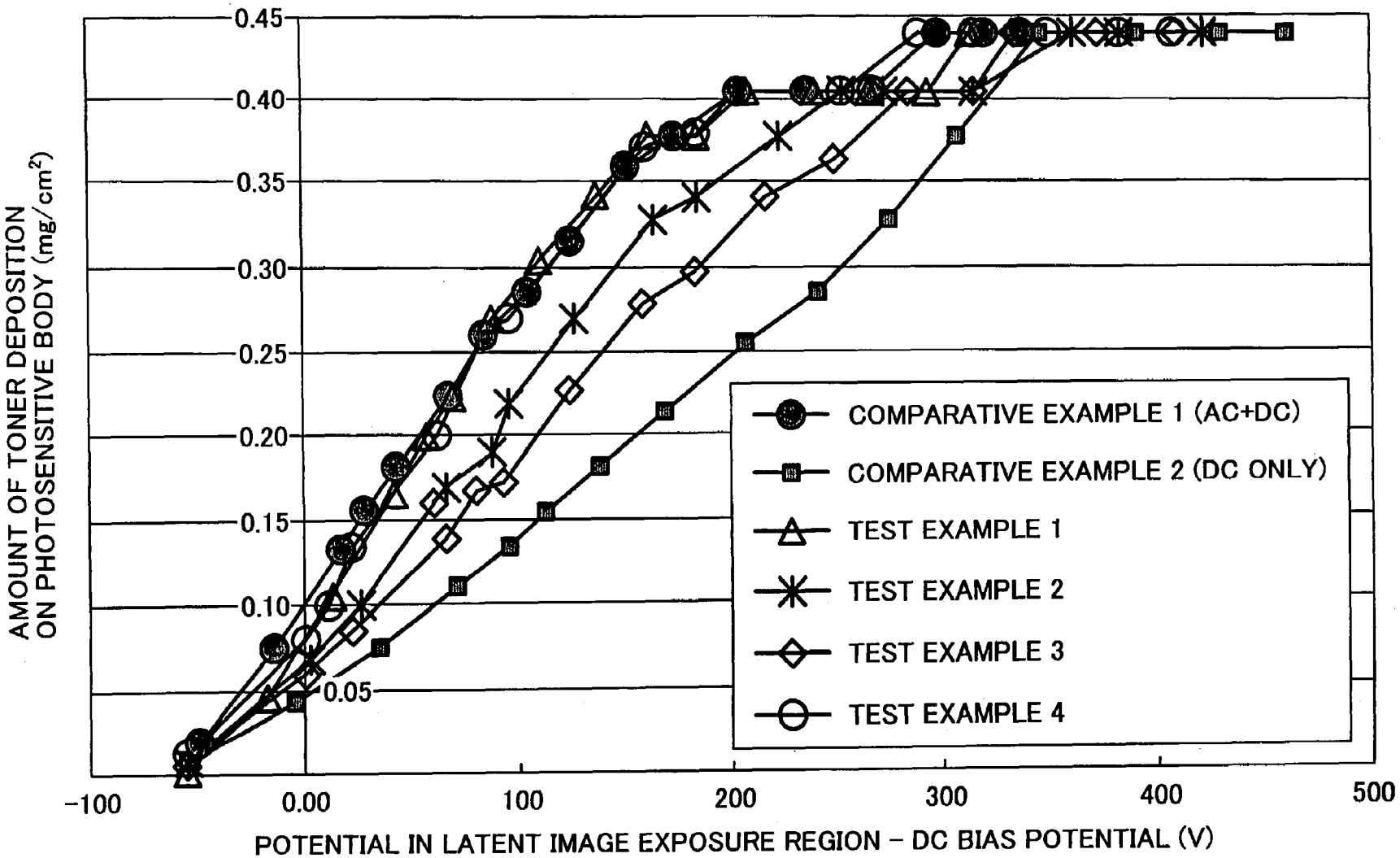

FIG. 37 is a graph showing the relationship of toner deposition amount with respect to developing bias obtained as a result of evaluation of development performance.

Although, in the case of development potential at which the amount of deposition reaches 0.45 mg/cm$^2$, which is a condition close to the limit of development performance, the output needs to be somewhat high, compared with the case where the toner density is 7%, the conditions of Embodiments 1 to 4 exhibit practically the same development performance as in the case of substantially DC/AC development under these conditions.

Also, as is clear from FIG. 37, regarding the amount of toner deposition per unit area, which is an index of developing performance, above a given development potential, deposition ceases, since a condition close to the limit is reached. Under a condition of toner density of 5%, deposition was substantially equivalent under the conditions of linear speed ratio 1.9 and 2.0; although not stated elsewhere, no improvement was seen even under conditions of linear speed ratio of 2.1. In contrast, the number of times of sliding friction of the magnetic brush with the photosensitive body increases with increase in the linear speed ratio, giving rise to loss of image density due to the scavenging effect. Accordingly, a linear speed ratio of no more than 2.0 is specified.

It should be noted that FIGS. 9 to 11 and the description thereof, which were referred to in the first embodiment of the present invention described above can be applied directly in the present embodiment, so repetition of this description is dispensed with. The description regarding measurement of amount of loss of image density can likewise be applied in the same way, so repetition of this description is also dispensed with.

As described above, with the process unit and image forming apparatus according to the second embodiment of the present invention, it is possible to reduce the vibration produced by impacts on contact of the teeth as the number of teeth is increased and the impulse produced by impact during contact per tooth is decreased; high quality images can thus be obtained by reducing development density unevenness produced by vibration generated by gear meshing to a degree such that this development density unevenness cannot be recognized visually.

Furthermore, it becomes possible to reduce the phenomenon of loss of image density generated at the boundary of high-density image portions and low-density image portions, by a comparatively simple combination of development conditions, without lowering the development performance.

In addition, decrease can be achieved in the extent to which loss of image density occurs due to flying off of developer and the edge effect, that takes place as a side-effect under development conditions aimed at promoting increased development performance.

Various modifications will become possible for those skilled in the art after receiving the teachings of the present disclosure without departing from the scope thereof.

What is claimed is:

1. An image forming apparatus comprising:

an image carrier;

a developer carrier comprising a plurality of magnetic poles fixedly arranged within a rotating non-magnetic sleeve, for carrying on its surface as a magnetic brush two-component developer containing toner and carrier and for supplying toner in a development region facing this image carrier to a latent image on this image carrier; and a transfer body onto which the toner image on this image carrier is transferred; wherein said transfer body is arranged above said image carrier and said developer carrier; and the center line of the half value width of the magnetic field produced by a developing magnetic pole for erecting the magnetic brush in the form of spikes in said development region is below the line segment joining the center of rotation of this image carrier and the center of rotation of this developer carrier.

2. The image forming apparatus as claimed in claim 1, wherein said center line of the half value width has an angle of at least 2° but no more than 8.5° with respect to the line segment joining the center of rotation of this image carrier and the center of rotation of this developer carrier.

3. The image forming apparatus as claimed in claim 2, further comprising a developer regulating member provided below the developer carrier for regulating the layer thickness of the developer on the developer carrier.

4. The image forming apparatus as claimed in claim 3, further comprising two developing feed screws that stir and feed the developer provided below the developer regulating member.

5. The image forming apparatus as claimed in claim 4, wherein the transfer body comprises a transfer belt arranged so as to be extended horizontally.

6. The image forming apparatus as claimed in claim 1, further comprising a developer receiving member that receives developer falling down from the surface of this image carrier, constituted by a resilient member and arranged such that its free end contacts the surface of said image carrier below said center line of the half value width.

7. The image forming apparatus as claimed in claim 6, further comprising a developer regulating member provided below the developer carrier for regulating the layer thickness of the developer on the developer carrier.

8. The image forming apparatus as claimed in claim 7, further comprising two developing feed screws that stir and feed the developer provided below the developer regulating member.

9. The image forming apparatus as claimed in claim 8, wherein the transfer body comprises a transfer belt arranged so as to be extended horizontally.

10. The image forming apparatus as claimed in claim 1 wherein said toner is polymer toner.

11. The image forming apparatus as claimed in claim 10 wherein the volume average particle size of said toner is at least 3 μm but no more than 8 μm and the ratio (Dv/Dn) of the volume average particle size (Dv) and the number average particle size (Dn) is at least 1.0 but no more than 1.40.

12. The image forming apparatus as claimed in claim 10 wherein said toner has a shape factor SF-1 of at least 100 but no more than 180 and a shape factor SF-2 of at least 100 but no more than 180.

13. The image forming apparatus as claimed in claim 10 wherein said toner is toner obtained by cross linkage and/or elongation reaction, in an aqueous medium, of toner material in which polyester prepolymer having at least a functional group containing a nitrogen atom, polyester, coloring agent and release agent are dispersed in an organic solvent.

14. The image forming apparatus as claimed in claim 10 wherein the shape of said toner is defined by a long axis r1, short axis r2 and thickness r3 (where r1≧r2≧r3) and the ratio of the long axes r1 and short axis r2 (r2/r1) is at least 0.5 but no more than 1.0 and the ratio of the thickness r3 and short axis r2 (r3/r2) is at least 0.7 but no more than 1.0.

15. The image forming apparatus as claimed in claim 1 wherein a system for application of voltage to said non-magnetic sleeve is a DC bias application system using a DC bias developing system.

16. The image forming apparatus as claimed in claim 15 wherein the developing gap between said image carrier and said developer carrier is at least 0.25 mm but no more than 0.45 mm.

17. The image forming apparatus as claimed in claim 15 wherein the ratio (Vs/Vp) of a linear speed Vp of the image carrier and a linear speed Vs of the developer carrier is at least 1.7 but no more than 2.0.

18. The image forming apparatus as claimed in claim 1, further comprising a developer regulating member provided below the developer carrier for regulating the layer thickness of the developer on the developer carrier.

19. The image forming apparatus as claimed in claim 18, further comprising two developing feed screws that stir and feed the developer provided below the developer regulating member.

20. The image forming apparatus as claimed in claim 19, wherein the transfer body comprises a transfer belt arranged so as to be extended horizontally.

21. A process unit that is removably mountable on the main body of an image forming apparatus, comprising:

an image carrier that carries at least a latent image on its surface;

a developer carrier that moves carrying developer;

a developing device that develops a latent image on said image carrier by means of developer carried on the moving surface of this image carrier; and a drive transmission gear train comprising a plurality of gears that relay rotary drive force that is transmitted from a drive source provided on the image forming apparatus main body and transmit this rotary drive force to this developer carrier, wherein the number of moving teeth on the path of rotation of the respective gears that constitute said drive transmission gear train during movement by 1 mm over the surface of said image carrier is at least 0.72 teeth.

22. The process unit as claimed in claim 21, further comprising a drive side engagement section that is formed at the end in the direction of the rotary axis of a drive side rotary member provided on the image forming apparatus main body so as to transmit rotary drive force from said drive source to said drive transmission gear train at a position on the drive side from said drive transmission gear train; and a driven side engagement section that is rotated by abutment and engagement with this drive side engagement section in the direction of the rotary axis; wherein, of the gears in said drive transmission gear train, a first gear to which rotary drive force from said drive source is initially transmitted is integrally formed with said driven side engagement section and rotates on the same rotary axis as said driven side engagement section.

23. The process unit as claimed in claim 22, further comprising a holding element that holds said driven side engagement section and said first gear in moveable fashion at least in a plane orthogonal to the direction of the rotary axis thereof, wherein, with engagement of said driven side engagement section and said drive side engagement section, this driven side engagement section and this first gear move so that their own rotary axes approach the rotary axis of said drive side rotary member.

24. The process unit as claimed in claim 23 wherein at least said first gear and the downstream gear that meshes therewith are negative-shifted.

25. The process unit as claimed in claim 21 wherein a developing bias that is applied to said developer carrier is DC voltage, and a linear speed ratio Vs/Vp of a linear speed Vp of said image carrier and the linear speed Vs of said developer carrier is in the range 1.7 to 2.0, and a developing gap Gp of said image carrier and said developer carrier is in the range 0.1 to 0.45 mm.

26. An image forming apparatus comprising:

an image carrier that carries at least a latent image on its moving surface;

a developer carrier that moves carrying developer;

a developing device that develops a latent image on said image carrier by means of developer carried on the moving surface of this image carrier; and a drive source that drives in rotation said developer carrier;

said developing device comprising a drive transmission gear train comprising a plurality of gears that relay rotary drive force that is transmitted from said drive source and transmit this rotary drive force to said developer carrier, wherein the number of moving teeth on the path of rotation of the respective gears within said drive transmission gear train during movement by 1 mm over the surface of said image carrier is at least 0.72 teeth.

27. The image forming apparatus as claimed in claim 26, further comprising a drive side rotary member provided on an image forming apparatus main body so as to transmit rotary drive force from said drive source to said drive transmission gear train at a position on the drive side from said drive transmission gear train; wherein the developing device that is removably supported on this image forming apparatus main body comprises a drive side engagement section formed at the end in the direction of the rotary axis of said drive side rotary member, and a driven side engagement section that is rotated by abutment and engagement with the drive side engagement section in the direction of the rotary axis; and wherein, of the gears in said drive transmission gear train, a first gear to which rotary drive force from said drive source is initially transmitted is integrally formed with said driven side engagement section and rotates on the same rotary axis as said driven side engagement section.

28. The image forming apparatus as claimed in claim 27, wherein said developing device comprises a holding element that holds said driven side engagement section and this first gear in moveable fashion at least in a plane orthogonal to the direction of the rotary axis thereof, and wherein, with engagement of said driven side engagement section and said drive side engagement section, this driven side engagement section and this first gear move so that their own rotary axes approach the rotary axis of said drive side rotary member.

29. The image forming apparatus as claimed in claim 28, wherein at least said first gear and the downstream gear that meshes therewith are negative-shifted.

30. The image forming apparatus as claimed in claim 26, wherein a developing bias that is applied to said developer carrier is DC voltage, and the linear speed ratio Vs/Vp of a linear speed Vp of said image carrier and a linear speed Vs of said developer carrier is in the range 1.7 to 2.0, and a developing gap Gp of said image carrier and said developer carrier is in the range 0.1 to 0.45 mm.

31. An image forming apparatus comprising:

an image carrier that carries at least a latent image on its moving surface;

a developer carrier that moves carrying developer;

a developing device that develops a latent image on said image carrier by means of developer carried on the moving surface of this image carrier;

a transfer device that transfers a visible image on said image carrier onto a surface-movement element whose surface moves in a position facing said image carrier or a recording body carried on the surface of this surface-movement element; and a drive source that provides drive force to said surface-movement element; wherein said transfer device comprises a drive transmission gear train comprising a plurality of gears that relay rotary drive force that is transmitted from said drive source that is provided on the image forming apparatus main body and transmit this rotary drive force to said surface-movement element, and wherein the number of moving teeth on the path of rotation of the respective gears within said drive transmission gear train during movement by 1 mm over the surface of said image carrier is at least 0.72 teeth.

32. The image forming apparatus as claimed in claim 31 further comprising a drive side rotary member provided on an image forming apparatus main body so as to transmit rotary drive force from said drive source to said drive transmission gear train at a position on the drive side from said drive transmission gear train; wherein the transfer device that is removably supported on this image forming apparatus main body comprises a drive side engagement section formed at the end in the direction of the rotary axis of said drive side rotary member, and a driven side engagement section that is rotated by abutment and engagement with the drive side engagement section in the direction of the rotary axis; and wherein, of the gears in said drive transmission gear train, a first gear to which rotary drive force from said drive source is initially transmitted is integrally formed with said driven side engagement section and rotates on the same rotary axis as said driven side engagement section.

33. The image forming apparatus as claimed in claim 32 wherein said transfer device comprises a holding element that holds said driven side engagement section and said first gear in moveable fashion at least in a plane orthogonal to the direction of the rotary axis thereof, and wherein, with engagement of said driven side engagement section and said drive side engagement section, this driven side engagement section and this first gear move so that their own rotary axes approach the rotary axis of said drive side rotary member.

34. The image forming apparatus as claimed in claim 33 wherein at least said first gear and the downstream gear that meshes therewith are negative-shifted.

35. The image forming apparatus as claimed in claim 31 wherein a developing bias that is applied to said developer carrier is DC voltage, and the linear speed ratio Vs/Vp of a linear speed Vp of said image carrier and a linear speed Vs of said developer carrier is in the range 1.7 to 2.0, and a developing gap Gp of said image carrier and said developer carrier is in the range 0.1 to 0.45 mm.

36. An image forming apparatus comprising:

an image carrier that carries a latent image on its moving surface;

a developer carrier that moves carrying developer; and a developing device that develops a latent image on said image carrier by means of developer carried on the moving surface of this image carrier; wherein a developing bias that is applied to said developer carrier is DC voltage;

the linear speed ratio Vs/Vp of a linear speed Vp of said image carrier and a linear speed Vs of said developer carrier is in the range 1.7 to 2.0; and a developing gap Gp of said image carrier and said developer carrier is in the range 0.1 to 0.45 mm, wherein two-component developer in which carrier and toner are mixed are employed as said developer, and wherein the volume average particle size of said toner is 3 to 8 μm and the ratio (Dv/Dn) of the volume average particle size (Dv) and the number average particle size (Dn) is in the range 1.00 to 1.40.

37. The image forming apparatus as claimed in claim 36 wherein the toner that is used in said developing device has a shape factor SF-1 in the range 100 to 180 and a shape factor SF-2 in the range 100 to 180.

38. The image forming apparatus as claimed in claim 36 wherein said toner that is used in said developing device is toner obtained by cross linkage and/or elongation reaction, in an aqueous medium, of toner material in which polyester prepolymer having at least a functional group containing a nitrogen atom, polyester, coloring agent and release agent are dispersed in an organic solvent.

39. The image forming apparatus as claimed in claim 38 wherein the toner that is used in said developing device is substantially spherical in shape.

40. The image forming apparatus as claimed in claim 39 wherein the shape of said toner is defined by a long axis r1, short axis r2 and thickness r3 (where r1≧r2≧r3) and the ratio of the long axis r1 and short axis r2 (r2/r1) is in the range 0.5 to 1.0 and the ratio of the thickness r3 and short axis r2 (r3/r2) is in the range 0.7 to 1.0.

41. The image forming apparatus as claimed in claim 36 wherein the surface of the magnetic particles of said carrier is covered with resin, and the volume average particle size of said carrier is in the range 30 to 80 μm.

42. The image forming apparatus as claimed in claim 41 wherein the electrical resistance of said carrier is in the range 6 to 10 Log Ω·cm.

43. An image forming apparatus comprising:

an image carrier that carries a latent image on its moving surface:

a developer carrier that moves carrying developer; and a developing device that develops a latent image on said image carrier by means of developer carried on the moving surface of this image carrier; wherein a developing bias that is applied to said developer carrier is DC voltage;

the linear speed ratio Vs/Vp of a linear speed Vp of said image carrier and a linear speed Vs of said developer carrier is in the range 1.7 to 2.0; and a developing gap Gp of said image carrier and said developer carrier is in the range 0.1 to 0.45 mm, wherein said developer carrier incorporates a magnet roller having a plurality of magnetic poles and said magnet roller comprises a main magnetic pole that forms a magnetic brush for causing sliding contact of developer with said image carrier, and wherein the angle made by the line joining the center of the half value width of the magnetic field produced by said main magnetic pole and the center of rotation of said developer carrier with the line joining the center of rotation of said image carrier and the center of rotation of said developer carrier is in the range 2° to 85° with respect to the upstream direction in which said developer carrier rotates.

44. The image forming apparatus as claimed in claim 43 wherein two-component developer in which carrier and toner are mixed is employed as said developer.

45. The image forming apparatus as claimed in claim 44 wherein the volume average particle size of said toner is 3 to 8 μm and the ratio (Dv/Dn) of the volume average particle size (Dv) and the number average particle size (Dn) is 1.00 to 1.40.

46. The image forming apparatus as claimed in claim 45 wherein the toner that is used in said developing device has a shape factor SF-1 in the range 100 to 180 and a shape factor SF-2 in the range 100 to 180.

47. The image forming apparatus as claimed in claim 45 wherein the toner that is used in said developing device is toner obtained by cross linkage and/or elongation reaction, in an aqueous medium, of toner material in which polyester prepolymer having at least a functional group containing a nitrogen atom, polyester, coloring agent and release agent are dispersed in an organic solvent.

48. The image forming apparatus as claimed in claim 47 wherein the toner that is used in said developing device is substantially spherical in shape.

49. The image forming apparatus as claimed in claim 48 wherein the shape of said toner is defined by a long axis r1, short axis r2 and thickness r3 (where r1≧r2≧r3) and the ratio of the long axis r1 and short axis r2 (r2/r1) is in the range 0.5 to 1.0 and the ratio of the thickness r3 and short axis r2 (r3/r2) is in the range 0.7 to 1.0.

50. The image forming apparatus as claimed in claim 44 wherein the surface of the magnetic particles of said carrier is covered with resin, and the volume average particle size of said carrier is in the range 30 to 80 μm.

51. The image forming apparatus as claimed in claim 50 wherein the electrical resistance of said carrier is in the range 6 to 10 Log Ω·cm.

52. An image forming apparatus comprising:

an image carrier that carries a latent image on its surface;

a developer carrier that moves carrying developer; and a developing device that develops a latent image on said image carrier by means of developer carried on a moving surface of this image carrier, wherein said developer carrier incorporates a magnet roller comprising a plurality of magnetic poles;

said magnet roller comprises a main magnetic pole that forms a magnetic brush for causing sliding contact of developer with said image carrier;

and the angle R made by the line joining the center of the half value width of the magnetic field produced by said main magnetic pole and the center of rotation of said developer carrier with the line joining the center of rotation of said image carrier and the center of rotation of said developer carrier is in the range 2° to 8.5° with respect to the upstream direction in which said developer carrier rotates.

* * * * *